US005502462A

United States Patent [19]

Mical et al.

[11] Patent Number: 5,502,462

[45] Date of Patent: Mar. 26, 1996

[54] DISPLAY LIST MANAGEMENT MECHANISM FOR REAL-TIME CONTROL OF BY-THE-LINE MODIFIABLE VIDEO DISPLAY SYSTEM

[75] Inventors: Robert J. Mical, Redwood City; David L. Needle, Alameda; Stephen H. Landrum, San Leandro; Teju Khubchandani, Mountain View, all of Calif.

[73] Assignee: The 3DO Company, Redwood City, Calif.

[21] Appl. No.: 146,505

[22] Filed: Nov. 1, 1993

[51] Int. Cl.[6] ..... G09G 5/00

[52] U.S. Cl. ..... 345/185; 345/199

[58] Field of Search ..... 345/122, 199, 345/185, 203, 112; 395/152, 153

[56] References Cited

U.S. PATENT DOCUMENTS

| | | | |
|---|---|---|---|
| 4,045,789 | 8/1977 | Bristow | 340/324 |
| 4,760,390 | 7/1988 | Maine et al. . | |
| 4,799,053 | 1/1989 | Van Aken et al. | 345/199 |
| 4,864,289 | 9/1989 | Nishi et al. | 345/122 |
| 5,065,343 | 11/1991 | Inoue | 395/162 |
| 5,252,953 | 10/1993 | Sandrew et al. | 345/122 |

*Primary Examiner*—Richard Hjerpe
*Assistant Examiner*—Regina Liang
*Attorney, Agent, or Firm*—Fliesler, Dubb, Meyer & Lovejoy

[57] ABSTRACT

The invention provides a method and apparatus for managing color modification of a raster based image on a real time, line-by-line basis and for managing real-time of new imagery into buffers whose data is displayable.

10 Claims, 3 Drawing Sheets

DISPLAY LIST MANAGEMENT MECHANISM FOR REAL-TIME CONTROL OF BY-THE-LINE MODIFIABLE VIDEO DISPLAY SYSTEM

BACKGROUND

1. Field of the Invention

The invention relates generally to digital image processing and the display of digitally generated images. The invention relates more specifically to the problem of creating raster-based, high-resolution animated images in real time, where the mechanism for generating each raster line is modifiable on a by-the-line or on a by-a-group of lines basis.

2a. Copyright Claims to Disclosed Code

A portion of the disclosure of this patent document contains material which is subject to copyright protection. The copyright owner has no objection to the facsimile reproduction by anyone of the patent document or the patent disclosure as it appears in the U.S. Patent and Trademark Office patent file or records, but otherwise reserves all copyright rights whatsoever.

In particular, this application includes C language source-code listings of a variety of computer program modules. These modules can be implemented by way of a computer program, microcode, placed in a ROM chip, on a magnetic or optical storage medium, and so forth. The function of these modules can also be implemented at least in part by way of combinatorial logic. Since implementations of the modules which are deemed to be "computer programs" are protectable under copyright law, copyrights not otherwise waived above in said modules are reserved. This reservation includes the right to reproduce the modules in the form of machine-executable computer programs.

2b. Cross Reference to Related Applications

This application is related to:

PCT Patent Application Serial No. PCT/US92/09342, entitled RESOLUTION ENHANCEMENT FOR VIDEO DISPLAY USING MULTI-LINE INTERPOLATION, by inventors Mical et al., filed Nov. 2, 1992, Attorney Docket No. MDIO3050, and also to U.S. patent application Ser. No. 07/970,287, bearing the same title, same inventors and also filed Nov. 2, 1992;

PCT Patent Application Serial No. PCT/US92/09349, entitled AUDIO/VIDEO COMPUTER ARCHITECTURE, by inventors Mical et al., filed Nov. 2, 1992, Attorney Docket No. MDIO4222, and also to U.S. patent application Ser. No. 07/970,308, bearing the same title, same inventors and also filed Nov. 2, 1992;

PCT Patent Application Serial No. PCT/US92/09348, entitled METHOD FOR GENERATING THREE DIMENSIONAL SOUND, by inventor David C. Platt, filed Nov. 2, 1992, Attorney Docket No. MDIO4220, and also to U.S. patent application Ser. No. 07/970,274, bearing the same title, same inventor and also filed Nov. 2, 1992;

PCT Patent Application Serial No. PCT/US92/09350, entitled METHOD FOR CONTROLLING A SPRYTE RENDERING PROCESSOR, by inventors Mical et al., filed Nov. 2, 1992, Attorney Docket No. MDIO3040, and also to U.S. patent application Ser. No. 07/970,278, bearing the same title, same inventors and also filed Nov. 2, 1992;

PCT Patent Application Serial No. PCT/US92/09462, entitled SPRYTE RENDERING SYSTEM WITH IMPROVED CORNER CALCULATING ENGINE AND IMPROVED POLYGON-PAINT ENGINE, by inventors Needle et al., filed Nov. 2, 1992, Attorney Docket No. MDIO4232, and also to U.S. patent application Ser. No. 07/970,289, bearing the same title, same inventors and also filed Nov. 2, 1992;

PCT Patent Application Serial No. PCT/US92/09460, entitled METHOD AND APPARATUS FOR UPDATING A CLUT DURING HORIZONTAL BLANKING, by inventors Mical et al., filed Nov. 2, 1992, Attorney Docket No. MDIO4250, and also to U.S. patent application Ser. No. 07/969,994, bearing the same title, same inventors and also filed Nov. 2, 1992;

PCT Patent Application Serial No. PCT/US92/09467, entitled IMPROVED METHOD AND APPARATUS FOR PROCESSING IMAGE DATA, by inventors Mical et al., filed Nov. 2, 1992, Attorney Docket No. MDIO4230, and also to U.S. patent application Ser. No. 07/970,083, bearing the same title, same inventors and also filed Nov. 2, 1992; and PCT Patent Application Serial No. PCT/US92/09384, entitled PLAYER BUS APPARATUS AND METHOD, by inventors Needle et al., filed Nov. 2, 1992, Attorney Docket No. MDIO4270, and also to U.S. patent application Ser. No. 07/970,151, bearing the same title, same inventors and also filed Nov. 2, 1992.

The related patent applications are all commonly assigned with the present application and are all incorporated herein by reference in their entirety.

The present application is to be considered a continuation-in-part of one or more of the above cited, co-pending applications, including at least one of: U.S. patent application Ser. No. 07/970,287, filed Nov. 2, 1992 and entitled RESOLUTION ENHANCEMENT FOR VIDEO DISPLAY USING MULTI-LINE INTERPOLATION; U.S. patent application Ser. No. 07/969,994, filed Nov. 2, 1992 and entitled METHOD AND APPARATUS FOR UPDATING A CLUT DURING HORIZONTAL BLANKING; and U.S. patent application Ser. No. 07/970,289, filed Nov. 2, 1992 and entitled SPRYTE RENDERING SYSTEM WITH IMPROVED CORNER CALCULATING ENGINE AND IMPROVED POLYGON-PAINT ENGINE.

3. Description of the Related Art

In recent years, the presentation and prepresentation processing of visual imagery has shifted from what was primarily an analog electronic format to an essentially digital format.

Unique problems come to play in the digital processing of image data and the display of such image data. The more prominent problems include providing adequate storage capacity for digital image data and maintaining acceptable data throughput rates while using hardware of relatively low cost. In addition, there is the problem of creating a sense of realism in digitally generated imagery, particularly in animated imagery.

The visual realism of imagery generated by digital video game systems, simulators and the like can be enhanced by providing special effects such as moving sprites, real-time changes in shadowing and/or highlighting, smoothing of contours and so forth.

Visual realism can be further enhanced by increasing the apparent resolution of a displayed image so that it has a smooth photography-like quality rather than a grainy disjoined-blocks appearance of the type found in low-resolution computer-produced graphics of earlier years.

Visual realism can be even further enhanced by increasing the total number of different colors and/or shades in each displayed frame of an image so that, in regions where colors and/or shades are to change in a smooth continuum by subtle degrees of hue/intensity, the observer perceives such a smooth photography-like variation of hue/intensity rather than a stark and grainy jump from one discrete color/shade to another. Glaring changes of color/shade are part of the reason that computer-produced graphics of earlier years had a jagged appearance rather than a naturally smooth one.

Although bit-mapped computer images originate as a matrix of discrete lit or unlit pixels, the human eye can be fooled into perceiving an image having the desired photography-like continuity if the displayed matrix of independently-shaded (and/or independently colored) pixels has dimensions of approximately 500-by-500 pixels or better at the point of display and a large variety of colors and/or shades on the order of roughly 24 bits-per-pixel or better.

The VGA graphics standard, which is used in many present-day low-cost computer systems, approximates this effect with a display matrix having dimensions of 640-by-480 pixels. However, conventional low-cost VGA graphic systems suffer from a limited per-frame palette of available colors and/or shades.

Standard NTSC broadcast television systems also approximate the continuity mimicking effect by using interlaced fields with 525 lines per pair of fields and a horizontal scan bandwidth (analog) that is equivalent to approximately 500 RGB colored dots per line.

More advanced graphic display standards such as Super-VGA and High Definition Television (HDTV) rely on much higher resolutions, 1024-by-786 pixels for example. It is expected that display standards with even higher resolution numbers (e.g., 2048-by-2048) will emerge in the future. It is expected that the number of bits per displayed pixel will similarly increase in the future.

As resolutions increase, and a wider variety of colors/shades per frame is sought, the problem of providing adequate storage capacity for the corresponding digital image data becomes more acute. The problem of providing sufficient data processing throughput rates also becomes more acute. This is particularly so if an additional constraint is imposed of keeping hardware costs within acceptable price versus performance range.

A display with 640-by-480 independent pixels (307,200 pixels total) calls for a video-speed frame buffer having at least 19 address bits or a corresponding $2^{19}$ independently-addressable data words (=512K words), where each data word stores a binary code representing the shading and/or color of an individual pixel. Each doubling of display resolution, say from 640-by-480 pixels to 1280-by-960 pixels, calls for a four-fold increase in the storage capacity of the frame buffer. Each doubling of per-pixel color/shade variation, say from 8 bits-per-pixel to 16 bits-per-pixel, calls for an additional two-fold increase in storage capacity. This means that a system starting with a display of 8 bits-per-pixel and 640-by-480 independent pixels per screen would conventionally require a memory increase from 512K bytes to 4 MB (four Megabytes) as a result of doubling both the number of pixels per row and column and the number of bits-per-pixel. And in cases where parts or all of the resultant 1280-by-960 display field have to be modified in real-time (to create a sense of animation), the eight-fold increase of storage capacity calls for a corresponding eight-fold increase in data processing bandwidth (image bits processed per second) as compared to what was needed for processing the original, 8 bits-per-pixel, 640-by-480 pixels field.

The benefit versus cost ratio incurred by meeting demands for more storage capacity and faster processing speed has to be questioned at some point. Perhaps a given increase in performance is not worth the increase in system cost. On the other hand, it might be possible to create a perception of improved performance without suffering a concomitant burden of significantly higher cost.

Such an objective can be realized by using a High-performance, Inexpensive, Image-Rendering system (HI-IR system) such as disclosed in the above cited set of co-related patent applications. In particular, part of the low-cost and high-performance of the HI-IR system is owed to the use, in a display-defining path of the system, of a Color LookUp Table (CLUT) whose contents are modifiable on a by-the-line basis. Details of this CLUT system may be found in the above-cited PCT Patent Application Serial No. PCT/US92/09460, entitled METHOD AND APPARATUS FOR UPDATING A CLUT DURING HORIZONTAL BLANKING, by inventors Mical et al., filed Nov. 2, 1992.

Another part of the low-cost and high-performance of the HI-IR system is owed to the use, in the display-defining path of the system, of a subposition-weighted Interpolator whose subposition weights are modifiable on a by-the-pixel basis and whose mode of operation (horizontal-interpolation on/off and vertical-interpolation on/off) is modifiable on a by-the-line or by-the-frame basis.

Yet another part of the low-cost and high-performance of the HI-IR system is owed to the use, in the display-defining path of the system, of a slip-stream mechanism in which "background" pixels can be replaced or not, on a modifiable by-the-line basis, with so-called externally-provided slip-stream video data to create a picture-in-picture or another like effect. A description of this slipstream process may be found in the above-cited PCT Patent Application Serial No. PCT/US92/09349, entitled AUDIO/VIDEO COMPUTER ARCHITECTURE, by inventors Mical et al.

Still another part of the low-cost and high-performance of the HI-IR system is owed to the use, in a bitmap-defining portion of the system, of a unique set of one or more "spryte" rendering engines (also called cel animating engines) for executing a list of bitmap modifications stored in a queue. A description of this mechanism may be found in the above cited PCT Patent Application Serial No. PCT/US92/09350, entitled METHOD FOR CONTROLLING A SPRYTE RENDERING PROCESSOR, and also PCT Patent Application Serial No. PCT/US92/09462, entitled SPRYTE RENDERING SYSTEM WITH IMPROVED CORNER CALCULATING ENGINE AND IMPROVED POLYGON-PAINT ENGINE.

The rich assortment of capabilities that are made possible by these and other mechanisms of the HI-IR system provide benefits on the one hand, but create a new set of problems on the other hand.

In particular, it becomes a problem to manage and coordinate attempts by one or more application programs to alter the configuration of the display-defining path of the HI-IR system, or to change the operations of the spryte-rendering portion of the HI-IR system. Each operational change that is made either to the display-defining path of the HI-IR system, or to the spryte-rendering portion of the HI-IR system, can result in desired-beneficial changes to what is shown on the display monitor or it can just as easily produce undesired-detrimental changes to what is shown on the display monitor.

The desired-beneficial changes are, of course, no problem. Examples include the creation of a photography-quality background scene over which animated "spryres" move.

The undesired-detrimental changes can give nontechnical users of the machine a wrong impression of what is happening to their machine. Such users may come to believe that something has become permanently damaged within their machine (even though this is not true) and the users may then come to form a poor opinion of the machine's performance capabilities. It is preferable to give nontechnical users an impression that the machine is "robust" and can perform even under adverse conditions where an ill-behaved application program is installed in the machine.

There are some portions of the display-defining path of the HI-IR system, for example, that should be "configured" one time only, during the power-up/reset phase of machine operation (initialization phase). An example is the setting of a video-display driver within the system to an NTSC television drive mode or a PAL television drive mode. An ill-behaved module within an application program might inadvertently load a new configuration into the system after power-up/reset and thereby cause the entire display to show out-of-synch noise or "garbage". It may not be possible to fix this problem other than by shutting power off and restarting the machine. This type of "fix" is undesirable because it gives nontechnical users a notion that their machine is not as "robust" as they would like it to be. Manufacturers wish to continuously leave consumers with an impression that the machine they purchased is "robust" and is able to continue functioning in some minimal way even if loaded with an ill-behaved application programs.

On the other hand, manufacturers wish to make machines that are easily reconfigured to meet the requirements of specific markets. Systems sold in the United States are preferably configured, for example, to conform to the NTSC television standard while systems sold in Europe are preferably configured to conform to the PAL television standard.

A first presented problem is therefore how to permit easy reconfiguration of machines to conform with standards of different markets and yet at the same time avoid the appearance of less than robust, machine performance even in the case where an ill-behaved application program manages to enter the system.

Another problem relates to making sure that certain post-initialization reconfigurations of the display-defining path of the HI-IR system are carried in a timely manner and coordinated with operations of the spryte rendering engines. Some operations of the display-defining path of the HI-IR system and of the spryte rendering engines are preferably modified or "reconfigured" on a by-the-frame basis, or on a by-the-line basis. These modifications/reconfigurations should be coordinated with real-time events of the display-defining path of the system such as the actuation of the horizontal synch and vertical synch pulses of the video generating system.

In some situations, it is undesirable to let reconfiguration of a displayed image occur in the middle of an active scan line. This might create a clearly visible and annoying "tear" artifact or other disturbance in the displayed imagery. Ideally, reconfiguration should occur during the vertical blanking or horizontal blanking periods of the system so as to avoid the image-tearing problem.

On the other hand, the performance speed of real-time games or simulations might suffer if one always had to wait for the next horizontal or vertical blanking period each time a change was to be made. Some kinds of imagery changes can be made without creating a noticeable disturbance within the displayed image while others cannot. A flexible mechanism is needed for allowing both kinds of changes.

Another problem presented here is therefore, how to efficiently organize and prioritize the execution of real-time image and modality changes on a by-the-line or by-the-frame basis. A method is needed for coordinating and prioritizing changes to be made to the display-defining path of the HI-IR system and changes made by the spryte-rendering portion of the system.

SUMMARY OF THE INVENTION

The invention overcomes the above-mentioned problems by providing a set of graphics management primitives for coordinating reconfigurations of a system having a reconfigurable display-defining path.

A first aspect of the graphics management primitives involves providing a proofer that receives proposed display structures from application programs, proofs them for inconsistencies and filters out attempts to reconfigure a digital-to-video translating portion of the system after a system initialization phase completes.

A second aspect of the graphics management primitives involves establishing a master VDL (Video Data List) that allows for efficient execution of color palette changes and/or execution of cel animation activities.

A third aspect of the graphics management primitives involves generating support data structures in memory for supporting general purpose color palette changes and/or execution of cel animation activities.

BRIEF DESCRIPTION OF THE DRAWINGS

The below detailed description makes reference to the accompanying drawings, in which.

DETAILED DESCRIPTION

Figure 1A:
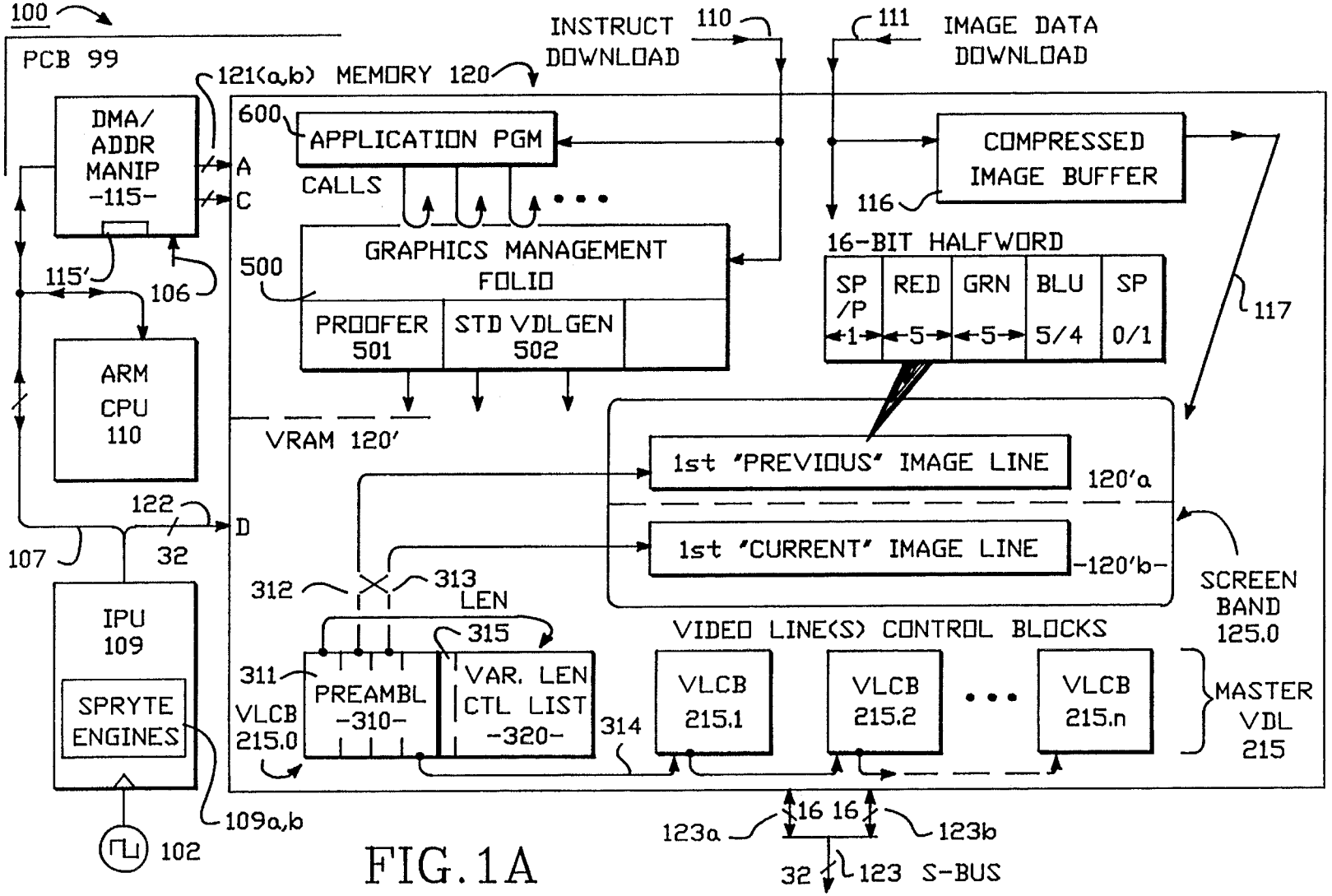
FIGS. 1A and 1B form a block diagram of a High-performance, Inexpensive, Image-Rendering system (HI-IR system) in accordance with the invention that includes a Video Display List (VDL) management subsystem.
Figure 1B:
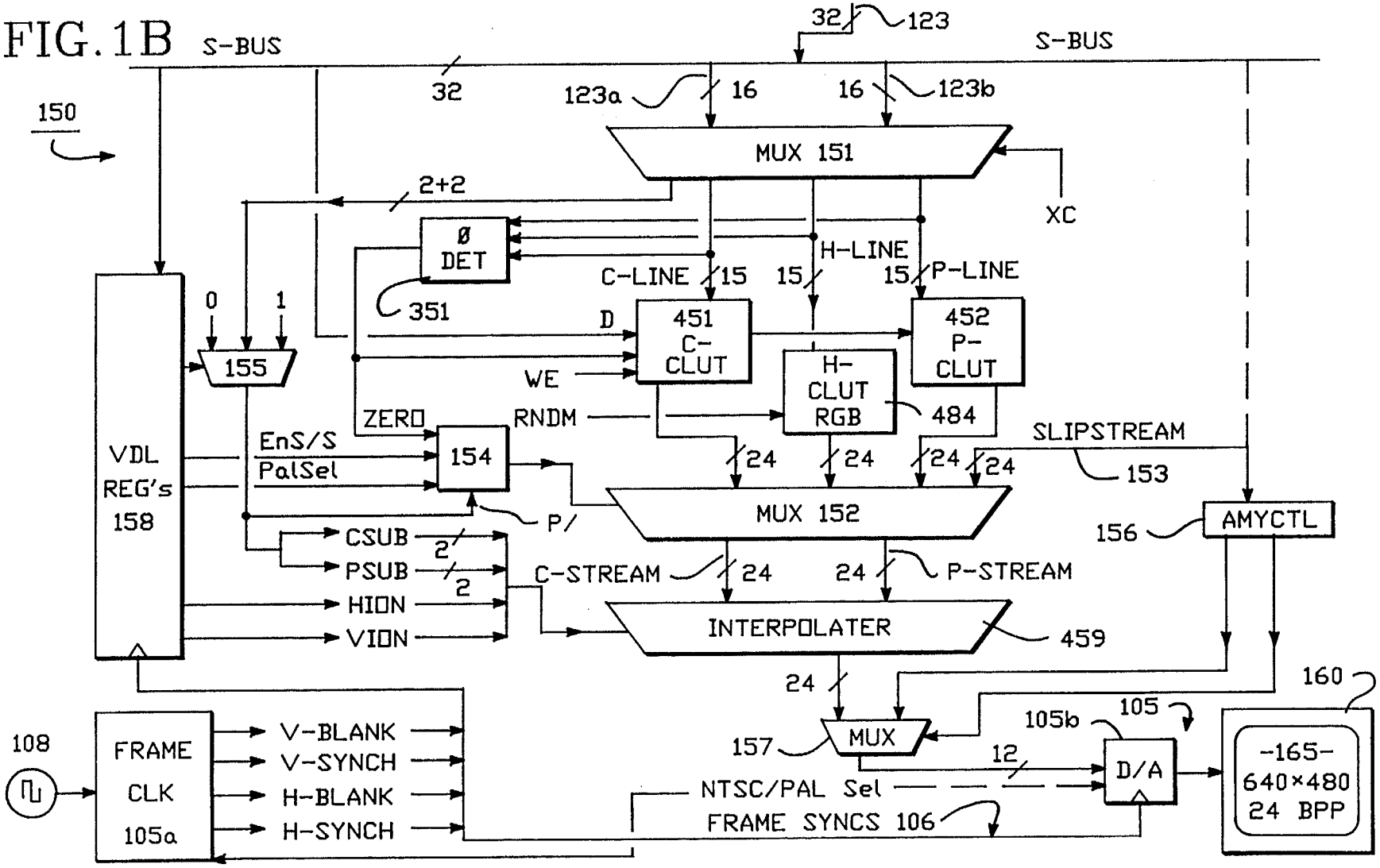

Referring to the combination of FIGS. 1A and 1B, a block diagram of an image processing and display system 100 in accordance with the invention is shown.

A key feature of system 100 is that it is relatively low in cost and yet it provides mechanisms for handling complex image scenes in real time and displaying them such that they appear to have relatively high resolution and a wide variety of colors and/or shades per displayed frame.

This feature is made possible by including a image-enhancing and display subsystem 150 (FIG. 1B) on one or a few integrated circuit (IC) chips within the system 100. Included within the image-enhancing and display subsystem 150 are a set of user-programmable Color LookUp Table modules (CLUT's) 451, 452, a hardwired pseudolinear CLUT 484 and a user-programmable resolution-enhancing interpolator 459. The operations of these and other components of subsystem 150 are best understood by first considering the video processing operations of system 100 in an overview sense.

FIGS. 1A and 1B join, one above the next, to provide a block diagram of the system 100. Except where otherwise stated, all or most parts of system 100 are implemented on a single printed circuit board 99 and the circuit components are defined within one or a plurality of integrated circuit (IC) chips mounted to the board 99. Except where otherwise stated, all or most of the circuitry is implemented in CMOS (complementary metal-oxide-semiconductor) technology using 0.9 micron or narrower line widths. An off-board power supply (not shown) delivers electrical power to the board 99.

Referring first to FIG. 1B, system 100 includes a video display driver 105 that is operatively coupled to a video display unit 160 such as an NTSC standard television monitor or a PAL standard television monitor or a 640-by-480 VGA monitor. The monitor 160 is used for displaying high-resolution animated images 165. Video display driver 105 has a front-end, frame clocking portion 105*a* and a backend, digital-to-video translating portion 105*b*. The front-end, frame clocking portion 105*a* generates frame synchronization signals 106 such as a vertical synch pulse (V-synch) and a horizontal synch pulse (H-synch). The backend translating portion 105*b* can be a digital-to-NTSC translator or a digital-to-PAL translator or a digital-to-VGA translator or a digital-to-other format translator. Preferably, the video display driver 105 is a software-configurable device such as a Philips 7199™ video encoder. Such a device responds to configuration instructions downloaded into it so that the same device is useable in either an NTSC environment or a PAL environment or another video-standard environment.

Referring to FIG. 1A, system 100 further includes a real-time image-data processing unit (IPU) 109, a general purpose central-processing unit (CPU) 110, and a multi-port memory unit 120.

The memory unit 120 includes a video-speed random-access memory subunit (VRAM) 120'. It can also include slower speed DRAM or other random access data storage means. Instructions and/or image data are loadable into the memory unit 120 from a variety of sources, including but not limited to floppy or hard disk drives, a CD-ROM drive, a silicon ROM (read-only-memory) device, a cable headend, a wireless broadcast receiver, a telephone modem, etc. Paths 118 and 119 depict in a general sense the respective download into memory unit 120 of instructions and image data. The downloaded image data can be in compressed or decompressed format. Compressed image data is temporarily stored in a compressed image buffer 116 of memory unit 120 and expanded into decompressed format on an as needed basis. Such decompression is depicted in a general sense by transfer path 117. Displayable image data, such as that provided in a below-described video image band 125.0 is maintained in a decompressed format.

Memory unit 120 is functionally split into dual, independently-addressable storage banks, 120*a* and 120*b*, which banks are occasionally referred to herein respectively as bank-A and bank-B. The split VRAM portions are similarly referenced as banks 120'*a* and 120'*b*. The address inputs to the storage banks, 120*a* and 120*b*, of memory unit 120 are respectively referenced as 121*a* and 121*b*, and the address signals carried thereon are respectively referenced as $A_a$ and $A_b$.

Noncompressed, displayable, bit-mapped image data is preferably stored within memory unit 120 so that even numbered image lines reside in a first of the memory banks (e.g., 120*a*) and odd numbered image lines reside in the second of the memory banks (e.g., 120*b*). For purposes of a below-described interpolation process, a first image line in a first of the banks is referenced as a "current" line and a corresponding second image line in a second of the banks is referenced as a "previous" line. The designation is swappable. An image line of either bank can be designated at different times as being both "current" and "previous". In the example of FIG. 1A, VRAMbank 120'*a* is shown holding a "previous" image line while VRAMbank 120'*b* is shown holding a "current" image line.

Each of memory banks 120*a*, 120*b* has a first bi-directional, general purpose data port (referenced respectively and individually as 122*a*, 122*b*) and a second, video-rate data port (referenced as 123*a*, 123*b*). Collectively, the general purpose data port of the memory unit 120 is referred to as the D-bus port 122 while the video-rate data port is referred to as the S-bus port 123.

The first set of bidirectional data ports 122*a*, 122*b* (collectively referenced to as 122) connect to the IPU 109, to the CPU 110 and to a dual-output memory-address driver/DMA controller (MAD/DMA) 115 by way of a data/control bus (DCB) 107. The data/control bus (DCB) 107 also carries control signals between the various units.

The second set of memory data ports (video-output ports) 123*a*, 123*b* of the memory unit 120 connect to the above-mentioned, image-enhancing and display subsystem 150 by way of a so-called S-bus 123.

The dual-output memory-address driver/DMA controller (MAD/DMA) 115 is responsible for supplying address and control signals (A and C) to the independently-addressable storage banks, 120*a* and 120*b*, of memory unit 120 on a real-time, prioritized basis. As will be understood shortly, some of the address signals ($A_a$, $A_b$) need to or can be timely delivered during a horizontal-blanking period (H-BLANK) and others of the address signals need to or can be timely delivered during a horizontal active-scan period (H-SCAN). Yet others of the address signals need to or can be timely delivered during a vertical-blanking period (V-BLANK). And yet others of the address signals need to or can be timely delivered at the start of a vertical-active period (at V-sync or within the first 21 NTSC scan lines).

The dual-output memory-address driver/DMA controller (MAD/DMA) 115 performs this function in accordance with a supplied list of ordered commands stored in a "Master" set of Video Line(s) Control Blocks that is stored in the video random-access memory subunit (VRAM) 120' of memory unit 120. The Master set of VLCB's is referenced as 215. The contents of the Master set of VLCB's 215 defines what will be seen on the monitor screen at a given moment, and hence the master set 215 is also at times referred to herein as the "master screen definition" 215 or the currently active "Video Display List" (VDL) 215.

The CPU 110 or another memory altering means can define one or more VDL's within memory unit 120 and shift them around as desired between VRAM 120' and other sections of system memory. The CPU 110 sets a register within the memory-address driver/DMA controller (MAD/DMA) 115 to point to the VRAM address where the currently active "Video Display List" (VDL) 215 begins. Thereafter, the memory-address driver/DMA controller (MAD/DMA) 115 fetches and executes commands from the Master set of VLCB's 215 in timed response to the frame synchronization signals 106 supplied from the display-drive frame-clocking portion 105*a*. The portion of the memory-address driver/DMA controller (MAD/DMA) 115 that provides this function is occasionally referred to herein as the VDLE (Video Display List Engine) 115'.

Each individual VLCB (Video Line(s) Control Block) within the Master set of VLCB's 215 is individually referenced with a decimated number such as 215.0, 215.1, 215.2, etc. For each displayed screen, the first fetched and executed control block is VLCB number 215.0 which is also referred to as VDL section 215.0 (Video-control Data List section number 215.0). The remaining VLCB's, 215.1, 215.2 may or may not be fetched and executed by the VDLE 115' depending on the contents of the first VLCB 215.0. The contents of each VLCB 215.0, 215.1, . . . , 215.i and the corresponding functions will be more fully described below.

As already mentioned, the front-end, frame clocking portion 105*a* of the video display driver 105 generates a plurality of frame synchronization signals 106. These include: (a) a low-resolution video pixel (LPx) clock for indexing through pixels of a low-resolution video image band 125.0 stored in memory unit 120; (b) a V-synch pulse for identifying the start of a video frame (or field); (c) an H-synch pulse for identifying the start of a horizontal scan line; (d) an H-BLANK pulse for identifying the duration of a horizontal-blanking period; and (e) a V-BLANK pulse for identifying the duration of a vertical-blanking period.

In one embodiment, the image data processing unit (IPU) 109 is driven by a processor clock generator 102 (50.097896 MHz divided by one or two) operating in synchronism with, but at a higher frequency than the low-resolution pixel (LPx) clock generator 108 (12.2727 MHz) that drives the frame-clocking portion 105*a* of the display-drive. The CPU 110 can be a RISC type 25 MHz or 50 MHz ARM610 microprocessor available from Advanced RISC Machines Limited of Cambridge, U.K. A plurality of spryte-rendering engines 109*a,b* (not shown in detail) are provided within the IPU 109 for writing in real-time to image containing areas (e.g., 125.0) of memory unit 120 and thereby creating real-time, animated image renditions. The spryte-rendering activities of the spryte-rendering engines 109*a,b* can be made to follow a linked list which orders the rendering operations of the engines and even prioritizes some renditions to take place more often than others.

In a system initialization phase of operations, display drive configuration instructions may be downloaded into the video display driver 105 (FIG. 1B) by way of S-bus 123 and a configuration routing module (AMYCTL module) 156 and a routing multiplexer 157. In an alternate embodiment, the configuration of the video display driver 105 is hardwired. Once the frame synchronization signals 106 are set to proper speeds and timings, and are up and running, the CPU 110 sets the register (not shown) within the memory-address driver/DMA controller (MAD/DMA) 115 that points to the start of the currently active "Video Display List" (VDL) 215, and the VDLE 115' portion of the memory-address driver/DMA controller (MAD/DMA) 115 begins to fetch and execute the display control command stored in the Master VDL 215. The screen display of the video display unit 160 is refreshed accordingly.

At the same time that a screen image 165 is being repeatedly sent to video display unit 160 by the VDLE 115', the IPU 109 and/or CPU 110 can begin to access binary-coded data stored within the memory unit 120 and to modify the stored data at a sufficiently high-rate of speed to create an illusion for an observer that realtime animation is occurring in the high-resolution image 165 (640-by-480 pixels, 24 bits-per-pixel) that is then being displayed on video display unit 160. In many instances, the observer (not shown) will be interacting with the animated image 165 by operating buttons or a joystick or other input means on a control panel (not shown) that feeds back signals representing the observer's real-time responses to the image data processing unit (IPU) 109 and/or the CPU 110 and the latter units will react accordingly in real-time.

The IPU 109 and CPU 110 are operatively coupled to the memory unit 120 such that they (IPU 109, CPU 110) have read/write access to various control and image data structures stored within memory unit 120 either on a cycle-steal basis or on an independent access basis. For purposes of the present discussion, the internal structures of IPU 109 and CPU 110 are immaterial. Any means for loading and modifying the contents of memory unit 120 at sufficient speed to produce an animated low-resolution image data structure therein will do. The important point to note is that the image 165 appearing on video display unit 160 is a function of time-shared activities of the IPU/CPU 109/110 and the Video Display List Engine 115'.

The image 165 that is rendered on monitor 160 is defined in part by bitmap data stored in one or more screen-band buffers (e.g., 125.0) within memory unit 120. Each screen-band buffer contains one or more lines of bit-mapped image data. Screen-bands can be woven together in threaded list style to define a full "screen" as will be explained below, or a single screen-band (a "simple" panel) can be defined such that the one band holds the bit-mapped image of an entire screen (e.g., a full set of 240 low-resolution lines).

Major animation changes are preferably performed on a double-buffered screen basis where the contents of a first screen buffer are displayed while an image modifying engine (the cel or "spryte" engines 109*a,b*) operates on the bit-map of a hidden, second screen buffer. Then the screen buffers are swapped so that the previously hidden second buffer becomes the displayed buffer and the previously displayed first buffer becomes the buffer whose contents are next modified in the background by the image modifying engine.

Each line in a screen-band buffer (e.g., 125.0) contains a block of low-resolution "halfwords", where each halfword (16 bits) represents a pixel of the corresponding low-resolution line. The line whose contents are being instantaneously used for generating a display line is referred to as a "current" low-resolution line, and for purposes of interpolation, it is associated with a "previous" low-resolution line.

Memory unit 120 outputs two streams of pixel-defining "halfwords," $Px(LR_0)$ and $Px(LR_1)$, on respective video-rate output buses 123*a* and 123*b* to the image-enhancing and display subsystem 150 in response to specific ones of the bank-address signals, $A_a$ and $A_b$ supplied by the memory-address driver (MAD/DMA) 115. A selectable one of these streams defines the "current" line and the other defines the "previous" line. Each 16-bit halfword contains color/shade defining subfields for a corresponding pixel. The make-up of each 16 bit halfword depends on which of a plurality of display modes is active.

In one mode of operation (the 1/555 mode), 5 of the bits of the 16-bit halfword define a red (R) value, 5 of the bits define a green (G) value, 5 of the bits define a blue (B) value, and the last bit (a "subposition weighting" bit) defines a weight value, 0 or 1, to be used by the interpolator 459.

In second mode of operation (the 1/554/1 mode), 5 of the bits define a red (R) value, 5 of the bits define a green (G) value, 4 of the bits define a blue (B) value, and the last 2 bits ("subposition weighting" bits) define a weight value, 0 to 3, to be used by the interpolator 459.

In a third mode of operation (the P/555 mode), 5 of the bits define a red (R) value, 5 of the bits define a green (G) value, 5 of the bits define a blue (B) value, and the last bit (the P or "soft-versus-hard palette select" bit) defines whether the user-programmable Color LookUp Table modules (CLUT's) 451, 452 or the hardwired pseudo-linear CLUT 484 will used for performing color code expansion (from 5-bits per color to 8-bits per color) in the image-enhancing and display subsystem 150.

In fourth mode of operation (the P/554/1 mode), 5 of the bits define a red (R) value, 5 of the bits define a green (G) value, 4 of the bits define a blue (B) value, 1 of the bits (a "subposition weighting" bit) defines a weight value, 0 or 1, to be used by the interpolator 459, and the last 1 bit (the P or "soft-versus-hard palette select" bit) defines whether the user-programmable Color LookUp Table modules (CLUT's) 451, 452 or the hardwired pseudo-linear CLUT 484 will used for performing color code expansion.

The image-enhancing and display subsystem 150 includes a stream routing unit 151 for selectively transposing the $Px(LR_0)$ and $Px(LR_1)$ signals, in response to a supplied "cross-over" signal, XC, so that one of these video stream streams becomes defined as being the "current line" and the other comes to be defined as the "previous line". When the soft (user-programmable) Color LookUp Table modules (CLUT's) 451, 452 are used, one module holds the conversion palette for the current line and the other for the previous line. Each time the display of a new line completes, the contents of the "current" CLUT module 451 are copied to the "previous" CLUT module 452.

Each CLUT module has three independent CLUT's, an R-CLUT, a G-CLUT, and a B-CLUT. Each of the R,G,B CLUT's has 5 address input lines and 8 data output lines. Thus each CLUT module, 451 or 452, converts a 15-bit wide color code into a 24-bit wide color code.

In the illustrated example, 451 is the C-CLUT module and 452 is the P-CLUT module. The interpolator 459 tends to produce different results depending on which pixel stream is defined as "current" and which as "previous". The cross-over signal, XC, that is applied to the stream routing unit 151 designates which of the parallel streams from the video-rate output buses 123*a* and 123*b* of memory unit 120 will pass through the C-CLUT module 451 or the P-CLUT module 452 and respectively function as "current" or as "previous".

If the hardwired pseudo-linear CLUT 484 is to be used for color expansion instead of the user-programmable CLUT modules 451, 452, the stream routing unit 151 routes both the pixel streams of the video-rate memory output buses 123*a*, 123*b* through the hardwired pseudo-linear CLUT module 484. A substantially same color expansion algorithm is then applied to both streams. In one mode of operation for unit 484, the 5 bits of each of the RGB colors are shifted left by 3 bit positions and the less significant bits of the resulting 8-bit wide values are set to zero. In a second mode, a pseudo-random 3-bit pattern is written into the less significant bits of the resulting 8-bit wide values.

The three stream routing output lines of stream-routing unit 151 are respectively labeled C-line, H-line and P-line, and are respectively connected to the inputs of the C-CLUT 451, the hardwired pseudo-linear CLUT 484 and the P-CLUT 452. A zero detector 351 has inputs coupled to the 15-bit wide signals moving down the C-line, the H-line and the P-line. The zero detector 351 further has control outputs coupled to the C-CLUT 451 and to the P-CLUT 452 and also to a control decoder 154 that controls the operation of a below-described multiplexer 152.

In one mode of operation, an all-zero color code (RGB=000) is used to designate a special "background" pixel color. Each of the C-CLUT 451 and the P-CLUT 452 can have its own unique, software-defined background color. In a first submode of operation, each zero-value pixel code (RGB=000) is replaced by the expanded background color code of the corresponding CLUT module 451 or 452. In a second submode of operation, each background pixel is replaced by a 24-bit wide "slipstream" pixel. An external video source (not shown) provides the 24-bit wide slipstream 153 of pixel data at a "GENLOCKED" rate. (Due to chip pinout limitations, the slipstream signal 153 comes in by way of the S-bus 123, time-multiplexed with other S-bus signals and thus it is shown to be sourced by a dashed line from the S-bus 123.) If the second submode (slipstream override mode) is active, each "background" pixel is replaced by a corresponding slipstream pixel. This makes the background pixel appear to have a "transparent" color because the slipstream image shines through.

A second stream routing unit 152 (multiplexer 152) receives the 24-bit wide streams respectively output from the C-CLUT 451, the P-CLUT 452, the hard CLUT 484 and the slipstream source line 153. The second stream routing unit (multiplexer) 152 forwards a selected subset of these received streams to the interpolator unit 459 as a 24-bit wide C-stream and a 24-bit wide P-stream ("current" and "previous" streams). The output of zero detector 351 connects to a control decoder 154 that drives the control port of the second stream routing unit (multiplexer) 152. The zero detector output is used for dynamically replacing background pixels with corresponding slipstream pixels when the slip/stream override mode (EnS/S) is active. (See Bit 20 of the below defined first DMA control word 311.) The interpolater 459 can be used to smooth sharp differentiations at a boundary between a slipstream image and a VRAM-supplied image.

Another control signal which is applied to multiplexer 152 and appropriately decoded by control decoder 154, is a palette select (PalSel) signal which is sometimes referred to also as the "cluster select" signal. This signal selects on a line-by-line basis one or the other of the user-programmable CLUT modules 451, 452 or the hardwired CLUT module 484 as the means to be used for color code expansion (from 5-bits per color to 8-bits per color). There is also a P/signal supplied from a subposition extraction unit 155 to the control decoder 154 for dynamically selecting on a pixel-by-pixel basis one or the other of the user-programmable CLUT modules 451, 452 or the hardwired CLUT module 484 as the means to be used for color code expansion. The latter operation is used in the P/554/1 and P/555 modes.

Interpolator 459 receives the 24-bit wide C-stream and P-stream video signals from multiplexer 152 in accordance with the selection criteria applied to multiplexer 152. Depending on whether one or both of a horizontal interpolation mode (HIon) and a vertical interpolation mode (VIon) are active or not, the interpolator can enhance the resolution in the horizontal and/or vertical direction of the received signals. In one mode, the interpolator 459 converts a 320 by 240 pixels, low-resolution image into a 640 by 480 pixels, high-resolution image. The interpolation operations of interpolator 459 are responsive to a set of supplied weighting bits (which are also referred to as subposition bits, or C-SUB and P-SUB bits). These bits, C-SUB and P-SUB, can be fixed or extracted from the S-bus 123. A subposition extraction unit 155 is provided for, in one mode, extracting the subposition bits from the S-bus 123, time delaying them, and supplying them to interpolator 459 in phase with the arriving C-stream and P-stream signals.

The subposition extraction unit 155 is responsive to control signals supplied from a set of VDL control registers 158. The VDL control registers 158 are set or reset in accordance with VDL data downloaded from the Master set of VLCB's 215. The VDL control registers 158 are also used for establishing the operational modes of other parts of the image-enhancing and display subsystem 150 as will be detailed shortly.

The output of interpolator 459 is a 24-bit wide interpolated signal 460 which is next fed to multiplexer 157. Among other functions, multiplexer 157 converts each instance of the 24-bit wide interpolated signal 460 into two 12-bit wide chip-output signals 462. This is done in order to minimize chip-pinout counts. Chip-output signals 462 are then directed to the digital-to-video translating portion 105*b*.

A digit-to-analog converter (D/A) is included in the backend portion 105*b* of the display driver for converting the output of interpolator 459 from digital format to analog format. In one embodiment, the D/A converter outputs NTSC formatted analog video to an NTSC compatible monitor 160.

In addition to, or instead of, being directed to the digital-to-video translating portion 105*b*, the chip-output signals (CLIO output signals) 462 can be directed to a digital signal storage/processing means 170 which stores the chip-output signals 462 and/or digitally processes them (e.g., by scaling the size of the image data contained therein) and thereafter forwards the stored/further-processed digital signals 463 to a digital display (e.g., VGA display) for viewing or other use. Either or both of the video display unit 160 and the digital signal storage/processing means 170 constitutes an image integration means wherein the individual image lines output by the interpolator 459 and/or C-CLUT modules 451, 452,484 are integrated into a unified image data structure for viewing, or storage, or further processing.

Those skilled in the art will recognize that it is often advisable to establish the configuration of the image-enhancing and display subsystem 150 before a stream of video-rate image data comes pouring down the pipeline. More specifically, before a frame of image data begins to pass through the CLUT's (451/452 or 484) and through the interpolator 459, it is advisable to define certain system modes such as for example, whether the incoming image data is rendered in 1/555 mode, 1/554/1 mode, P/555 mode or P/554/1 mode. The subposition extraction unit 155 should be preconfigured to extract one or two subposition bits from the instreaming video data and to supply the extracted subposition weighting bits to the interpolator 459 in each display mode other than P/555. In the P/555 mode, the subposition extraction unit 155 supplies default weights to the interpolator 459.

In the case where one of display modes P/555 or P/554/1 are selected, control decoder 154 of multiplexer 152 should be preconfigured to respond to the P/palette select bit so as to provide dynamic palette selection (in which one of the soft or hard CLUT sets, 451/452 or 484, is selected on a pixel-by-pixel basis). On the other hand, in the case where either the 1/555 or the 1/554/1 mode is selected, the control decoder 154 should be preconfigured to default to the user-programmable CLUTs 451, 452 rather than the hard-wired CLUT 484. In the case where slipstream overwrite of background pixels is enabled (EnS/S=1), the control decoder 154 of multiplexer 152 should be appropriately configured to respond to the output of zero detector 351. Also, depending on whether vertical and/or horizontal interpolation is desired, various registers setting the HIon or VIon modes of interpolator 459 should be preloaded with the appropriate settings.

Preconfiguration of various parts of the resolution enhancement system 150 preferably occurs during one or both of the vertical blanking period (V-BLANK) that precedes the display of each field or frame, and during the horizontal blanking period (H-BLANK) that precedes an active horizontal scan period (H-SCAN). The H-BLANK period is relatively short in comparison to the V-BLANK and H-SCAN periods, and as such, preconfiguration operations within the H-BLANK period should be time-ordered and prioritized to take as much advantage of the limited time available in that slot as possible.

Each video line(s) control block 215.0, 215.1, etc. has a mandatory four-word preamble 310 which is always fetched and executed by the Video Display List Engine 115'. The mandatory 4-word preamble 310 is optionally followed by a variable length control list 320. The four mandatory control words within preamble 310 are respectively referenced as first through fourth DMA control words 311–314. The data structure of each of these 4 mandatory words is given in below Tables 1–4. The optional follow-up list 320 can contain from one to as many as 50 optional control words where the optional control words are of three types: (1) a color-defining word; (2) a video-translator control word; and (3) a display path reconfiguration word. The data structure of the optional color-defining download word is shown in below Table 5. The data structure of the optional display path reconfiguration download word is shown in below Table 6.

TABLE 1

First DMA control word 311 (32 bits), mandatory.

| Bit No.s | Field Name | Function |
|---|---|---|
| 31 \| 27 | | Reserved, must be set to zero for this version |
| 26 | SBC | 1=doubles the S-Bus clock rate for faster memory fetch rate |
| 25 \| 23 | Dmode | These 3 bits tell the hardware how many pixels to expect per line. 0=320, 1=384, 2=512, 3=640, 4=1024, 5=reserved, 6=reserved, 7=reserved. |
| 22 | EnS/S | 1 = Enables Slip Stream capture during H-blanking period. |
| 21 | EnVDMA | 1 = Enables operation of video DMA. |
| 20 | SelS/S | 1 = Selects one of two DMA channels as source of slipstream image data or command data. |
| 19 | VRes | 0 = Vertical resolution of incoming data is 240 lines per screen. 1 = Vertical resolution of incoming data is 480 lines per screen. |
| 18 | NexVLCBr | Indicates whether the "next CLUT list" address is absolute (=0) or relative (=1) |
| 17 | NexPline | Specifies whether the "previous video line" address for each subsequent scan line is to be calculated by adding a predefined modulo or by defining it as the previously used "current video line" address. |
| 16 | CAValid | Indicates the validity of the "current line video address" (0= use normally incremented "current line video address", 1= use new address included in current CLUT list instead) |
| 15 | PAValid | Indicates the validity of the "previous line video address" (0= use normally incremented "previous line video address", 1= use new address included in current CLUT list instead) |
| 14 \| 9 | ListLen | These 6 bits indicate the length in words left to the rest of this list= VLCB_len−4 (−4 because 4 preamble words are always loaded in the current load) |
| 8 \| 0 | NoLines | These 9 bits indicate the number of additional H scan lines to wait after this line before processing the next VLCB (range= 0 to 2 to-the-9th -1) |

TABLE 2

| Second DMA control word 312 (32 bits), mandatory. Current Frame Buffer Address | | |
|---|---|---|
| Bit No.s | Field Name | Function |
| 31 \| 00 | cFBA | Physical address from which to fetch first "current" line of pixel data after processing this CLUT list. (Provided CAValid =1.) |

TABLE 3

| Third DMA control word 313 (32 bits), mandatory. Previous Frame Buffer Address | | |
|---|---|---|
| Bit No.s | Field Name | Function |
| 31 \| 00 | pFBA | Physical address from which to fetch first "previous" line of pixel data after processing this CLUT list. (Provided PAValid =1.) |

TABLE 4

| Fourth DMA control word 314 (32 bits), mandatory. Next CLUT List Address | | |
|---|---|---|
| Bit No.s | Field Name | Function |
| 31 \| 00 | NexVLCB | Address from which the next CLUT list should be fetched, after the number of scan lines specified in the first CLUT DMA control word 311 have been transmitted. The next CLUT list address can be either absolute or relative. |

TABLE 5

| DMA color-defining word 315 (32 bits), optional. If Bit 31=0, Then this is Download Data for Current RGB CLUT's | | |
|---|---|---|
| Bit No.s | Field Name | Function |
| 31 | Ctl/Colr (0=Colr) | This first read bit indicates whether the remainder of this 32 bit word is a color palette download word or a display control (command) word. Bit 31 is 0 for a color pallette download word. The subsequent bit descriptions (Bits 30-0) in this Table are only valid for the case where Bit 31=0. |
| 30 \| 29 | RGBen | These 2 bits are write enable bits. 00 = enable a write of the download data of this word to all three current CLUTs (RGB) at the same time. 01 = write the blue field to the blue CLUT only. 10 = write the green field to the green CLUT only. 11 = write the red field to the red CLUT only. |
| 28 \| 24 | Addr | This five bit address field is applied to the RGB CLUT's simultaneously. |
| 23 \| 16 | RedV | This is the 8 bit Red value to be downloaded if enabled and later output from the Red CLUT when the present address is input. |
| 15 \| 8 | GreenV | This is the 8 bit Green value to be downloaded if enabled and later output from the Green CLUT when the present address is input. |
| 7 \| 0 | BlueV | This is the 8 bit Blue value to be downloaded if enabled and later output from the Blue CLUT when the present address is input. |

If bits 31 and 30 of an optional download word are both one, and if bit 29 is zero (110), then the word is a display control word and contains the following information:

TABLE 6

| DMA display-path reconfigure word 316 (32 bits), optional. If Bits 31, 30, 29 = 1, 1, 0, Then this is Download Command for Display Path | | |
|---|---|---|
| Bit No.s | Field Name | Function |
| 31 \| 29 | Ctl/Colr (110=Ctl) | These first-read 3 bits indicate that the remainder of this 32 bit word is a display control (command) word. Bit 31 is 0 for a color palette download word. The subsequent bit descriptions (Bits 28-0) in this Table are only valid for the case where Bits 31:29=110. |
| 28 | Null | 1= forces the audio/video processor to send a null control word to audio/video output circuitry |
| 27 | PAL/NTSC | Selects the NTSC or PAL transmission standard for the output. 1=PAL 0=NTSC |
| 26 | | Reserved |
| 25 | ClutBypss | Enables CLUT bypass 484 |
| 24 | SrcSel | Select source of background overlay data, 1=SlipStream 0=CVBS |
| 23 | TranTrue | Forces transparency always true mode, letting overlay data be displayed from a slipstream capture if a pixel is defined as being "transparent" |
| 22 | EnZDet | Enables the background color detector in the display path to indicate transparency |
| 21 | SwapHV | Swaps the meaning of the horizontal and vertical subposition bits for window color |
| 20 \| 19 | VSrc | Select the vertical subposition bit source as being: a constant 0, a constant 1, equal to a value specified by the corresponding frame buffer bit, or equal to the value of the prior V source setting for window |
| 18 \| 17 | HSrc | Select the horizontal subposition bit source as being: a constant 0, a constant 1, equal to a value specified by the corresponding frame buffer bit, or equal to the value of the prior H source setting for window |
| 16 \| 15 | BlueLSB | Select the blue pen LSB source as being: 0, use frame buffer data bit 0, use frame buffer data bit 5, and maintain prior setting for window |
| 14 | VIon | Enables vertical interpolation for window |
| 13 | HIon | Enables horizontal interpolation for window |
| 12 | Rndm | Enables random number generator for the three LSBs of CLUT bypass module 484 |
| 11 | MSBrep | Enables a window MSB replication gate |
| 10 | SwapPENms | Swaps the MSB and LSB of the PEN half-word for line |
| 9 \| 8 | VSrc | Select the vertical subposition bit source as being: a constant 0, a constant 1, equal to a value specified by the corresponding frame buffer bit, or equal to the value of the prior V source setting for line |
| 7 \| 6 | HSrc | Select the horizontal subposition bit source as being: a constant 0, a constant 1, equal to a value specified by the corresponding frame buffer bit, or equal to the value of the prior H source setting for line |
| 5 \| 4 | BlueLSB | In the case of a x/554/x mode, this field selects the blue pen LSB source as being: 0, use frame buffer data bit 0, use frame buffer data bit 5, and maintain prior setting for line |
| 3 | VIon | Enables vertical interpolation for line |
| 2 | HIon | Enables horizontal interpolation for line |
| 1 | ColrsOnly | Colors Only after this point. Ignore optional download words that are other than color-defining words |
| 0 | VIoff1ln | Disable vertical interpolation for this line only |

If bit 31 of an optional color/control word is one, and if bit 30 is zero (10×), then the word contains control information for an audio/video output circuit 105 (not detailed herein) of the system. The audio/video processor circuitry receives this word over the S-bus 123, and forwards it to the audio/video output circuitry for processing. In one embodiment, such translator control words have to be spaced apart from one another by at least four color defining words due to the timing requirements of the configurable video display driver 105.

If bits 31, 30 and 29 of a color/control word are all one (111), then the word contains three 8-bit color fields (red, green and blue) for writing to the "background" pen of the current CLUT module 451.

A DMA stack within the memory-address driver/DMA controller (MAD/DMA) 115 contains an 8-register group (only seven of which are used) to control read transfers out the S-port of VRAM 120'. The S-port transfers themselves do not require control of the D-bus or the address generator, but S-port activity can be controlled only via commands issued over the D-bus. The registers in the group are set forth in Table II.

TABLE II

0 Current CLUT Address
1 Next CLUT Address
2 CLUT Mid-Line Address
3 - - -
4 Previous Line Video Address
5 Current Line Video Address
6 Previous Line Mid-Line Address
7 Current Line Mid-Line Address In order to coordinate control of the video display path with the display scanning operation, the system of FIG. 1 transmits all of such commands down the display path during an allocated portion of each horizontal blanking period. In particular, about 50 words of transfer time are allotted during each horizontal blanking period. These commands are mostly directed to the color look-up table (CLUT), thereby permitting the CLUTs (there are three CLUTs for a scan line—one for each primary color) to be updated each scan line. The use of the commands ("color words") by the CLUTs, and the structure of the CLUT system, are described in the related METHOD AND APPARATUS FOR UPDATING A CLUT DURING HORIZONTAL BLANKING application. Other commands ("control words") are directed to the interpolation mechanism, described in the related RESOLUTION ENHANCEMENT FOR VIDEO DISPLAY USING MULTI-LINE INTERPOLATION application. Still other control words are directed to the audio/video output circuitry 105 and are passed by the audio/video processor to audio/video output circuitry over an AD bus. Note that in another embodiment, other otherwise unused time slots on the S-bus may be used to transmit commands down the video display path, such as during start-up and/or during vertical blanking.

The control words to be transmitted down the video display path during the allocated portion of the horizontal blanking period are prepared in advance by the CPU in the form of a linked list (VDL) set up by the CPU in VRAM. Although the control words are not always intended for the CLUTs, this list is sometimes referred to herein as a CLUT list.

During frame initialization, (in the vertical blanking period) the CPU 110 can write the address of a new "top of field" CLUT list into register 1 (next CLUT address) of the S-port read transfer group in the DMA stack. If enabled, the top of field CLUT list is executed at the top of every field by the CLUT control circuitry near the end of scan line 5 (or 4, depending on which field, odd or even, is being generated). To initiate the action, S-port control circuitry of the address manipulator chip issues a request to a DMA arbiter. When granted, the arbiter transmits the DMA group address for S-port read transfers to a stack address logic unit. The address manipulator chip responsively transfers the corresponding data to the Sport control circuitry. Additionally, the CLUT list length indication from the control word is loaded into a word counter (not shown), and the number of scan lines to wait before processing the next CLUT list is loaded into a scan line counter (not shown).

After the four mandatory word transfers take place (311–314), if the CLUT DMA control word indicates a non-zero number of color/display path control words to follow, the address generator initiates a CLUT list display path transfer. If the number of scan lines to wait before loading the next CLUT list is zero, then Sport control no longer checks for new transfer requests until the next "top of field" occurs. The top of field CLUT list transfer will take place beginning with the address specified in register 1.

If the number of scan lines defined by the NoLines field of the first DMA control word 311 of the first VLCB 215.0 covers the entire screen (e.g., 240 low-resolution lines), then the mandatory and/or optional control words in the next VLCB 215.1 will not be downloaded or executed because the DMA engine restarts with the first VLCB 215.0 of the then active VDL 215 at the top of each frame.

On the other hand, if the number of scan lines defined by the NoLines field of the first DMA control word 311 of the first VLCB 215.0 is less than the number needed to cover the entire screen (e.g., less than 240 low-resolution lines), then the mandatory and/or optional control words in the next VLCB 215.1 will be downloaded and executed during the H-BLANK period preceding the next horizontal scan line that follows the group of scan lines controlled by the first VLCB 215.0.

The last VLCB 215.n in the VDL chain can designate itself or one of the other VLCB's in the VDL chain as the next VLCB (NexVLCB) and thereby define an endless loop. The hardware automatically restarts at the top of each frame with the first VLCB 215.0 so there is no danger of being trapped in an endless loop.

The basic method for creating a downloadable list of display control words that are to be downloaded from system memory (120) to a configurable image-enhancing and display subsystem (150) has the following steps: (a) define in a first region (215.0) of the system memory (120), a first control word (311) having a ListLen field, where the first control word (311) is to be processed before a corresponding first image line (125.0) is displayed and where the ListLen field indicates a number of additional control words (312–315) that are to optionally follow the first control word (311) before the display of the corresponding first image line; (b) defining in the first memory region (215.0), a second control word (312) following the first control word (311), where the second control word (312) includes a pointer to a memory buffer (125.0) containing at least the to-be displayed first image line; (c) defining in the first memory region (215.0), a third control word (313) following the second control word (312); and (d) defining in the first memory region (215.0), a fourth control word (314) following the third control word (313), where the fourth control word (314) includes a pointer to a next memory region (215.1) having control words to be optionally executed prior to display of another image line, the display of the other image line following the display of said first image line (125.0).

Many variations on this basic process are possible as will now be explained.

Although it is fairly easy for the CPU 110 or another data source to establish a VDL 215 within the VRAM 120' and it is also fairly straightforward to have the CPU 110 designate the VDL as the "currently active" or "master" VDL, such a procedure is fraught with dangers. It is advisable to use pre-proofed or standardized VDLs which meet certain criteria rather than generating VDLs on an ad hoc basis.

One danger, that has already been mentioned, is that an application program might contain a bug that generates a VDL containing unintended command words for reconfiguring the video display path and/or reconfiguring the digital-to-video translating unit 105 in a manner not intended. Such reconfigurations might disadvantageously "crash" the display subsystem 150 and require a power-up restart in order to fix the problem.

In accordance with a first aspect of the invention, a VDL authenticator or proof-reader 501 is provided within a graphics management folio 500 that is downloaded into system memory 120. The VDL authenticator 501 proofs any custom VDL submitted to it by an application program 600. The authenticator 501 weeds out logically inconsistent portion of the submitted VDL's, depending on context, and produces a proofed copy for use by the system.

By way of example, if an application program 600 submits a custom VDL for approval after system initialization has occurred and the submitted VDL includes commands for reconfiguring the digital-to-video translator 105, the proofer 501 rejects such a custom VDL because it is logically inconsistent with the time of submission.

Proofing speed is enhanced by including a special "Colors-Only" bit (bit 1 of reconfigure word 316 in above Table 6) in the hardware. If the Colors-Only bit is set, the hardware disables any further response during the frame to optional download words other than color-defining words such as word 315 (Table 5). The custom VDL proofer 501 first checks this Colors-Only bit to see if it is set. If the Colors-Only bit is set, the proofer 501 can avoid wasting time checking remaining words within the VDL since the remaining words will not affect anything other than the CLUT colors. A change of CLUTs colors will not crash the system.

Another feature of the custom VDL proofer 501 is that it places proofed copies of submitted VDL's into VRAM 120' such that each VLCB does not span over an address page crossing. Since the master VDL 215 is to be accessed at high speed by the DMA portion of module 115, it is desirable to position the master VDL 215 within the VRAM portion 120' of system memory and to arrange the VDL such that no Video Line(s) Control Block (VLCB) within the master VDL 215 crosses a memory page boundary. Accordingly, when a custom VDL is submitted for approval to the proofer 501, and the proofer 501 finds the custom VDL to be proper, the proofer 501 reproduces a copy of the VDL in VRAM 120' appropriately positioned to avoid page boundary crossings by the VLCB's.

When the below code of a below-listed Source-code Section is used, a custom VDL is submitted to the graphics management folio 500 for proofing by the statement:

```
int=SubmitVDL(VDLentry *vdlDataPtr)
```

where vdlDataPtr is a pointer to the custom VDL being submitted by the calling application program to the graphics management folio 500. The custom VDL proofer 501 scans the submitted structure, proofs it for bad arguments, and—if it finds none—copies the submitted VDL under a logical fence into system RAM. (The prefix "int32" incidentally defines the return code as a 32 bit integer.) The proofed VDL copy can then be an active VDL by invoking a further call having the structure:

```
int32 DisplayScreen(Item ScreenItemX)
```

where X is an "item number" assigned to the proofed VDL. When the SubmitVDL( ) completes successfully, it returns a "screen item-number" to the calling program. The calling program activates the VDL by submitting the screen item-number to the DisplayScreen( ) portion of the graphics management folio 500.

In the particular implementation of the SubmitVDL( ) call listed in the below Source-Code Section checks each VDL entry to make sure reserved fields are filled only with zero bits. It also enforces certain hardware restrictions for the corresponding circuitry. Selection of PAL line width is disallowed because the corresponding hardware supports only NTSC format. Also 640 mode is disallowed, slipstream override is disallowed, and control word transmission to the digital-to-video translator 105 is disallowed. Moreover, the Colors-Only bit is not taken advantage of in this version. The list of allowed and disallowed modes can of course be modified as desired to conform with different hardware embodiments.

Yet another feature of the graphics management folio 500 is the inclusion of a "primary" VDL generator 502 within the folio 500. A set of pre-proofed standard-use VDL structures can be generated by generator 502, thereby avoiding time consumption by the custom proofer 501. The suite of generated "primary" VDL data structures includes a "simple" type, a "full" type, a "colors-only" type and an "addresses-only" type as will be explained below.

Figure 2:
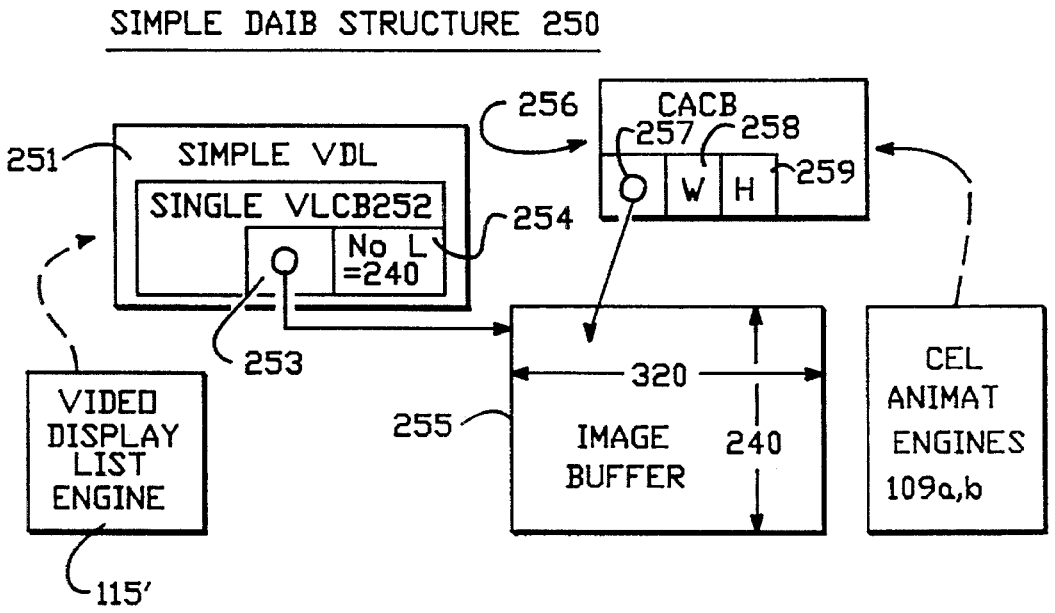
FIG. 2 diagrams a "simple" Displayable, Animateable, Image Buffer (DAIB) structure.

FIG. 2 shows a first data structure 250 that can be generated by the primary VDL generator 502. This first data structure 250 is referred to as a "simple", Displayable, Animateable, Image Buffer structure 250 or a "simple DAIB structure 250" for short.

The simple DAIB structure 250 has sufficient memory space allocated to it for supporting the following constituent components: (a) a "simple" VDL 251 that consists of a single VLCB 252; (b) a "full" screen buffer 255; and (c) a Cel Animation Destination Map (CADM) 256. The function of the CADM 256 will be described shortly.

The full screen buffer 255 contains at least 240 low-resolution lines, where each line has 320 pixels, and each pixel is 16 bits deep. (Depending on the active display mode, e.g. 1/554/1 or P/555, each pixel can have 14 or 15 bits of color-defining data and 1 or 2 additional bits of other data.) The interpolator 459 of FIG. 1B can be used to increase the apparent resolution of this 320-by-240 full-screen image buffer 255 to 640 pixels by 480 pixels.

The NoLines field (bits 8:0) in the first DMA control word 311 of the single VLCB 252 is set to a value of 239 image lines or more so that it will span a full screen's-worth (240 lines) of the full-screen image buffer 255. The second and third DMA control words, 312 and 313, of the single VLCB 252 are set to point to the memory bank addresses containing the top two lines of full-screen image buffer 255. For simplicity sake, these entries are conceptually shown as a single address pointer 253 pointing to the start of a low resolution image buffer 255.

The Cel Animation Destination Map (CADM) 256 is a data structure that is used by a set of Draw routines (e.g., DrawTo( ) ) within the graphics management folio 500 to control a rendering function performed by the spryte-rendering engines 109*a,b*. The CADM data structure is referred to in the below Source-code listing Section as a "BitMap".

Each of plural BitMaps is assigned an item number and is addressed by use of that bitmap item number. To fill a rectangular area one would use a call of the following form:

```
int32 FillRect(Item bitmapItem, GrafCon *grafcon, Rect *boundary)
```

where bitmapItem is the number of the BitMap (or CADM), Rect *boundary defines the boundary of the rectangular area, and GrafCon *grafcon defines the color mix to be used.

Each BitMap, including the illustrated CADM 256 contains an animation-destination pointer 257 pointing to the start or another region of image buffer 255 where new imagery is to be rendered. The CADM 256 further includes a width (W) definition 258 indicating the width of a region within buffer 255 that is to be animated and also a height (H) indicator 259 defining the height of a region within buffer 255 that is to be animated. The cel engines 109*a,b* render spryres into buffer 255 in accordance with the information contained in the corresponding cel animation control block (CADM) 256.

At the time of a rendition, the Cel Animation Destination Map (CADM) 256 is logically linked by the Draw routines to a so-called "Spryte-rendition Control Block" or SCoB 104 for short. The SCoB defines the source of new imagery while the CADM 256 defines the destination. A detailed description of the parts of a SCoB 104 and its various functions may be found in the above cited, co-pending applications: U.S. patent application Ser. No. 07/970,083 (PCT Patent Application Serial No. PCT/US92/09467), entitled IMPROVED METHOD AND APPARATUS FOR PROCESSING IMAGE DATA, and U.S. patent application Ser. No. 07/970,289 (PCT Patent Application Serial No. PCT/US92/09462), entitled SPRYTE RENDERING SYSTEM WITH IMPROVED CORNER CALCULATING ENGINE AND IMPROVED POLYGON-PAINT ENGINE. In brief, a SCoB includes a "Next-Pointer" (NEXPTR) which allows it to form part of a linked list of SCoB's. It also includes a "Source-Pointer" (SOURCEPTR) which defines an area in system memory from which a source spryte is to be fetched. It further includes X and Y coordinate values (XPOS, YPOS) which may be converted into an absolute destination address if desired. Various clipping constructs are included both in the definition of a "spryte" and by various hardware registers (simple clip and super-clip) for limiting the area into which the spryte-rendering engines (col animation engines) 109*a,b* write.

The image buffer 255, the display pointer 253 pointing thereto, and the animation-destination pointer 257 also pointing thereto, are preferably all defined within memory unit 120 at the same time so that independent display operations and spryte rendering operations can be performed on respective parts of the same image buffer 255 that are pointed to by the display pointer 253 and the animation-destination pointer 257.

When the simple VDL 251 of FIG. 2 is designated by the CPU 110 as being the master VDL, then the Video Display List Engine portion 115' of the DMA engine 115 will cause the contents of image buffer 255 to be displayed on the screen of monitor 160 (and/or sent to the digital signal storage/processing means 170) in accordance with the information contained in the single VLCB 252.

It is to be understood that the image data within buffer 255 is not necessarily the image data that is being displayed on monitor 160 (or sent to the digital signal storage/processing means 170) at a given time. It becomes the displayed image when the simple VDL 251 is made the master VDL. The logical connections (253,254) that are made between the simple VDL 251 and the full-screen image buffer 255 make it possible to quickly display the contents of buffer 255 simply by naming VDL 251 as the master VDL. Until VDL 251 is named master, the image information pointed to by fields 253 and 254 of VDL 251 are in a stand-by state, ready to be displayed rather than being actually displayed. Hence the term "displayable" rather than "displayed" is used in defining this simple DAIB structure 250. (It should be understood that a VDL other than 251 can point to part or all of buffer 255 at the same time, and if that other VDL is active, the pointed to parts of buffer 255 may be displayed by way of that other VDL even though VDL 251 is not active at the time.)

It is to be additionally understood that the cel engines (spryte-rendering engines) 109*a,b* are not necessarily writing spryres into a region or all of image buffer 255 at any given time. The Cel Animation Destination Map (CADM) 256 constitutes a data structure that stands ready for directing the cel engines 109*a,b* to render sprytes into buffer 255 when desired. Hence the term "animateable" rather than "animated" is used in describing the DAIB structure 250. The cel engines 109*a,b* can be writing to buffer 255 regardless of whether all or parts of it are being currently displayed or not. The Video Display List Engine 115' can be displaying the contents of buffer 255, or not, regardless of whether the cel engines are or are not concurrently writing new image data into buffer 255. The display and render functions can be actuated independently of one another so that they occur either both at a same time or at different times, one after the next.

Figure 3:
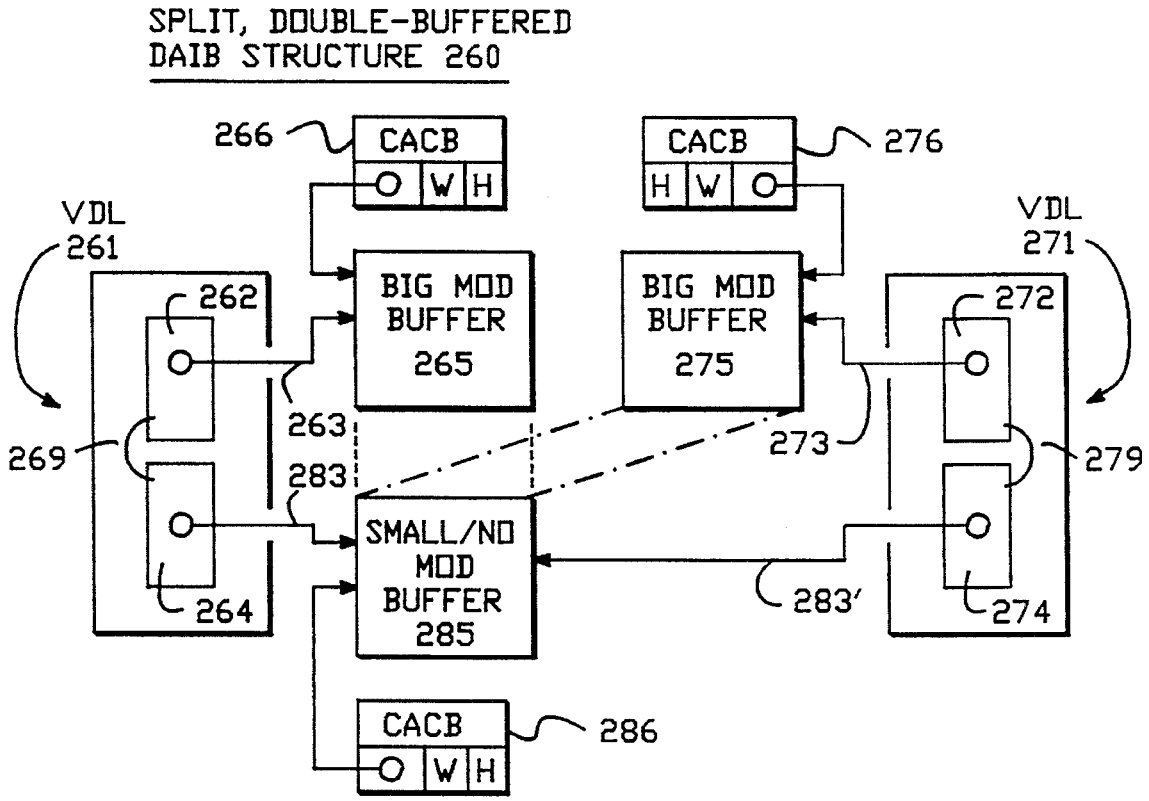
FIG. 3 diagrams a "split, double-buffered" DAIB structure.

FIG. 3 shows the data structure of a more complex, "split, double-buffered" DAIB structure 260. The split, double-buffered DAIB structure 260 includes a first VDL 261 and a second VDL 271. The first VDL 261 has two VLCB's, 262 and 264, defined therein. The threaded-list link 269 that joins VLCB 262 to VLCB 264 is preferably based on relative addresses rather than absolute addresses. The image source pointer 263 of first VLCB 262 points to a first image buffer 265. The image source pointer 283 of second VLCB 264 points to a second image buffer 285.

The NoLines field of VLCB 262 is set so that the number of image lines to be displayed out of the first buffer 265 is less than that used for filling an entire screen (e.g. less than 240 low resolution lines). The NoLines field of VLCB 264 is similarly set so that the number of image lines to be displayed out of the second buffer 285 is similarly less than that needed for filling an entire screen. When buffers 265 and 285 are stitched together, however, by VDL 261, —and VDL 261 is made active—the image lines of buffers 265 and 285 combine to fill all or a significant portion of the screen 165. (VLCB 262 is downloaded into the hardware during a first H-BLANK period and VLCB 264 is downloaded into the hardware during a second H-BLANK period further down the same frame.)

For purposes of example, it will be assumed that the displayable imagery of buffer 265 fills a top portion of the display screen and the displayable imagery of buffer 285 fills a remaining bottom portion of the display screen. More specifically, it will be assumed that the lower buffer 285 contains the imagery of a control panel such as used in an airplane cockpit or on an automobile dashboard.

It will be further assumed that a real-time game or simulation program is being executed on the image processing and display system 100, and the image 165 on video display unit 160 is showing the pilot's or driver's view of what is happening during a fast-paced flight simulation or a car-racing simulation, both inside and outside the vehicle. It will be assumed that the upper portion of the screen (buffer 265 of FIG. 3) contains the "outside world" view—in other words, what would be seen through the windshield of the simulated vehicle as the vehicle (e.g., airplane or car) moves and changes directions.

During a fast-paced game or simulation, many changes will have to be made to what is shown through the windshield of the simulated airplane/car. The background scenery changes quickly as the vehicle changes orientation. Other moving objects (e.g., other airplanes or cars) quickly move in and out of the scenery displayed through the windshield.

In light of this, there is a need to make fast-paced, bulk modifications to the imagery contained in the upper-screen buffer 265. Buffer 265 is accordingly referred to here as a first bulk/fast modification buffer. The term "bulk/fast modification" is intended to imply that fast-paced changes and/or changes to a bulk portion of the imagery in the buffer have to be often made on a real time basis as the game/simulation proceeds.

A first Cel Animation Control Buffer (CADM) 266 is shown logically coupled to the first bulk/fast modification buffer 265 for enabling the spryte engines 109*a,b* to write image modifications into buffer 265.

In contrast to the rapid and/or major changes that need to be made to the outside-world view that comes through the windshield, no or very few modifications have to be made to the control panel of buffer 285 over relatively long spans of time. Perhaps an instrumentation needle may have to be moved a slight amount one way or another; or an indicator light may have to be switched on or off, but the rest of the control panel remains basically unchanged. Also, the player is probably focusing most of his/her attention on the fast-paced imagery coming through the top window and probably paying much less attention to what is being displayed on the control panel. So when changes are to be made to the imagery of the bottom buffer 285 they tend to be of a minute nature and often times they are not time critical—meaning that they can be often put off for a later time, when a time slot conveniently opens up in the play action for downloading the control panel changes.

In light of this, buffer 285 is referred to as the slow/small/no modification buffer 285. A second Cel Animation Destination Map (CADM) 286 is shown logically coupled to the small/no modification buffer 285 for allowing the spryte engines 109*a,b* to write into buffer 285.

The second VDL 271 is structured similarly to the first VDL 261 and has corresponding third and fourth VLCB's 272 and 274 linked by relative thread 279. The fourth VLCB 274 points to the small/no modification buffer 285 in substantially the same way that the second VLCB 264 points to that same small/no modification buffer 285. The third VLCB 272, on the other hand, points to a third buffer 275 which is referred to here as the second bulk/fast modification buffer 275. A third Cel Animation Destination Map (CADM) 276 is logically coupled to the second bulk/fast modification buffer 275 for allowing the cel animation engines 109*a,b* to write new imagery into buffer 275.

The problem of image tear has been discussed above and will not be repeated here. One solution to the tear problem is to double buffer the entire screen, but this wastes memory space, particularly when one or more bands of the screen (such as the above-described cockpit control panel) will have no or only a few minute changes made to their contents over relatively long periods of time, The better approach is to use the split, double-buffered DAIB structure 260 of FIG. 3. The application program periodically swaps the designation of the currently active VDL back and forth between the first VDL 261 and the second VDL 271. When the first VDL 261 is the active video display list, the screen shows the first bulk/fast modification buffer 265 filling its top and the small/no modification buffer 285 filling the bottom of the screen 165. The first CADM 266 is taken off the activity queue of the spryte engines 109*a,b* so that the spryte engines 109*a,b* will not write to the first bulk/fast modification buffer 265 during the time that buffer 265 is being actively displayed.

The second CADM 286 is kept on the activity queue of the spryte engines 109*a,b* during this time. Because no changes or only a few minute changes will be made on-the-fly to buffer 285, it is unlikely that a noticeable tear will occur in the imagery of buffer 285, even if the spryte engines 109*a,b* are writing to a line of buffer 286 at the same time that the display beam of video display unit 160 is moving through that same line. This might be seen as a small twitch in the length of an advancing instrumentation needle and will probably not draw attention.

At the same time that the image buffers of VDL 261 are being actively displayed, the third cel animation control block (CADM) 276 is placed on the activity queue of the spryte engines 109*a,b* so that the spryte engines 109*a,b* can make major changes to the imagery contained in the second bulk/fast modification buffer 275. The rendition operation of the spryte-rendering engines 109*a,b* is started. Because buffer 275 is not being actively displayed at this time, there is no danger that a noticeable tear will appear on the display screen due to major modifications then being made to the imagery of buffer 275 by the spryte-rendering engines 109*a,b*. Minor changes to buffer 285 are unlikely to draw notice even if they cause a slight glitch in the then displayed imagery.

When desired changes to the second bulk/fast modification buffer 275 and to the small/no modification buffer 285 have completed, the spryte-rendering engines 109*a,b* signal the CPU 110 that they have completed the job. The CPU 110 then designates the second VDL 271 as the active video display list while making the first VDL 261 nonactive. The third CADM 276 is taken off the activity queue of the spryte engines 109*a,b* and the first CADM 266 is placed onto the activity queue of the spryte engines 109*a,b*. The spryte-rendering engines 109*a,b* are restarted. The screen of monitor 160 will now show the contents of the second bulk/fast modification buffer 275 at its top and the contents of the small/no modification buffer 285 still filling the bottom of the screen. This new combination is indicated by the dash dot lines linking buffers 275 and 285.

Major changes to the first bulk/fast modification buffer 265 are made in the background by the restarted spryte-rendering engines 109*a,b* while the combination of buffers 275 and 285 are displayed in the foreground. When the new spryte rendering operation completes, the first VDL 261 is again made the active video display list while the second VDL 271 is made inactive. The swapping process repeats with the completion of each rendition by the spryte-rendering engines 109*a,b*. The split buffer nature of this approach has the benefit of reducing the amount of memory and time consumed by double buffering.

While the above description of FIG. 3 used the example of a screen that is split into two parts (a top windshield and a bottom control panel), it should be apparent that much more complex structures can be formed by appropriate linking of VLCB's to form different varieties of VLD's. By way of example, a same horizontal band of a given image buffer (e.g., 265) can be repeatedly called into different parts of a displayed screen by a series of VLCB's in a longchained, active VDL. A one time change to the contents of the repeatedly-called buffer band will be multiplied on the screen by the number of times that same band is called by the active VDL.

For purposes of speaking, it is useful to define the set of horizontal image bands that are stitched together by a VDL as a "virtual screen". Each virtual screen has a single Video Display List (VDL) associated with it. Thus, in FIG. 3, image bands from buffers 265 and 285 become stitched together to define a first "virtual screen". The first VDL 261 is the VDL associated with that first virtual screen. Image bands from buffers 275 and 285 become stitched together to define a second "virtual screen". The second VDL 271 is the VDL associated with that second virtual screen. Double-buffering is performed by periodically switching the "active" virtual screen designation back and forth between the first virtual screen (265 plus 285) and the second virtual screen (275 plus 285).

A triple-buffering process can be set up by establishing an array of three virtual screens (not shown) and rotating the active designation among them. More generally, an n-buffering process can be set up by establishing an array of n virtual screens and rotating the active designation among them. The array of n virtual screens is referred to a "screen group".

A generalized approach to creating a screen group and displaying the imagery extracted from that group can be explained by the following procedure guide:

PROCEDURE GUIDE FOR CREATING AND DISPLAYING SCREENS

CREATING A SCREEN GROUP

Displaying a "virtual screen" within an executing task is a three-level process: You first create a "screen group" composed of an array of one or more virtual screens, you then add the screen group to a displayable set in the graphic folio's display mechanism, and finally you display a screen from the group by making it the active or master screen.

Creating a "screen group" can be a fairly involved step—or it can be extremely simple, depending on whether you chose to create your own custom set of screens or you use a provided set of default screen group settings. This section describes your options in defining a screen group and its components.

The CreateScreenGroup( ) Call

To create a screen group, use the procedure call:

```
Item CreateScreenGroup(item *screenItemArray, TagArg
    *tagArgs)
```

The first argument is a pointer to a one-dimensional array with one element for each screen in the screen group. You must dimension the array so that it contains at least as many elements as the screen group has screens. When CreateScreenGroup( ) is executed, it creates the number of screens specified in its tag arguments, and fills in the array elements with an item number for each screen. You use the item numbers to refer to any screen in the group.

The second argument is a pointer to a list of tag arguments (tag args), groups of values that specify the attributes of the screen group. Each tag arg is a pair of 32-bit values. The first value (ta_Tag) specifies which attribute of the screen group is being defined; the second value (ta_Arg) specifies how that attribute is defined. The list can contain a variable number of tag args in any order; it must be terminated, however, with a CSG_TAG_DONE tag arg so the call knows when it's finished reading tag args.

CreateScreenGroup( ) assumes that any tag arg not sullied in the tag arg list is set to a default value. For example, if the tag arg for the screen count is not in the list, CreateScreenGroup( ) sets the screen count to the default value of 1. If you want CreateScreenGroup( ) to create a screen group with nothing but default values, you can substitute "NULL" for the tag arg list pointer. You then create a screen group with a single 320×240 screen, a single 320×240 bitmap, and a standard (simple) VDL.

When CreateScreenGroup( ) executes, it creates and links together the data structures that define the bitmaps, VDLs, screens, and other components of the screen group. It also allocates any resources necessary to create the screen group (such as VRAM for bitmap buffers). When finished, it returns zero to indicate success, or a negative number (an error code) if it was unsuccessful.

The sections that follow describe the tag args you can use with the CreateScreenGroup( ) call.

Setting the Screen Count and Dimensions

The tag arg CSG_TAG_SCREENCOUNT sets the number of screens in the screen group. Its value is the integer number of screens you want in the group; you should set it to the appropriate number for your purposes: two for double-buffering, three or four for double-buffered stereoscopic display, etc. (Stereoscopic display relies on the use of LCD shutter glasses that alternatingly show interlaced fields to an observer's left and right eyes.) The default value for this tag arg is one.

Be sure that the returned screen item number array you create for the CreateScreenGroup( ) call has at least enough elements to contain the number of screens you specify here.

The tag arg CSG_TAG_SCREENHEIGHT sets the height in pixels of the buffer for each screen in the screen group. (The buffer is the combined VRAM of all of each screen's bitmaps.) The default value is 240, which is the maximum number of visible rows in the NTSC display, but you can set the height to be larger (so you can hide parts of the screen off the display) or smaller (so you can reveal other screen groups below this one).

The tag arg CSG_TAG_DISPLAYHEIGHT sets the height in pixels of the visible portion of each screen in the screen group. The display height can't be set to reveal more of a screen than exists, so this value must always be less than or equal to the screen height value. When you set a value here that's less than the screen height, the bottom rows of the screen group are hidden in the display, an effect that can reveal other screen groups beneath this one. When you set a value that's greater than the screen height, added rows of black appear at the bottom of the screen. The default display height is 240, enough to fully display a default screen height.

Note that both CSG_TAG_SCREENHEIGHT and CSG_TAG_DISPLAYHEIGHT must be set to an even number. That's because the frame buffer stores pixels in left/right format, binding pairs of odd and even frame buffer together in VRAM. If you specify height with an odd number, the graphics folio rounds the value up to the next higher even number.

Setting Bitmap Counts, Dimensions, and Buffers

The tag arg CSG_TAG_BITMAPCOUNT sets the number of bitmaps within each screen of the screen group. You must have at least one bitmap; you can, in theory, have one bitmap per screen row if you wish. It's easier, however, to manage a more reasonable number of bitmaps—less than ten, for example. If you don't specify a bitmap count, the default is one bitmap per screen.

The tag arg CSG_TAG_BITMAPWIDTH_ARRAY controls the width of each bitmap set in the bitmap count. It contains a pointer to a one-dimensional array of 32-bit integer values, one value for each bitmap. The values in the array apply to the bitmaps within a screen starting with the top bitmap, working down to the bottom bitmap. Each array value sets the width in pixels of its corresponding bitmap. Bitmaps may be wider than their parent screen, in which case the rightmost columns of the bitmap are truncated from the screen, and not displayed. Bitmaps may also be narrower than their parent screen, in which case they are appear flush on the left side of the screen.

A bitmap's width may be set to only one of a set of possible widths. Those widths are 32, 64, 96, 128, 160, 256, 320, 384, 512, 576, 640, 1024, 1056, 1088, 1152, 1280, 1536, and 2048. The default bitmap width is 320 pixels, which exactly matches the screen width of the NTSC display.

The tag arg CSG_TAG_BITMAPHEIGHT_ARRAY controls the height of each bitmap set in the bitmap count. Like the bitmap width tag arg, this tag arg points to a one-dimensional array of 32-bit integer values, one for each bitmap, going from the top bitmap to the bottom bitmap. You don't need to set this tag arg if there is only one bitmap set per screen (in which case the bitmap height is set to 240), but you must set bitmap heights if there is more than one bitmap per screen.

Bitmaps are contiguous within the screen; one bitmap picks up where the last bitmap left off. If the combined bitmap heights are greater than the screen height, then the bottom rows of the bottom bitmap (or bitmaps) are clipped from the screen. If the combined bitmap heights are less than the screen height, then the bottom of the screen is empty—filled with 000 pixels. <<<In a planned future release of Portfolio, bitmaps may be able to be positioned within a screen using a Y offset.>>>

The tag arg CSG_TAG_BITMAPBUF_ARRAY lets you specify a bitmap buffer in VRAM for each bitmap—if you're intent on doing it by hand, and don't let the graphics folio do it for you automatically. If you skip this tag arg altogether, you can live a life of leisure: the graphics folio specifies all the bitmap buffers on its own. If you decide to use this tag arg, its value is a pointer to one-dimensional array of pointers, one per bitmap. The bitmap order is top to bottom in the first screen, top to bottom in the next screen, and so on. Each bitmap pointer points to the starting address in VRAM of the bitmap buffer.

Note that the bitmap buffer array must contain one entry for each bitmap in the screen group. For example, if a screen group has two screens and each screen has three bitmaps, then the array must contain six pointers, one for each bitmap. Those pointers can, of course, point to the same address if you want to share a buffer among bitmaps.

The tag arg CSG_TAG_SPORTBITS is the last bitmap tag arg. It controls the location of the bitmap buffers when they're allocated so that the buffers are capable (or not, if so specified) of using SPORT transfers. SPORT transfers are used for refreshing bitmap backgrounds between frames, erasing cel projections and other perframe renderings to start with a fresh background for new projections and renderings. (SPORT transfers are S-bus data downloads occurring during the V-BLANK period.)

SPORT transfers between bitmap buffers (or within a bitmap buffer) require that the buffers reside within the same bank of memory, so it's important that the buffers be placed together within the same bank when allocated. Banks of VRAM are specified with a 32-bit mask whose bits show selected VRAM banks. The kernel call GetBankBits( ) accepts a pointer to any memory location, and then returns a bank mask with the proper bits set to show within which VRAMbank the memory location resides.

If you provide a 32-bit bank mask specifying a single VRAM bank for CSG_TAG_SPORTBITS, bitmap buffers are allocated within that specified bank. If you provide a null mask (all bits set to 0 so no banks are specified), all bitmap buffers are allocated within a single unspecified bank of memory so that SPORT transfers are possible among all bitmaps. And if this tag arg is left out altogether, bitmap buffers are placed in any available VRAM without regard to banks, so that SPORT transfers among bitmaps may not be able to take place.

Note that CSG_TAG_SPORTBITS settings apply to bitmap buffers whether you specify each buffer by hand with the CSG_TAG_BITMAPBUF_ARRAY tag arg or if you leave the tag arg out and let the graphics folio specify bitmap buffers for you.

Setting Screen VDL Types and Attaching Custom VDLs

The tag arg CSG_TAG_VDLTYPE specifies the type of VDL supplied for each screen of the screen group—one type for all the screens in the group. The VDL type specified here is used whether you supply your own "custom" VDLs (in which case this tag arg tells CreateScreenGroup( ) what kind of VDLs you're supplying), or the graphics folio supplies VDLs for you (in which case it tells the graphics folio what kind of VDLs it must create).

The five types of "noncustom" VDLs you can specify here are:

VDLTYPE_SIMPLE, which has one entry. This entry points to a single bitmap buffer, and defines a single VLCB having one set of CLUT and display control words. The single bitmap buffer and VLCB (CLUT, and display control settings) are used for the entire screen.

VDLTYPE_FULL, which has an entry for each line of the display. Each entry has its own bitmap buffer pointer and its own VLCB (set of CLUT and display control words).

VDLTYPE_COLOR, which has an entry for each line of the display. Each entry has only a full CLUT, and does not (and can not) include a bitmap buffer pointer or a display control word. The colors of the CLUT are changeable on a line by line basis while the display control remains fixed for the entire screen and the bitmap remains the same for the entire screen. <<<This type of VDL isn't supported yet in the below listed Portfolio.>>>

VDLTYPE_ADDRESS, which has an entry for each line of the display. Each entry has only a bitmap buffer pointer, and does not (and can not) include CLUT and display control words. The address from which a screen band will be fetched for display is changeable on a line by line basis and the corresponding bitmap for rendering to each band can be changed on a line by line basis; but the display control and the colors of the CLUT remain fixed for the entire screen. <<<This type of VDL isn't supported yet in the below listed Portfolio.>>>

VDLTYPE_DYNAMIC, which can be modified freely both in terms of address per line and CLUT per line. <<<This type of VDL isn't support yet in the below listed Portfolio.>>>

The default VDL type is VDLTYPE_SIMPLE.

If you're bold and decide to create your own VDLs, the tag arg CSG_TAG_VDLPTR_ARRAY lets you point to a custom VDL for each of the screens in the screen group. It contains a pointer to an array of VDLs, each of which must match the type specified in the previous tag arg. If you don't specify an array of VDLs here, then the graphics folio will create them for you. The graphics folio provides a set of VDL calls that create VDLs and submit them to the system for approval.

Note that if you create a custom VDL, the graphics folio ignores all the previous tag args about bitmaps because your custom VDL will have to define its own corresponding bitmap or bitmaps.

CREATING CUSTOM SCREEN VDLs

Several procedure calls create, modify, and connect a VDL to a screen. Your first task is to create a VDL data structure to submit to the system. You can create any of the five VDL types described earlier in the VDL tag args section:

The Simple VDL Data Structure

A single VLCB (Video Line/s Control Block) linked to a single image buffer which is then linked to a single bitmap (CADCM, see FIG. 2).

The Full VDL Data Structure

240 VLCB's threaded one to the next, each with its own CLUT palette and source address and rendition-controlling bitmap.

The Color VDL Data Structure

240 VLCB's threaded one to the next, each with its own CLUT palette. Only the first VLCB defines a source address and rendition-controlling bitmap. The remaining VLCB's refer to the remaining contiguous lines of a single 240 line image buffer.

The Address VDL Data Structure

240 VLCB's threaded one to the next, each with its own source address and rendition-controlling bitmap. Only the first VLCB defines the CLUT palette. The remaining VLCB's rely on the CLUT palette downloaded by the first VLCB.

The Dynamic VDL Data Structure

<<<This section to be filled in when the VDL data structure is defined.>>>

Submitting a Screen VDL

Once you've created a custom screen VDL data structure, you submit it to the system with the procedure call:

```
int32 SubmitVDL(VDLEntry *vdlDataPtr)
```

The single argument submitted to this call is a pointer to your custom VDL data structure. Portfolio reads the data structure, proofs it for bad arguments, and—if it finds none—copies the VDL under the fence, into system RAM, as a screen VDL. It returns an item number for the screen VDL, which you can use in a CreateScreenGroup( ) tag arg to associate the VDL with a newly-created screen in a screen group. You can also use the VDL item number to specify the VDL when you modify it or its connections.

Modifying a VDL

To modify the contents of a screen VDL in system RAM, use the procedure call:

```
long ModifyVDL(item IVDL, long linenumber, long *Targs)
```

The first argument specifies the screen VDL, the second argument specifies the number of the VDL line to receive the modification, and the third argument points to a tag arg array that describes the changes to be made to the VDL.

The call returns a zero to indicate success, or an error code (less than zero) if there was a problem.

Note that you can't modify a screen VDL by modifying the VDL data structure you used to first create that VDL. It now exists in system RAM, and must be modified using ModifyVDL( ).

Setting a New VDL for an Existing Screen

If you've already created a screen in a screen group and want to assign a different screen VDL to that screen, use the procedure call:

```
int32 Set VDL(Item screenItem, Item vdlItem)
```

The first argument specifies the screen to which you want to assign a new screen VDL, and the second argument specifies the screen VDL that you want to assign.

Deleting a VDL

To delete a screen VDL, use the call DeleteItem( ), and supply it with the item number of the screen VDL to delete. If you delete a VDL that is in use, the screen depending on that VDL goes black.

SETTING A SCREEN'S COLOR PALETTE

The contents of a screen's CLUT set determine the color palette available to the pixels in the screen. If you don't specify any custom colors for a screen, then the screen uses the default CLUT set, the fixed CLUT set. The fixed palette contains a linear ascending color palette.

If you want to set a custom color palette for a screen, you can do so by creating a custom VDL, which can be an involved process, as you just read. This method lets you change color palettes from line to line within a screen. If you simply want to set a color palette for an entire screen that uses a simple VDL (one that doesn't change parameters from line to line), then you can use the much simpler graphics folio color calls. These calls accept new color entries for a screen's CLUT set and then revise the screen's VDL appropriately. You don't have to deal with the VDL directly.

A CLUT Set Review

As you'll recall from the above discussion, the display generator reads pixels from the frame buffer. Each frame buffer pixel has a 15-bit color value: five bits devoted to red, five to green, and five to blue (in the 1/555 mode). Those values enter the CLUT (Color LookUp Table) set, which has a separate lookup table for red, green, and blue. Each CLUT register stores an eight-bit value.

When a 15-bit RGB value enters the CLUT set, it's broken into its red, green, and blue components. Each component enters the appropriate CLUT, where it selects a corresponding eight-bit red, green, or blue value. The three outputs are combined into a 24-bit RGB value that is then used for that pixel in the rest of the display generator.

The CLUT for each color has 33 registers: numbers 0–31 are for direct color indexing; number 32 is for any pixel marked as background. Although red, green, and blue are separated when they enter the CLUT set, and although the CLUT set is treated as three CLUTs, one for each color, the physical reality of the CLUT hardware is that each CLUT register extends across all three colors. That is, each register is 24 bits wide. The first eight bits are for red, the second eight bits for green, and the last eight bits for blue. When the VDLP (Video Display List Processor or engine) writes a new register value into the CLUT set, it writes a 24-bit value that changes red, green, and blue for that register number. For example, if the VDLP sets a new value for register 3, it writes a 24-bit value that changes red register 3, green register 3, and blue register 3.

Specifying a New Color

To set a new color in the CLUT set, you must first specify which CLUT register you want to set, and then specify the 8-bit red, green, and blue values you want in that register. Use this call to specify red, green, and blue together and then return a value you can then use to set red, green, an blue within a CLUT register:

```
int32 MakeCLUTColorEntry(index, red, green, blue)
```

The call accepts an unsigned index byte that indicates which CLUT set register you want to change. A value of 0 to 31 indicates registers 0 to 31 in the CLUT set; a value of 32 indicates the background register.

The call also accepts an unsigned byte each for the red, green, and blue value you want to set in the CLUT set register. A minimum value of 0 indicates none of the color, while a maximum value of 255 indicates as much of the color as possible.

MakeCLUTColorEntry( ) returns a 32-bit value that you can use with the color-setting calls to change CLUT set registers.

To specify only a red, a green, or a blue value to write into a CLUT register without touching any of the other color values in the register, use these three calls:

```
int32 MakeCLUTRedEntry(index, red )

int32 MakeCLUTGreenEntry(index, blue)

int32 MakeCLUTBlueEntry(index, blue)
```

Each call accepts an unsigned index byte to indicate which CLUT set register you want to change, and then accepts an unsigned byte with that signifies a red, green, or blue color value you want to set. Use MakeCLUTRedEntry( ) to specify a red value, MakeCLUTGreenEntry( ) to specify a green value, and MakeCLUTBlueEntry( ) to specify a blue value.

Each of these calls returns a 32-bit value to use with a color-setting call.

Setting a New Color Register Value in the CLUT Set

The simplest of these is this call:

```
int32 SetScreenColor(Item screenItem, int32 colorEntry)
```

SetScreenColor( ) accepts the item number of the screen for which you want to change the color palette. It also accepts a color entry value created by any of the four CLUT entry calls: MakeCLUTColorEntry( ), MakeCLUTRedEntry( ), MakeCLUTGreenEntry( ), and MakeCLUTBlueEntry( ). The color value specifies the color register and the colors you want to change. SetScreenColor( ) then changes the screen's VDL so that the screen uses the custom CLUT set (if it was using the fixed CLUT set) and so that the appropriate register in the CLUT set uses the new color or colors you specified.

SetScreenColor( ) returns a zero if successful, or a negative number (an error code) if unsuccessful.

Setting Multiple New Color Register Values in the CLUT Set

If you want to set more than one color in a screen's palette at a time, use this call:

```
int32 SetScreenColors(Item screenItem, int32 *entries, int32
    count)
```

The call accepts the item number of the screen for which you want to change the palette. It also accepts a pointer to a list of 32-bit color entries and a 32-bit count value that gives the number of entries in the list. Each of the color entries is a value set by one of the four CLUT entry calls.

When SetScreenColors( ) executes, it reads each color entry, and then changes the specified screen's VDL appropriately so that it uses the custom CLUT set and writes the specified colors into the specified CLUT set registers.

Reading Current CLUT Set Registers

You may occasionally need to read the color value currently stored in a CLUT set register. To do so, use this call:

```
RGB888 ReadScreenColor(ulong index)
```

It accepts an index number from 0 to 32 which specifies registers 0 to 31 or the background register (32) of the CLUT set. It returns a 24-bit RGB value if successful. The first byte of the RGB value is red, the second is green, and the third is blue. The call returns a negative number (an error code) if unsuccessful.

Resetting the Fixed Palette for a Screen

If you want a screen to abandon its custom palette and return to the linear ascending color of the fixed palette, use this call:

```
int32 ResetScreenColors(Item screenItem)
```

It accepts the item number of the screen for which you want to reset the palette and, when executed, changes the screen's simple VDL so that it specifies the fixed CLUT set for the entire screen. It returns a zero if successful, or a negative number (an error code) if unsuccessful.

DISPLAYING A SCREEN GROUP

Once a screen group and its components are defined, you use further graphics calls to display the screens of a given screen group in a video frame.

Adding a Screen Group to the Display

The first step in causing the screens of a screen group to show up in the displayed video, is to add the data structure for the screen group to the graphics folio's display mechanism, which you do with this call:

```
int32 AddScreenGroup(Item screenGroup, TagArg *targs)
```

The first argument is the item number of the screen group which you wish to add. The second argument is a list of tag args that defines how the screen group is to be placed in the display. <<<These tag args don't exist in the below-listed, latest release.>>>

This call returns a zero if the screen group was added to the display mechanism; it returns non-zero (an error code) if anything went wrong and the screen group was not added.

Displaying Screens

Once the data structure of a given screen group has been added to the display mechanism, you can display any of its screens (which includes all of the screens' visible bitmaps) by using the procedure call:

```
int32 DisplayScreen(Item ScreenItem0, Item ScreenItem1)
```

This call accepts two arguments, each the item number of a screen within the same screen group. The first screen is displayed in the odd field of a frame; the second screen is displayed in the even field of the same frame.

If you want to display a stereoscopic image from a screen group, specify two different screens in this call: the right screen first, the left screen second. If you don't want a stereoscopic image and instead want the same image displayed in both fields of the frame, you can either specify the same screen for both arguments, or you can pass a null value for the second argument.

DisplayScreen( ) returns zero if it was successful. It returns a value less than zero (an error code) if it wasn't successful.

Double-Buffering

To use a two-screen group for double-buffered animation, issue a DisplayScreen( ) call during each vertical blank. In one frame, specify one screen alone for display, and render to the other screen. In the next frame, specify the second screen alone for display, and render to the first screen. Continue alternating as long as the animation continues.

Double-buffering a stereoscopic display works much the same way, but instead of alternating between single screens in each frame, alternate between pairs of screens.

Multiple Screen Groups

When a screen appears in a display where screens from other screen groups are also present, the screen's position attributes (set in the tag args of AddScreenGroup( )) determines what screen is on top of what other screen. A screen with a position attribute of "bottom" will appear beneath all other screens present; a screen with a position attribute of "top" will appear above all other screens. If a screen doesn't fill the entire frame, any screens displayed beneath it will show through.

Moving Visible Screens

<<<Note: In the below listed latest release of Portfolio, this call does not yet exist.>>>

Once a screen is displayed, you can change its position in the frame with this call:

```
int32 MoveScreenGroup(Item screenGroup, Coord x, Coord y,
    level)
```

This call accepts the item number of the screen group that you wish to move, and accepts X and Y coordinates to specify the location within the frame where you want to screen group to move. The coordinates are figured from the frame's origin, which falls in the upper left corner of the frame. MoveScreenGroup( ) also accepts a level argument, a value that specifies whether the screen group appears on top of, at the bottom of, or in between any other screen groups in the display. <<<The level value is TBD. When it's set, a table will go here with those values.>>>

Note that whatever level you set with this call may not endure. Another screen group can change in relationship to this screen group, or the user might decide to pop another screen above or below this screen.

Removing a Screen Group From Display

Once a screen is displayed with the DisplayScreen( ) call, it remains in the frame until the screen's screen group is removed. To remove a screen group, use this procedure call:

```
int32 RemoveScreenGroup(Item screenGroup)
```

This call accepts the item number of the screen group that you wish to remove. It removes the group from the graphics folio's display mechanism, but the group's data structures and resource allocation remain intact. You may redisplay the group at any time with another AddScreenGroup( ) call followed by a DisplayScreen( ) call.

RemoveScreenGroup( ) returns a zero if successful, and returns a negative number (an error code) if it failed.

Deleting a Screen Group

To completely delete a screen group, including the data structures used for its definition and all of its allocated resources, use the call DeleteItem( ), and supply it with the item number of the screen group.

Note that anytime a task quits, any of its screen groups are automatically deleted.

RENDERING INTO A SCREEN

You can render into a screen by projecting a cel, drawing a graphics primitive, or rendering text. To project a cel, use either the DrawScreenCels( ) or the DrawCels( ) call. The first call projects a cel (or cel group) into a full screen even across multiple bitmaps if the screen has them. The second call restricts cel projection to a single bitmap, which is no restriction to single bitmap screens, but can create interesting effects in multiple. You'll find more details about both cel calls in the next chapter, "Using the Cel Engine."

To draw directly to a screen's bitmaps without the cel engine, use the graphics folio's drawing and text calls.

Creating a Graphics Context

Before a task can use drawing and text calls, it must first create a graphics context data structure (known as a GrafCon), defined below:

```
/* Graphics Context structure */
typedef struct GrafCon
    {
    Node gc;
    Color gc_FGPen;
    Color gc_BGPen;
    Coord gc_PenX;
    Coord gc_PenY;
    ulong gc_Flags;
    } GrafCon;
```

The GrafCon serves to keep track of the current status of the pen, an invisible cursor that moves through a bitmap as calls draw graphics primitives or render text. The pen has two colors: a foreground color and a background color, both specified as a 3DO RGB value in the low 15 bits of a 32-bit integer (the upper 17 bits are set to zero). The foreground color is stored in gc_FGPen; the background color is stored in gc_BGPen. The pen also has a position, specified in X and Y coordinates stored in gc_PenX and gcPenY. These two values are each 32-bit integers that are read in either 16.16 or 17.15 format. <<<The field gc_Flags isn't currently defined.>>>

The colors and the coordinates of the GrafCon's pen are stored independently, and aren't connected to any specific bitmap or screen. When a task uses a drawing or text call, it specifies a bitmap where it wishes to render, and then points to a GrafCon to use the values stored there. When the call executes, it often changes the GrafCon values when finished. For example, a line-drawing command uses a GrafCon's pen position to start the line, draws the line, and then changes the GrafCon's pen position to the position of the line's end. And a text rendering routine advances the pen position beyond the character just rendered.

A task can use as few or as many GrafCons as are useful. For example, one GrafCon can be used for rendering to multiple bitmaps; if so, the last-used GrafCon values in one bitmap become the first-used GrafCon values in a new bitmap when a call switches bitmaps but not GrafCons. A task may also create a separate GrafCon for each bitmap and switch to the appropriate GrafCon whenever it switches rendering to a new bitmap. Or a task may create more than once GrafCon for a single bitmap and use the multiple GrafCons to store multiple pen positions and colors within the bitmap, switching GrafCons whenever to switch pen states.

Setting Pen Colors

When a GrafCon structure is first created, you can, of course, set it to whatever background and foreground pen colors you wish. To set new pen colors in the Grafcon, use these calls:

```
void SetFGPen(GrafCon *grafcon, Color color)

void SetBGPen(GrafCon *grafcon, Color color)
```

Each call accepts a pointer to the GrafCon and a 15-bit 555 formated color stored in the low 15 bits of a 32-bit integer. When executed, SetFGPen( ) changes the GrafCon's foreground pen color to the specified value; SetBGPen( ) changes the GrafCon's background pen color to the specified value.

If you have a 24-bit RGB color that you'd like to turn into a 15-bit RGB color value, use this convenience call:

```
int32 MakeRGB15(red, green, blue)
```

It accepts a red value, a green value, and a blue value (which you can supply from a 24-bit RGB value by breaking it into three 8-bit values). MakeRGB15( ) takes the lowest five bits from each value and combines them to create a 15-bit RGB value.

Setting Pen Position

The GrafCon's stored pen position always specifies a point that is figured from the origin of whatever bitmap is specified by a graphics call. That position is often changed by the graphics folio after executing a drawing or text callo If you'd like to change the pen position without drawing or rendering text, use this call:

```
void MoveTo(GrafCon *grafcon, Coord x, Coord y)
```

MoveTo( ) accepts a pointer to the GrafCon whose pen position you want to change, as well as a 32-bit X and a 32-bit Y value. When executed, it writes the new pen position into the specified GrafCon so that the next call referring to that GrafCon uses the position as its starting pen position.

Finding a Bitmap Within a Screen

To specify a bitmap for rendering, you must know its item number. To get the item number, use this call:

```
item LocateBitmap(Item ScreenItem, long bitmapnumber)
```

This call accepts the item number of a screen in which you wish to find a bitmap, and the number of the bitmap within that screen: 0 for the first bitmap within the screen, 1 for the second bitmap within the screen, and so forth. It returns the item number for the specified bitmap. If that bitmap doesn't exist (for example, if you specify bitmap 4 in a two bitmap screen), then the call returns a zero. If the call runs into any other problems, it returns a negative number (an error code).

Drawing Graphics Primitives

Once a GrafCon is set up with proper pen colors and coordinates and you have the item number for a bitmap in which you wish to draw, you can use the graphics folio's drawing calls. The simplest is this call:

```
int32 WritePixel(Item bitmapItem, GrafCon *grafcon, Coord x,
    Coord y)
```

WritePixel( ) accepts the item number of the bitmap to which you want to render, and a pointer to the GrafCon whose pen values you want to use. It also accepts X and Y coordinates (each in a 32-bit integer). When executed, it writes the current foreground pen color into the pixel at the specified coordinates in the bitmap. Because this call has its own coordinates, it ignores the GrafCon's stored pen position. When the call is finished, it writes its own coordinates into the GrafCon to be used as the starting pen position for the next call.

To draw a line, use this call:

```
void DrawTo(Item bitmapItem, GrafCon *grafcon, Coord x,
    Coord y)
```

DrawTo( ) accepts the item number of the bitmap to which you want to render, a pointer to the GrafCon you want to use, and X and Y coordinates to the end of the line. When executed, this call draws a line from the GrafCon's pen position to the position specified in its arguments. It uses the foreground pen color, and when finished, it writes the line end's coordinates in the GrafCon as the starting pen position for the next call.

Note that DrawTo( ) renders pixels at both the starting and ending locations in the line it draws.

To draw a filled rectangle in a bitmap, use this call:

```
int32 FillRect(Item bitmapItem, GrafCon *grafcon, Rect *bound-
    ary)
```

It, as other calls do, accepts a bitmap item number and a pointer to a GrafCon. It then accepts a pointer to a Rect data structure which defines the rectangle. Rect is defined as follows:

```
typedef struct Rect
    {
    Coord rect_XLeft;
    Coord rect_YTop;
    Coord rect_XRight;
    Coord rect_YBottom;
    } Rect;
```

The four coordinates (each a 32-bit integer) define the left, top, right, and bottom boundaries of the rectangle. The left and right boundaries are X coordinates; the top and bottom boundaries are Y coordinates.

Note that the Y values in the Rect structure should be even numbers to allow for the left/right pixel storage in VRAM. If they are odd numbers, the graphics folio rounds them up to the next higher even number.

Finding a Pixel's Color and Address

To find the color contents of a single pixel within a bitmap, use this call:

```
Color ReadPixel(Item bitmapItem, GrafCon *grafcon, Coord x,
    Coord Y)
```

This call accepts the item number of the bitmap where the pixel is located, a pointer to a GrafCon, and X and Y coordinates of a pixel within the bitmap. When ReadPixel( ) executes, it returns the 3DO RGB color value of the specified pixel. It then changes the pen position of the GrafCon to the new X and Y coordinates.

To find the absolute address of a pixel within a screen (regardless of which bitmap it's in), use this call:

```
void *GetPixelAddress(Item screenItem, Coord x, Coord y)
```

The call accepts the item of the screen in which the pixel is located, and X and Y screen coordinates (figured from the screen's origin) of the pixel. When the call executes, it goes to the bitmap where the point specified by the coordinates is located, and finds the absolute address of the pixel there, which it returns.

This call is particularly useful for cel projection when the cel's source data is a subrectangle extracted from a screen.

This call can find the address necessary to set up the necessary offsets in the preamble to the source data.

Rendering Text

To render text in a bitmap, the graphics folio's text calls depend on a font table, a set of 1-bit deep patterns that define each character within a character set. <<<The structure of a font table hasn't been set in this release.>>> Within a font table, the pattern for each character is called a character block. A character block is a rectangle of 1-bit pixels that uses ones for pixels that are part of the character and zeros for pixels that are background to the character.

Text calls, like graphics calls, depend on a GrafCon for pen colors and pen position. Whenever a call renders text, it uses the foreground pen color for the character pixels and uses the background pen color for the background pixels. The pen position determines the location of the upper left corner of a character block.

Setting a Font

A text rendering call uses the system's current font table whenever it renders characters to the screen. The current font is usually set to a default font, but if you want to set a different font, you may specify it with this call:

```
void SetCurrentFont(Font *font)
```

The call accepts a pointer to the font table you want to use and, after it is executed, sets the current font to the character set contained in the font table to which you pointed. Text rendering calls after this call use the new current font until you set another current font.

If you want to return to the system's original font, use this call:

```
void ResetCurrentFont(void)
```

It resets the font table pointer to the system's default font, and all text rendering calls after it use the default font (until and unless, of course, you reset the current font once again). <<<In this release of Portfolio, if a task has set a new default font, it must always execute ResetCurrentFont( ) before it exits. In future releases, this will be taken care of automatically.>>>

If you're unsure of the font that is currently the current font, or if you want to find out the parameters of the current font, you can get a pointer to the current font's table by executing this call:

```
Font *GetCurrentFont(void)
```

It returns a pointer to the default font table.

Placing Characters

Once you've set the font you want, you can place a single character in a bitmap with this call:

```
int32 DrawChar(GrafCon *gcon, Item bitmapItem, uint32 character)
```

It accepts a pointer to a GrafCon and an item number for a bitmap to establish the graphics context and the bitmap to which you want to render. It also accepts an unsigned 32-bit integer that contains the code number of the character within the font table that you want to render. For English applications, this value will probably be a 7- or 8-bit ASCII code placed in the low-order bits of the integer (all other bits are set to zero). For international applications, this value will probably be a 16-bit Unicode number (or another standard).

When executed, DrawChar( ) renders the character block of the specified character into the bitmap using the pen position to set the upper left corner of the block, using the foreground pen color for the character bits, and using the background pen color for the the background bits. After execution, it resets the GrafCon's pen position by adding the width of the character just rendered to the pen's X coordinate. The call returns a zero if successful, and a negative number (an error code) if unsuccessful.

To place a string of 8-bit text, use this call:

```
int32 DrawText8(GrafCon *gcon, Item bitmapItem, uint8 *text)
```

It accepts a GrafCon and bitmap, and also accepts a pointer to a text string. The text string contains characters that are all defined in an 8-bit code such as ASCII, and are contained in memory one per byte. When the call executes, it renders the characters specified by the string into the bitmap, using the GrafCon's background and foreground pen colors. The upper left corner of the first character starts at the pen position stored in the GrafCon. When the string is rendered, the width of all the rendered characters is added to the X coordinate of the GrafCon's pen position.

Setting a Clipping Rectangle

Whenever the graphics folio projects cels or draws directly into a bitmap, it can write anywhere in the entire bitmap. If you wish to restrict cel projection and rendering to a subrectangle of the bitmap, you can do so with these calls:

```
int32 SetClipHeight(Item bitmapItem, ulong clipHeight)

int32 SetClipWidth(Item bitmapItem, ulong clipWidth)
```

The two calls together set the dimensions of a clipping rectangle within the specified bitmap. The first, SetClipHeight( ), sets the number of rows within the clipping rectangle; the second, SetClipWidth( ), sets the number of columns within the clipping rectangle. Each call accepts the item number of a bitmap within which you wish to set a clipping rectangle, and a 32-bit unsigned integer containing the appropriate rectangle dimension in pixels.

Note that if the height or width of the clipping rectangle is equal to or larger than the height or width of the bitmap, then there is no clipping in that direction. Note also that if one of the dimensions is set without the other, the unset dimension is set to the full width or height of the bitmap.

When executed, these two calls create a clipping rectangle within a bitmap. Any cel projections or bitmap renderings (including text) that fall outside of the rectangle are clipped, and aren't written to the bitmap. The calls both return zero if the call was successful, or a negative number (an error code) if unsuccessful.

When a clipping rectangle's dimensions are set, the clipping rectangle's upper left corner is located in the upper left corner of the bitmap. To set the clipping rectangle in a different location within the bitmap, use this call:

```
int32 SetClipOrigin(Item bitmapItem, Coord x, Coord y)
```

This call accepts the item number of the bitmap in which you want to move the clipping rectangle; it also accepts the X and Y coordinates of the point within that bitmap where you want to move the clipping rectangle's origin.

When SetClipOrigin( ) executes, it moves the clipping rectangle so that its origin falls on the specified point. It returns a zero if successful, or a negative number (an error code) if unsuccessful.

Note that if you move a clipping rectangle so that any of its boundaries fall beyond the bitmap boundaries, it is an error. It's wise, therefore, when you're reducing a clipping rectangle size to first set the height and width and then set the origin. If you're enlarging the clipping rectangle, you should first set the origin to a new (and safe location), and then set the height and width. And if you don't know what size the current clipping rectangle is or where it's located, you should first set the origin to 0, 0 then set the new height and width and only then reset the origin where you want it.

REFRESHING BACKGROUNDS WITH SPORT TRANSFERS

SPORT transfers take advantage of the high speed SPORT bus to copy one or more pages of VRAM to other pages of VRAM. Because a SPORT transfer always takes place during the vertical blank, it's a perfect method for refreshing a frame buffer background between cel projections. To set up background refreshment with SPORT, you must first know the set of VRAM pages used to store the bitmap (or bitmaps) you wish to refresh. You must then create and store a background image in a bitmap that won't be written into (it doesn't have to be part of a screen). Finally, you must make sure that all these bitmaps reside within the same VRAM bank so that SPORT will work among them. The tag args of the CreateScreenGroup( ) call can help you make sure that bitmaps are all allocated within the same bank.

Consider an example: A double-buffered screen group has two screens; each screen has a single bitmap. The two screen bitmaps are stored in the same bank of VRAM; each starts on a page boundary and takes nine and a half pages of VRAM. A third non-screen bitmap is created in nine and a half pages of VRAM. All the bitmaps reside in the same VRAM bank.

Now if you want to project moving cels on a static background—say, for example, crawling centipedes on a background of mushrooms—you store the mushroom background in the third bitmap. You then use a SPORT transfer to copy the mushroom background to the non-displayed screen in the screen group, which presents a clean background. You then project the centipede cels where they should be for that particular frame. When the screens are swapped for the next frame, you use SPORT to copy the clean background into the second screen, which is no longer displayed, and then project the centipede cels in a new position for the next frame. Each SPORT transfer removes projected cel images from the background so they won't linger into a later frame.

Because the SPORT bus is a device, all SPORT calls require an IOReq to communicate to the SPORT device. The graphics folio provides a convenience call to create a special IOReq for that purpose, which you can use in SPORT calls.

Creating an IOReq for the Sport Device

To create an IOReq to use with the SPORT device, use this call:

```
Item GetVRAMIOReq(void)
```

This call requires no argument and, when executed, creates an IOReq item for use with the SPORT bus. It returns the item number of that IOReq, which you should store for other SPORT calls. If unsuccessful, it returns a negative value (an error code).

Copying VRAM Pages

If your bitmaps are set up to fit within a known set of VRAM pages, you can use this call to copy the range of pages containing one bitmap into a second range of pages containing another bitmap:

```
Err CopyVRAMPages(item ioreq, void *dest, void *src, uint32
    humPages, uint32 mask)
```

The call accepts the item number of the SPORT IOReq, a pointer to the beginning address of the destination bitmap, a pointer to the beginning address of the destination bitmap, and the number of VRAM pages you wish to copy from the source to the destination. It also accepts a 32-bit mask.

When CopyVRAMPages( ) executes, it waits until the next vertical blank to read the specified number of VRAM pages starting at the source address, and then copies those pages into the same number of VRAM pages starting at the destination address. The 32-bit mask determines which pixels within the source are copied; it provides a pattern of 32 ones and zeros that is repeated and applied consecutively to rows of pixels in the source pages. Only pixels coinciding with a one in the mask are copied to the destination pages. Pixels coinciding with a zero in the mask aren't copied.

Note that the source and destination pointers you use will probably fall within a VRAM page and not directly on a page border. If so, CopyVRAMPages( ) automatically finds the starting page addresses of the pages you point to, and uses those addresses for copying VRAM pages.

Cloning a Single VRAM Page

It is useful sometimes to be able to clone a single VRAM page to many different destination pages. If, for example, a background bitmap contains a repeated pattern, there's no need to use many pages to store it—a single page can store the pattern, and it can be duplicated as many times as necessary to fill a full bitmap. To clone a single page, use this call:

```
Err CloneVRAMPages(Item ioreq, void *dest, void *src, uint32
    numPages, uint32 mask)
```

Like CopyVRAMPages( ), it accepts an ioreq item number and pointers to source and destination VRAM addresses (usually the beginnings of bitmaps). It also accepts the number of destination pages to which the single source page is cloned, and a 32-bit mask.

When CloneVRAMPages( ) executes, it waits for the next vertical blank to read the specified source VRAM page, apply the 32-bit mask to it, and then copy the results as many times as necessary to fill all the specified destination VRAM pages.

Setting VRAM Pages to a Single Color or Pattern

If a bitmap background is all one color, you can save quite a bit of VRAM by setting a single color value instead of creating a full backup bitmap or VRAM page. You then use FlashWrite to copy that value into full pages of VRAM with this call:

```
Err SetVRAMPages(Item ioreq, void *dest, int32 value, int32
    numpages, int32 mask)
```

The call accepts an ioreq item number. It also accepts a pointer to a VRAMdestination and the number of pages, staring at that destination, to which it will copy the color value. It accepts a 32-bit color value that is the 15-bit 3DO RGB color value with a sixteenth high-order bit of zero added, then duplicated to fill 32 bits. It also accepts a 32-bit mask that works here just as it does in the SPORT calls.

When SetVRAMPages( ) executes, it waits until the next vertical blank, and then copies the specified color value into the specified VRAM pages using the copy mask to determine which pixels in the source pages get the copied color value and which pixels do not.

To create the color value used with SetVRAMPages( ), use this call:

```
int32 MakeRGB15Pair(red, green, blue)
```

It accepts a red, green, and blue value, combines the low five bits of each value, to create a single 15 -bit RGB value, then duplicates it to create a 32-bit color value accepted by SetVRAMPages( ). It returns the 32-bit color value.

Deferred SPORT Calls

Two of the last SPORT calls—CopyVRAMPages( ) and CloneVRAMPages( )—all put the calling task in wait state while they execute, and only return the task to active state once the SPORT device has processed the IOReq and completed the operation. If you'd like to perform the same operations without waiting for the operation to complete (for asynchronous SPORT I/O), you can use "deferred" versions of the same calls:

```
Err CopyVRAMPagesDefer(Item ioreq, void *dest, void *src,
    uint32 numPages, uint32 mask)

Err CloneVRAMPagesDefer(Item ioreq, void *dest, void *src,
    uint32 numPages, uint32 mask)

Err SetVRAMPagesDefer(Item ioreq, void *dest, int32 value, int
    32 numpages, int32 mask)
```

These calls all accept the same arguments as their non-deferred counterparts, but don't put the calling task in wait state while they execute, so the task is free to continue execution while the SPORT device reads the IOReq and performs the requested operation.

(Note the SetVRAMPages( ) doesn't put its calling task in wait state, so it executes exactly the same as SetVRAM-PagesDefer( ), which is included only to make a complete set of deferred SPORT calls.

DISPLAY TIMING CALLS

If you have other task activities you want to coordinate with the frame display, you can use the timer device to inform the task when a vertical blank occurs. The task can enter wait state until it receives notice of the vertical blank, or it can continue while it waits.

Getting a VBL IOReq

To use VBL timing calls, a task must first have an IOReq to communicate with the timer. To get one, use this convenience call:

```
Item GetVBLIOReq(void)
```

It accepts no arguments, and when it executes, it creates an IOReq for the timer. It returns the item number of that IOReq if successful, or a negative value (an error code) if unsuccessful. Save the item number for use with the VBL timing calls.

Waiting For a VBL Frame

Once a task has a VBL IOReq, it can call on the timer to wait for a vertical blank. To do so, it uses this call:

```
Err WaitVBL(Item ioreq, uint32 numfields)
```

It accepts the item number of the VBL IOReq and the number of vertical blank fields the task should wait before becoming active again. It returns a zero if successful, and a negative value (an error code) if unsuccessful.

To allow a task to continue execution while the timer processes the IOReq sent to it, use this call:

```
Err WaitVBLDefer(Item ioreq, uint32 numfields)
```

It accepts the same arguments as WaitVBL( ), but— when executed—allows the task to continue execution while the IOReq is outstanding. If the task wants to be notified of the timing call's completion, it should use the WaitIO( ) call.

CONTROLLING PIXEL INTERPOLATION

The display generator, in its default state, practices full pixel interpolation for all 320×240 pixels it receives from a screen. If you'd like to turn off interpolation for the "crispy pixels" look within a screen, you can use these two calls:

```
int32 DisableHAVG(Item screenItem)

int32 DisableVAVG(Item screenItem)
```

The first call disables horizontal interpolation for the specified screen; the second call disables vertical interpolation for the specified screen. If either call is successful, it returns a zero. If unsuccessful, it returns a negative number (an error code).

To turn interpolation back on, use these two calls:

```
int32 EnableHAVG(Item screenItem)

int32 EnableVAVG(Item screenItem)
```

The first call enables horizontal interpolation for the specified screen; the second call enables vertical interpolation for the specified screen. If either call is successful, it returns a zero. If unsuccessful, it returns a negative number (an error code).

PRIMARY DATA STRUCTURES

The Graphics Context (GrafCon)Data Structure

```
/* Graphics Context structure */
typedef struct GrafCon
    {
    Node gc;
    Color gc_FGPen;
    Color gc_BGPen;
    Coord gc_PenX;
    Coord gc_PenY;
    ulong gc_Flags;
    } GrafCon;
```

The Rect Data Structure

```
typedef struct Rect
    {
    Coord rect_XLeft;
    Coord rect_YTop;
    Coord rect_XRight;
    Coord rect_YBottom;
    } Rect;
```

PROCEDURE CALLS

The following graphics folio calls control bitmaps, screens, and the display generator. They also write to bitmaps and frame buffers.

Screen Calls

```
Item CreateScreenGroup( item *screenItemArray,
    TagArg *tagArgs )
int32 AddScreenGroup( Item screenGroup, TagArg
    *targs )
int32 DisplayScreen( Item ScreenItem0, Item
    ScreenItem1 )
int32 MoveScreenGroup( Item screenGroup, Coord x,
    Coord y, level )
int32 RemoveScreenGroup( Item screenGroup )
```

VDL Calls

```
int32 SubmitVDL( VDLEntry *vdlDataPtr )
long ModifyVDL( item IVDL, long linenumber, long
    *Targs )
int32 Set VDL( Item screenItem, Item vdlItem )
```

-continued

PRIMARY DATA STRUCTURES

Screen Color Calls

```
int32 MakeCLUTColorEntry( index, red, green, blue )
int32 MakeCLUTRedEntry( index, red )
int32 MakeCLUTGreenEntry( index, blue )
int32 Make CLUTBlueEntry( index, blue )
int32 SetScreenColor( Item screenItem, int32
    colorEntry )
int32 SetScreenColors( Item screenItem, int32
    *entries, int32 count )
RGB888 ReadScreenColor( ulong index )
int32 ResetScreenColors( Item screenItem )
```

Drawing Calls

```
void SetFGPen( GrafCon *grafcon, Color color )
void SetBGPen( GrafCon *grafcon, Color color )
int32 MakeRGB15( red, green, blue )
void MoveTo( GrafCon *grafcon, Coord x, Coord y )
Item LocateBitmap( Item ScreenItem, long
    bitmapnumber )
int32 WritePixel ( Item bitmapItem, GrafCon *grafcon,
    Coord x, Coord y )
void DrawTo( Item bitmapItem, GrafCon *grafcon,
    Coord x, Coord y )
void FillRect( Item bitmapItem, GrafCon *grafcon,
    Coord x, Coord y )
Color ReadPixel( Item bitmapItem, GrafCon *grafcon,
    Coord x, Coord Y )
void *GetPixelAddress( Item screenItem, Coord x,
    Coord y )
```

Text Calls

```
void SetCurrentFont( Font *font )
void ResetCurrentFont( void )
Font *GetCurrentFont( void )
int32 DrawChar( GrafCon *gcon, Item bitmapItem,
    uint32 character )
int32 DrawText8( GrafCon *gcon, item bitmapItem,
    uint8 *text )
```

Clipping Calls

```
int32 SetClipHeight( Item bitmapItem, ulong
    clipHeight )
int32 SetClipWidth( Item bitmapItem, ulong
    clipWidth )
int32 SetClipOrigin( Item bitmapItem, Coord x,
    Coord y )
```

Bitmap Copying Calls

```
void CopyVRAMPages( void *dest, void *src, ulong
    numPages, ulong mask )
void CloneVRAMPages( void *dest, void *src, ulong
    numPages, ulong mask )
void SetVRAMPages( void *dest, ulong value, ulong
    numPages, ulong mask )
int32 MakeRGB15Pair( red, green, blue )
```

SlipStream and GenLock Calls

Display Timing Calls

```
void WaitVBL( )
```

Interpolation Calls

```
int32 DisableHAVG( Item screenItem )
int32 DisableVAVG( Item screenItem )
int32 EnableHAVG( Item screenItem )
int32 EnableVAVG( Item screenItem )
```

Source-Code Section

NOTICE: The below C language source code listings are subject to copyright claims with the exception of the waiver provided in the initial section of this document entitled "2a. Copyright Claims to Disclosed Code".

By way of introduction, the dot-h (.h) files are C language include files. The CreateScreenGroup( ) function creates a data structure called a screen group. A screen group is comprised of plural screens each having an item number attached to it. Each screen has one VDL and one or more bitmaps associated to it. A VDL includes a pointer to an image buffer that is to be displayed. A bitmap includes an independent pointer which is initially set to point to the same image buffer as the corresponding VDL. The bitmap pointer, together with height and width variables of the bitmap, defines the area into which the spryte engines will draw. The function Proof VDLEntry( ) proofs submitted, VDL's and returns an error code if there is a problem. The CreateScreenGroup( ) function links through an interface to another function internalCreateScreenGroup( ) which then links to realCreateScreenGroup to generate the VDL for each screen. Corresponding bitmaps are generated by internalCreateBitmap( ). The function internalCreateGrafItem( ) links the item numbers of the VDL and bitmaps to the item number of a common screen.

Oct 12 17:54 1993 ../uc/includes/hardware.h Page 1

```
/* ************************************************************************
 *
 * Opera Hardware Definitions Include File
 *
 * Copyright (C)       New Technologies Group, Inc.
 * Confidential and Proprietary  -  All Rights Reserved
 *
 * This file works with any tab space from 1 to 8.
 *
 * HISTORY
 * Date   Author            Description
 * ------ --------------- ---------------------------------------------
 * 930228 -RJ              Added SKIPX def's to cel preamble
 * 921204 -RJ Mical        Burst this file out of sherrie.h
 *
 * ********************************************************************** */

#ifndef __HARDWARE_H
#define __HARDWARE_H


/* === VDL DMA control === */
/* Bit fields 0xF8000000 are reserved */
#define VDL_640SC          0x04000000
#define VDL_DISPMOD_MASK   0x03800000
#define VDL_SLIPEN         0x00400000
#define VDL_ENVIDDMA       0x00200000
#define VDL_SLIPCOMMSEL    0x00100000
#define VDL_480RES         0x00080000
#define VDL_RELSEL         0x00040000
#define VDL_PREVSEL        0x00020000
#define VDL_LDCUR          0x00010000
#define VDL_LDPREV         0x00008000
#define VDL_LEN_MASK       0x00007E00
#define VDL_LINE_MASK      0x000001FF

#define VDL_LINE_SHIFT      0
#define VDL_LEN_SHIFT       9

#define VDL_LEN_PREFETCH    4

/* VDL_DISPMOD_MASK definitions */
#define VDL_DISPMOD_320    0x00000000
#define VDL_DISPMOD_384    0x00800000
#define VDL_DISPMOD_512    0x01000000
#define VDL_DISPMOD_640    0x01800000
#define VDL_DISPMOD_1024   0x02000000
#define VDL_DISPMOD_res5   0x02800000
#define VDL_DISPMOD_res6   0x03000000
#define VDL_DISPMOD_res7   0x03800000


/* === VDL Palette data === */
#define VDL_CONTROL      0x80000000
#define VDL_RGBCTL_MASK  0x60000000
#define VDL_PEN_MASK     0x1F000000
#define VDL_R_MASK       0x00FF0000
#define VDL_G_MASK       0x0000FF00
#define VDL_B_MASK       0x000000FF

#define VDL_B_SHIFT        0
#define VDL_G_SHIFT        8
#define VDL_R_SHIFT        16
#define VDL_PEN_SHIFT      24
#define VDL_RGBSEL_SHIFT   29

/* VDL_RGBCTL_MASK definitions */
#define VDL_FULLRGB      0x00000000
#define VDL_REDONLY      0x60000000
#define VDL_GREENONLY    0x40000000
#define VDL_BLUEONLY     0x20000000


/* === VDL display control word === */
#define VDL_DISPCTRL       0xC0000000
#define VDL_BACKGROUND     0x20000000
#define VDL_NULLAMY        0x10000000
#define VDL_PALSEL         0x08000000
#define VDL_S640SEL        0x04000000
#define VDL_CLUTBYPASSEN   0x02000000
#define VDL_SLPDCEL        0x01000000
```

```
#define VDL_FORCETRANS     0x00800000
#define VDL_BACKTRANS      0x00400000
#define VDL_WINSWAPHV      0x00200000
#define VDL_WINVSUB_MASK   0x00180000 /* See definitions below */
#define VDL_WINHSUB_MASK   0x00060000 /* See definitions below */
#define VDL_WINBLSB_MASK   0x00018000 /* See definitions below */
#define VDL_WINVINTEN      0x00004000
#define VDL_WINHINTEN      0x00002000
#define VDL_RANDOMEN       0x00001000
#define VDL_WINREPEN       0x00000800
#define VDL_SWAPHV         0x00000400
#define VDL_VSUB_MASK      0x00000300 /* See definitions below */
#define VDL_HSUB_MASK      0x000000C0 /* See definitions below */
#define VDL_BLSB_MASK      0x00000030 /* See definitions below */
#define VDL_VINTEN         0x00000008
#define VDL_HINTEN         0x00000004
#define VDL_COLORSONLY     0x00000002
#define VDL_ONEVINTDIS     0x00000001

/* VDL_BLSB_MASK definitions */
#define VDL_BLSB_NOP     0x00000030
#define VDL_BLSB_BLUE    0x00000020 /* Normal */
#define VDL_BLSB_GREEN   0x00000010
#define VDL_BLSB_ZERO    0x00000000

/* VDL_HSUB_MASK definitions */
#define VDL_HSUB_NOP     0x000000C0
#define VDL_HSUB_FRAME   0x00000080 /* Normal */
#define VDL_HSUB_ONE     0x00000040
#define VDL_HSUB_ZERO    0x00000000

/* VDL_VSUB_MASK definitions */
#define VDL_VSUB_NOP     0x00000300
#define VDL_VSUB_FRAME   0x00000200 /* Normal */
#define VDL_VSUB_ONE     0x00000100
#define VDL_VSUB_ZERO    0x00000000

/* VDL_WBLSB_MASK definitions */
#define VDL_WINBLSB_NOP     0x00018000
#define VDL_WINBLSB_BLUE    0x00010000 /* Normal */
#define VDL_WINBLSB_GREEN   0x00008000
#define VDL_WINBLSB_ZERO    0x00000000

/* VDL_HSUB_MASK definitions */
#define VDL_WINHSUB_NOP     0x00060000
#define VDL_WINHSUB_FRAME   0x00040000 /* Normal */
#define VDL_WINHSUB_ONE     0x00020000
#define VDL_WINHSUB_ZERO    0x00000000

/* VDL_VSUB_MASK definitions */
#define VDL_WINVSUB_NOP     0x00180000
#define VDL_WINVSUB_FRAME   0x00100000 /* Normal */
#define VDL_WINVSUB_ONE     0x00080000
#define VDL_WINVSUB_ZERO    0x00000000


/* --- AMY control word --- */
#define VDL_AMYCTRL  0x80000000


/* --- Special VDL 'NOP' --- */
#define VDL_NOP       0xE1000000
#define VDL_NULLVDL   VDL_NOP
#define VDL_AMY_NOP   VDL_AMYCTRL+0
#define VDL_AMYNULL   VDL_AMY_NOP


/* --- CCB control word flags --- */
#define CCB_
#define CCB_
#define CCB_
#define CCB_
#define CCB_
#define CCB_
#define CCB_
#define CCB_
#define CCB_
#define CCB_
#define CCB_
#define CCB_
#define CCB_
#define CCB_
#define CCB_
```

```
/* --- CECONTROL flags --- */
#define B15POS_MASK    0xC0000000
#define B0POS_MASK     0x30000000
#define SWAPHV         0x08000000
#define ASCALL         0x04000000
#define CECONTROL_u25  0x02000000
#define CFBDSUB        0x01000000
```

```
#define CFBDLSB_MASK   0x00C00000
#define PDCLSB_MASK    0x00300000

#define B15POS_SHIFT 30
#define B0POS_SHIFT  28
#define CFBD_SHIFT   22
#define PDCLSB_SHIFT 20

/* B15POS_MASK definitions */
#define B15POS_0     0x00000000
#define B15POS_1     0x40000000
#define B15POS_PDC   0xC0000000

/* B0POS_MASK definitions */
#define B0POS_0      0x00000000
#define B0POS_1      0x10000000
#define B0POS_PPMP   0x20000000
#define B0POS_PDC    0x30000000

/* CFBDLSB_MASK definitions */
#define CFBDLSB_0       0x00000000
#define CFBDLSB_CFBD0   0x00400000
#define CFBDLSB_CFBD4   0x00800000
#define CFBDLSB_CFBD5   0x00C00000

/* PDCLSB_MASK definitions */
#define PDCLSB_0      0x00000000
#define PDCLSB_PDC0   0x00100000
#define PDCLSB_PDC4   0x00200000
#define PDCLSB_PDC5   0x00300000


/* --- Packed cel data control tokens --- */
#define PACK_EOL           0x00000000
#define PACK_LITERAL       0x00000001
#define PACK_TRANSPARENT   0x00000002
#define PACK_PACKED        0x00000003
```

```
#define RMOD_160    (G2_RMOD128 | G1_RMOD32)
#define RMOD_256    (G1_RMOD256)
#define RMOD_320    (G1_RMOD256 | G2_RMOD64)
#define RMOD_384    (G1_RMOD256 | G2_RMOD128)
#define RMOD_512    (G1_RMOD512)
#define RMOD_576    (G1_RMOD512 | G2_RMOD64)
#define RMOD_640    (G1_RMOD512 | G2_RMOD128)
#define RMOD_1024   (G1_RMOD1024)
#define RMOD_1056   (G2_RMOD1024 | G1_RMOD32)
#define RMOD_1088   (G1_RMOD1024 | G2_RMOD64)
#define RMOD_1152   (G1_RMOD1024 | G2_RMOD128)
#define RMOD_1280   (G2_RMOD1024 | G1_RMOD256)
#define RMOD_1536   (G2_RMOD1024 | G1_RMOD512)
#define RMOD_2048   (G1_RMOD1024 | G2_RMOD1024)

#define WMOD_32     (G1_WMOD32)
#define WMOD_64     (G2_WMOD64)
#define WMOD_96     (G2_WMOD64 | G1_WMOD32)
#define WMOD_128    (G2_WMOD128)
#define WMOD_160    (G2_WMOD128 | G1_WMOD32)
#define WMOD_256    (G1_WMOD256)
#define WMOD_320    (G1_WMOD256 | G2_WMOD64)
#define WMOD_384    (G1_WMOD256 | G2_WMOD128)
#define WMOD_512    (G1_WMOD512)
#define WMOD_576    (G1_WMOD512 | G2_WMOD64)
#define WMOD_640    (G1_WMOD512 | G2_WMOD128)
#define WMOD_1024   (G1_WMOD1024)
#define WMOD_1056   (G2_WMOD1024 | G1_WMOD32)
#define WMOD_1088   (G1_WMOD1024 | G2_WMOD64)
#define WMOD_1152   (G1_WMOD1024 | G2_WMOD128)
#define WMOD_1280   (G2_WMOD1024 | G1_WMOD256)
#define WMOD_1536   (G2_WMOD1024 | G1_WMOD512)
#define WMOD_2048   (G1_WMOD1024 | G2_WMOD1024)

/* --- REGCTL1 --- */
#define REG_XCLIP_MASK  0x000007FF
#define REG_YCLIP_MASK  0x07FF0000

#define REG_XCLIP_SHIFT  0
#define REG_YCLIP_SHIFT  16
```

```
/* --- VCNT --- */
#define VCNT_MASK    0x000007FF
#define VCNT_FIELD   0x00000800

#define VCNT_SHIFT        0
#define VCNT_FIELD_SHIFT  11
```

Oct 12 17:54 1993 ../uc/includes/hardware.h Page 3

```
/* --- JOYSTICK/JOYSTICK1 flags --- */
#define JOYSTART
#define JOYFIREC
#define JOYFIREA
#define JOYFIREB
#define JOYDOWN
#define JOYUP
#define JOYRIGHT
#define JOYLEFT

#define JOYSELECT JOYFIREC

#define JOYMOVE      (JOYLEFT+JOYRIGHT+JOYUP+JOYDOWN)
#define JOYBUTTONS   (JOYFIREA+JOYFIREB+JOYFIREC+JOYSTART)


/* --- Finally, a kernel call that uses the hardware (?) --- */
uint32 __swi(KERNELSWI+17) ReadHardwareRandomNumber(void);


#endif /* of #ifdef __HARDWARE_H */
```

```
/* === REGCTL0 === */
#define G1_RMOD_MASK  0x0000000F
#define G2_RMOD_MASK  0x000000F0
#define G1_WMOD_MASK  0x00000F00
#define G2_WMOD_MASK  0x0000F000
#define RMOD_MASK     (G1_RMOD_MASK|G2_RMOD_MASK)
#define WMOD_MASK     (G1_WMOD_MASK|G2_WMOD_MASK)
#define RMOD_SHIFT    0
#define WMOD_SHIFT    8

#define G1_RMOD32     0x00000001
#define G1_RMOD512    0x00000002
#define G1_RMOD256    0x00000004
#define G1_RMOD1024   0x00000008
#define G2_RMOD64     0x00000010
#define G2_RMOD128    0x00000020
#define G2_RMODu6     0x00000040
#define G2_RMOD1024   0x00000080
#define G1_WMOD32     0x00000100
#define G1_WMOD512    0x00000200
#define G1_WMOD256    0x00000400
#define G1_WMOD1024   0x00000800
#define G2_WMOD64     0x00001000
#define G2_WMOD128    0x00002000
#define G2_WMODuE     0x00004000
#define G2_WMOD1024   0x00008000

#define RMOD_32     (G1_RMOD32)
#define RMOD_64     (G2_RMOD64)
#define RMOD_96     (G2_RMOD64 | G1_RMOD32)
#define RMOD_128    (G2_RMOD128)
```

```
#pragma force_top_level
#pragma include_only_once

/* ************************************************************************
 *
 * Graphics Include File
 *
 * Copyright (C)       New Technologies Group, Inc.
 * NTG Trade Secrets  -  Confidential and Proprietary
 *
 * The contents of this file were designed with any tab stops from 1 to 8
 *
 * DATE   NAME              DESCRIPTION
 * ------ ---------------- ------------------------------------------------
 * 930830 SHL               Split CreateBitmap out of CreateScreenGroup
 * 930729 SHL               Removed all reference to file base font stuff
 * 930726 SHL               Made graphics more paranoid about Items
 *                          not owned by the current task
 * 930708 SHL               Commented out stale elements of GrafFolio struct
 * 930630 SHL               Changed all SWI calls to use in-line SWIs
 * 930421 JCR               Changed Screen struct.
 * 930315 -RJ               Macro name changes
 * 930210 -RJ               Merged vdl.h into this file
 * 930102 -RJ               Changed DEFAULT_DISPCTRL to set HSUB and VSUB
 *                          flags to default to zero
 * 921212 -RJ               Added font data structures
 * 921104 -RJ               Added scr_BitmapCount, started toying with idea
 *                          of BitmapInfo and ScreenInfo structures
 * 921031 -RJ               Changed rect_YBot to rect_YBottom
 * 921028 -RJ               Changed some CCB fields to follow name convention
 * 921016 -RJ               Ongoing massive overhauls for graphics
 *                          restructuring  -  everything is different
 * 921015 -RJ               __SHERRIE must be defined for sherrie.h to be
 *                          included, else hardware.h will be included.
 * 920724 -RJ Mical         Start overhaul
 * 920717 Stephen Landrum   Last edits before July handoff
 *
 * ********************************************************************** */


#ifndef __GRAPHICS_H
#define __GRAPHICS_H


#include "types.h"
#include "nodes.h"
#include "folio.h"
#include "item.h"
#include "list.h"
#include "operror.h"
#include "timer.h"

#include "filesystem.h"
#include "filesystemdefs.h"
#include "filefunctions.h"
#include "filestream.h"
#include "filestreamfunctions.h"

#include "hardware.h"



/* ===  =========  ===================================================== */
/* ===             ===================================================== */
/* ===  Constants  ===================================================== */
/* ===             ===================================================== */
/* ===  =========  ===================================================== */


/* Hard coded numbers for the graphics folio SWI functions */
#define GRAPHICSFOLIO   2
#define GRAFSWI         (GRAPHICSFOLIO<<16)


/* These represent the value one (1) in various number formats.
 * For example, ONE_12_20 is the value of 1 in fixed decimal format
 * of 12 bits integer, 20 bits fraction
 */
#define ONE_12_20  (1<<20)
```

```
#define ONE_16_16  (1<<16)

/* --- Some typical PPMP modes --- */
#define PPMP_MODE_NORMAL   0x01F40L
#define PPMP_MODE_AVERAGE  0x01F81L

/* When setting up your own VDL, this constant defines a reasonable
 * starting value for your display control word
 * The display control word in the system's pre-display VDL uses this
 * constant, so the values here are what your screen will inherit
 * unless (until) you specify your own display control word.
 */
#define DEFAULT_DISPCTRL (VDL_DISPCTRL\
                          |VDL_HINTEN|VDL_VINTEN\
                          |VDL_BLSB_BLUE|VDL_HSUB_ZERO|VDL_VSUB_ZERO\
                          |VDL_WINBLSB_BLUE|VDL_WINHSUB_ZERO|VDL_WINVSUB_ZERO\
                          )

/* These are the types of VDL's that can exist in the system */
#define VDLTYPE_FULL     1
#define VDLTYPE_COLOR    2
#define VDLTYPE_ADDRESS  3
#define VDLTYPE_SIMPLE   4
#define VDLTYPE_DYNAMIC  5

/* These are the type arguments for the tag args that can be used to create
 * a screen group.
 */
#define CSG_TAG_DONE                 0
#define CSG_TAG_DISPLAYHEIGHT        1
#define CSG_TAG_SCREENCOUNT          2
#define CSG_TAG_SCREENHEIGHT         3
#define CSG_TAG_BITMAPCOUNT          4
#define CSG_TAG_BITMAPWIDTH_ARRAY    5
#define CSG_TAG_BITMAPHEIGHT_ARRAY   6
#define CSG_TAG_BITMAPBUF_ARRAY      7
#define CSG_TAG_VDLTYPE              8
#define CSG_TAG_VDLPTR_ARRAY         9
#define CSG_TAG_VDLLENGTH_ARRAY     10 /* JCR */
#define CSG_TAG_SPORTBITS           11

/* These are the type arguments for the tag args that can be used to create
 * a bitmap.
 */
#define CBM_TAG_DONE            0
#define CBM_TAG_WIDTH           11
#define CBM_TAG_HEIGHT          12
#define CBM_TAG_BUFFER          13
#define CBM_TAG_CLIPWIDTH       14
#define CBM_TAG_CLIPHEIGHT      15
#define CBM_TAG_CLIPX           16
#define CBM_TAG_CLIPY           17
#define CBM_TAG_WATCHDOGCTR     18
#define CBM_TAG_CECONTROL       19

/* NOTE: THESE OFFSETS MUST CORROSPOND TO SPORTCmdTable IN sportdev.c */
#define SPORTCMD_CLONE  4
#define SPORTCMD_COPY   5
#define FLASHWRITE_CMD  6

/* --- Node and Item type numbers for graphics folio -- */
#define NODE_GRAPHICS   2

/* These are the graphics folio's item types */
#define TYPE_SCREENGROUP  1
#define TYPE_SCREEN       2
#define TYPE_BITMAP       3
#define TYPE_VDL          4

/* The default CE watch dog time out vertical blank counter */
#define WATCHDOG_DEFAULT        1000000

/* The default value in the Bitmap structure CEControl register */
#define CECONTROL_DEFAULT       (B15POS_PDC|B0POS_PPMP|CFBDSUB|CFBDLSB_CFBD0|PDCLSB_PDC0)
```

```
/* ===  ======  ================================================================ */
/* ===          ================================================================ */
/* ===  Macros  ================================================================ */
/* ===          ================================================================ */
/* ===  ======  ================================================================ */

/* This macro allows you to turn the absolute address of an object into
 * the sort of relative address needed by the cel engine.  The first
 * argument is the absolute address of the field to receive the relative
 * address, and the second argument is the absolute address of the object
 * to be referenced.
 *   For instance, to create a relative pointer to a "next cel" you
 * would use these arguments:
 *      MakeCCBRelative( &cel->ccb_NextPtr, &NextCel );
 * To make sure your cel indicates it has a relative pointer to the next
 * cel, you might want to explicitly clear the control flag:
 *      ClearFlag( cel->ccb_Flags, CCB_NPABS );
 */
#define MakeCCBRelative(field,linkobject) ((int32)(linkobject)-(int32)(field)-4)

#define MakeRGB15(a,b,c) (((a)<<10)|((b)<<5)|(c))
#define MakeRGB15Pair(a,b,c) (MakeRGB15(a,b,c)*0x00010001)

#define MakeCLUTColorEntry(index,r,g,b) ((((uint32)(index)<<24)|VDL_FULLRGB\
                        |((uint32)(r)<<16)|((uint32)(g)<<8)|((uint32)(b))))
#define MakeCLUTRedEntry(index,r) ((((uint32)(index)<<24)|VDL_REDONLY\
                        |((uint32)(r)<<16)))
#define MakeCLUTGreenEntry(index,g) ((((uint32)(index)<<24)|VDL_GREENONLY\
                        |((uint32)(g)<<8)))
#define MakeCLUTBlueEntry(index,b) ((((uint32)(index)<<24)|VDL_BLUEONLY\
                        |((uint32)(b)<<0)))
#define MakeCLUTBackgroundEntry(r,g,b) ((VDL_DISPCTRL|VDL_BACKGROUND\
                        |((uint32)(r)<<16)|((uint32)(g)<<8)|((uint32)(b))))

//#define WaitVBLCount(n) {int32 i; for(i=(n);i>0;i--) WaitVBL();}
//#define WaitVBLNumber(n) {while(GrafBase->gf_VBLNumber<n) WaitVBL();}


/* === RJ's Idiosyncracies === */
#define NOT !
#define FOREVER for(;;)
#define SetFlag(v,f) ((v)|=(f))
#define ClearFlag(v,f) ((v)&=~(f))
#define FlagIsSet(v,f) ((bool)(((v)&(f))!=0))
#define FlagIsClear(v,f) ((bool)(((v)&(f))==0))


/* ===  ==============  ============================================== */
/* ===                  ============================================== */
/* ===  Data Structures ============================================== */
/* ===                  ============================================== */
/* ===  ==============  ============================================== */

typedef int32 VDLEntry;

typedef int32  Color;
typedef int32  Coord;
typedef int32  RGB888;
typedef ubyte CharMap;


/* temporary definition of cel data structure */
typedef uint32 CelData[];


/* Here's the new font data structures */
typedef struct FontEntry
        {
        Node     ft;
        int32   ft_CharValue;
        int32   ft_Width;
        CelData *ft_Image;
        int32    ft_ImageByteCount;

        struct FontEntry *ft_LesserBranch;
        struct FontEntry *ft_GreaterBranch;
        } FontEntry;
```

```
typedef struct ScreenGroup {
  ItemNode sg;

  /* display location, 0 == top of screen */
  int32 sg_Y;

  /* total height of each screen */
  int32 sg_ScreenHeight;

  /* display height of each screen (can be less than the screen's
   * actual height)
   */
  int32 sg_DisplayHeight;

  /* list of tasks that have shared access to this ScreenGroup */
  List sg_SharedList;

  /* Flag verifying that user has called AddScreenGroup() */
  /* Just a temp solution for now (4-21-93) */
  int32 sg_Add_SG_Called;

  List sg_ScreenList;
} ScreenGroup;


typedef struct Bitmap {
  ItemNode bm;

  ubyte *bm_Buffer;

  int32 bm_Width;
  int32 bm_Height;
  int32 bm_VerticalOffset;
  int32 bm_Flags;

  int32 bm_ClipWidth;
  int32 bm_ClipHeight;
  int32 bm_ClipX;
  int32 bm_ClipY;
  int32 bm_WatchDogCtr;  /* JCR */
  int32 bm_SysMalloc;  /* If set, CreateScreenGroup MALLOCED for bm. JCR */

  /* List of tasks that have share access to this Bitmap */
  List bm_SharedList;

  int32 bm_CEControl;
  int32 bm_REGCTL0;
  int32 bm_REGCTL1;
  int32 bm_REGCTL2;
  int32 bm_REGCTL3;
} Bitmap;

/* VDLVDL */
typedef struct VDL
        {
        ItemNode vdl;  /* link VDL's in screen lists */
        struct Screen   *vdl_ScreenPtr;
        VDLEntry *vdl_DataPtr; /* addr of concatenation of VDLEntries*/
        int32    vdl_Type;
        int32    vdl_DataSize;  /* length of concat */
        } VDL;

/* JCR */
typedef struct Screen
        {
        ItemNode scr;

        ScreenGroup *scr_ScreenGroupPtr;

        VDL       *scr_VDLPtr;
        Item      scr_VDLItem; /* Item # for above VDL */
        int32     scr_VDLType;

        int32 scr_BitmapCount;
        List  scr_BitmapList;

        List scr_SharedList;
Bitmap *scr_TempBitmap;
        } Screen;
```

```
/* ??? The BitmapInfo and ScreenInfo stuff is under construction.
 * ??? I'm thinking about it ... I'm workin' on it, I'm workin' on it!
 */
typedef struct BitmapInfo
        {
        Item    bi_Item;
        Bitmap *bi_Bitmap;
        ubyte  *bi_Buffer;
        } BitmapInfo;

/* The ScreenInfo structure contains critical information about a
 * screen and all its associated data structures.
 *
 * The ScreenInfo ends with an instance of the BitmapInfo structure.
 * In actuality, there can be any number of BitmapInfo structures at the
 * end of the ScreenInfo structure.  In the simple case, which almost
 * everyone will use, a screen will be comprised of a single bitmap.
 * To simplify references to the ScreenInfo fields, the ScreenInfo
 * structure is defined as having a single instance of a BitmapInfo
 * structure.  Furthermore, to simplify allocation of and referencing to
 * ScreenInfo structures with more than a single bitmap, the ScreenInfo2
 * and ScreenInfo3 structures are defined to describe screens that have
 * two and three bitmaps.  These are defined for your convenience.
 *
 * The InitScreenInfo() call presumes that your ScreenInfo argument
 * points to a ScreenInfo structure with the correct number of BitmapInfo
 * fields at the end of it.
 *
 * Hmm:
 *   ScreenInfo ScreenInfos[2];
 *   ScreenInfo *ScreenInfoPtrs[2] = {&ScreenInfos[0], &ScreenInfos[1]};
 *   CreateScreenGroup( ScreenInfoPtrs, TagArgs );
 *   DrawCels( ScreenInfos[ScreenSelect].si_BitmapInfo.bi_Item, &Cel );
 *   DisplayScreen( ScreenInfos[ScreenSelect].si_Item, 0 );
 *   ScreenSelect = 1 - ScreenSelect;
 */
typedef struct ScreenInfo
        {
        Item       si_Item;
        Screen    *si_Screen;
        BitmapInfo si_BitmapInfo;
        } ScreenInfo;

typedef struct Point
        {
        Coord pt_X;
        Coord pt_Y;
        } Point;


typedef struct Rect
        {
        Coord rect_XLeft;
        Coord rect_YTop;
        Coord rect_XRight;
        Coord rect_YBottom;
        } Rect;


/* Graphics Context structure */
typedef struct GrafCon
        {
        Node  gc;
        Color gc_FGPen;
        Color gc_BGPen;
        Coord gc_PenX;
        Coord gc_PenY;
        uint32 gc_Flags;
        } GrafCon;


/* temporary definition of cel control block */
typedef struct CCB
        {
        uint32 ccb_Flags;

        struct CCB *ccb_NextPtr;
        CelData    *ccb_SourcePtr;
        void       *ccb_PLUTPtr;
```

```
        Coord ccb_XPos;
        Coord ccb_YPos;
        int32  ccb_HDX;
        int32  ccb_HDY;
        int32  ccb_VDX;
        int32  ccb_VDY;
        int32  ccb_HDDX;
        int32  ccb_HDDY;
        uint32 ccb_PIXC;
        uint32 ccb_PRE0;
        uint32 ccb_PRE1;

        /* These are special fields, tacked on to support some of the
         * rendering functions.
         */
        int32  ccb_Width;
        int32  ccb_Height;
        } CCB;


/* These are temporary definitions of the data structures the text
 * rendering routines will require.  All of this is probably going to
 * change dramatically when the real stuff comes online
 */

/* The FontChar structure defines the image for a single character
 * The text value of the character is defined with an int32 to allow
 * either 8-bit or 16-bit text character definitions.
 */
typedef struct FontChar
        {
        uint32   fc_CharValue;
        uint8    fc_Width;
        CelData *fc_Image;
        } FontChar;

/* The Font definition provides a font to be used with the text rendering
 * routines.  It defines a mapping from text characters to their images
 * by pointing to an array of FontChar definitions.  It also allows
 * the programmer to control the appearance of the rendered text imagery
 * by providing for a CCB to be used when printing the characters,
 * allowing the programmer to control both the CCB's Flags field and the
 * PPMP value.
 *
 * The PPMP value will come from the GrafCon supplied to the DrawChar()
 * call, as soon as I define a PPMP field in the GrafCon.
 */
typedef struct Font
        {
        uint8      font_Height;
        uint8      font_Flags;
        CCB       *font_CCB;

        /* The font_FontEntries field is significant only with RAM-resident fonts */
        FontEntry *font_FontEntries;
        } Font;
/* === font_Flags definitions === */
#define FONT_ASCII            0x01 /* This is an ASCII font */
#define FONT_ASCII_UPPERCASE  0x02 /* Lowercase will be translated to upper */
#define FONT_FILEBASED        0x04 /* Font is file-based (not RAM-resident */
#define FONT_VERTICAL         0x08 /* Font rendered vertically */

typedef struct GrafFolio
        {
        Folio gf;

        uint32 gf_Flags;

        volatile uint32 gf_VBLNumber;

        void *gf_ZeroPage;
        void *gf_VIRSPage;

        uint32 gf_VRAMPageSize;
        int32 gf_DefaultDisplayWidth;
        int32 gf_DefaultDisplayHeight;

        Timer *gf_TimeoutTimer;

        int32   gf_Reserved5;
        int32   gf_Reserved6;
        int32   gf_Reserved7;
```

```
        VDLEntry *gf_VDLForcedFirst;
        VDLEntry *gf_VDLPreDisplay;
        VDLEntry *gf_VDLPostDisplay;
        VDLEntry *gf_VDLBlank;
        VDLEntry *gf_CurrentVDLEven;
        VDLEntry *gf_CurrentVDLOdd;
        VDLEntry *gf_VDLDisplayLink;

        int32   gf_Reserved1;
        int32   gf_Reserved3;

        Item    gf_CelSemaphore;        /* who has the Cel Engine? */

        int32   gf_VBLTime;             /* number of usec between VBLs */
        int32   gf_VBLFreq;             /* approximate VBL frequency in Hz */

        int32   gf_Reserved2;

        Stream   *gf_CurrentFontStream;
        int32     gf_FileFontCacheSize;
        int32     gf_FileFontCacheAlloc;
        ubyte    *gf_FileFontCache;
        FontEntry *gf_FontEntryHead;
        FontEntry *gf_FontEntryButt;
        List      gf_FontLRUList;
        int32     gf_FileFontFlags;
        int32     gf_FontBaseChar;
        int32     gf_FontMaxChar;
        Font     *gf_CurrentFont;
        int32     gf_CharArrayOffset;
        int32   gf_fileFontCacheUsed;

        } GrafFolio;

/* === gf_Flags bits === */
/* none defined just now */


/* ===  ----------------  ------------------------------------------- */
/* ===                    ------------------------------------------- */
/* ===  Error Definitions ------------------------------------------- */
/* ===                    ------------------------------------------- */
/* ===  ----------------  ------------------------------------------- */

#define GRAFERR_BADTAG          MAKEGERR(ER_SEVERE,ER_C_STND,ER_BadTagArg)
#define GRAFERR_BADTAGVAL       MAKEGERR(ER_SEVERE,ER_C_STND,ER_BadTagArgVal)
#define GRAFERR_BADPRIV         MAKEGERR(ER_SEVERE,ER_C_STND,ER_NotPrivileged)
#define GRAFERR_BADSUBTYPE      MAKEGERR(ER_SEVERE,ER_C_STND,ER_BadSubType)
#define GRAFERR_BADITEM         MAKEGERR(ER_SEVERE,ER_C_STND,ER_BadItem)
#define GRAFERR_NOMEM           MAKEGERR(ER_SEVERE,ER_C_STND,ER_NoMem)
#define GRAFERR_BADPTR          MAKEGERR(ER_SEVERE,ER_C_STND,ER_BadPtr)
#define GRAFERR_NOTOWNER        MAKEGERR(ER_SEVERE,ER_C_STND,ER_NotOwner)

#define GRAFERR_BASE (20)
#define GRAFERR_CELTIMEOUT      MAKEGERR(ER_SEVERE,ER_C_NSTND,GRAFERR_BASE+0)
#define GRAFERR_BADCLIP         MAKEGERR(ER_SEVERE,ER_C_NSTND,GRAFERR_BASE+1)
#define GRAFERR_BADVDLTYPE      MAKEGERR(ER_SEVERE,ER_C_NSTND,GRAFERR_BASE+2)
#define GRAFERR_INDEXRANGE      MAKEGERR(ER_SEVERE,ER_C_NSTND,GRAFERR_BASE+3)
#define GRAFERR_BUFWIDTH        MAKEGERR(ER_SEVERE,ER_C_NSTND,GRAFERR_BASE+4)
#define GRAFERR_COORDRANGE      MAKEGERR(ER_SEVERE,ER_C_NSTND,GRAFERR_BASE+5)
#define GRAFERR_VDLWIDTH        MAKEGERR(ER_SEVERE,ER_C_NSTND,GRAFERR_BASE+6)
#define GRAFERR_NOTYET          MAKEGERR(ER_SEVERE,ER_C_NSTND,GRAFERR_BASE+7)
#define GRAFERR_MIXEDSCREENS    MAKEGERR(ER_SEVERE,ER_C_NSTND,GRAFERR_BASE+8)
#define GRAFERR_BADFONTFILE     MAKEGERR(ER_SEVERE,ER_C_NSTND,GRAFERR_BASE+9)
#define GRAFERR_BADDEADBOLT     MAKEGERR(ER_SEVERE,ER_C_NSTND,GRAFERR_BASE+10)
#define GRAFERR_VDLINUSE        MAKEGERR(ER_SEVERE,ER_C_NSTND,GRAFERR_BASE+11)
#define GRAFERR_PROOF_ERR       MAKEGERR(ER_SEVERE,ER_C_NSTND,GRAFERR_BASE+12)
#define GRAFERR_VDL_LENGTH      MAKEGERR(ER_SEVERE,ER_C_NSTND,GRAFERR_BASE+13)
#define GRAFERR_NO_FONT         MAKEGERR(ER_SEVERE,ER_C_NSTND,GRAFERR_BASE+14)
#define GRAFERR_BADDISPDIMS     MAKEGERR(ER_SEVERE,ER_C_NSTND,GRAFERR_BASE+15)
#define GRAFERR_BADBITMAPSPEC   MAKEGERR(ER_SEVERE,ER_C_NSTND,GRAFERR_BASE+16)
#define GRAFERR_INTERNALERROR   MAKEGERR(ER_SEVERE,ER_C_NSTND,GRAFERR_BASE+17)
#define GRAFERR_SGINUSE         MAKEGERR(ER_SEVERE,ER_C_NSTND,GRAFERR_BASE+18)
#define GRAFERR_SGNOTINUSE      MAKEGERR(ER_SEVERE,ER_C_NSTND,GRAFERR_BASE+19)
#define GRAFERR_GRAFNOTOPEN     MAKEGERR(ER_SEVERE,ER_C_NSTND,GRAFERR_BASE+20)
#define GRAFERR_NOWRITEACCESS   MAKEGERR(ER_SEVERE,ER_C_NSTND,GRAFERR_BASE+21)
```

```
/* ---  ------------------------------  ------------------------------ */
/* ---                                  ------------------------------ */
/* ---  Externs and Function Prototypes ------------------------------ */
/* ---                                  ------------------------------ */
/* ---  ------------------------------  ------------------------------ */

extern GrafFolio *GrafBase;
extern Item GrafFolioNum;

/* routine numbers for user mode folio calls */
#define _SETCEWATCHDOG_ -45
#define _DRAWSCREENCELS_        -44
#define _DRAWCELS_      -43
#define _SUBMITVDL_     -42
#define _SETVDL_        -41
#define _DISPLAYSCREEN_ -40
//
#define _SETCECONTROL_  -38
#define _DRAWTEXT8_     -37
#define _GETCURRENTFONT_        -36
#define _SETCURRENTFONTCCB_     -35
#define _FILLRECT_      -34
#define _DRAWTO_        -33
#define _DRAWCHAR_      -32

#define _MOVETO_        -30
#define _SETCLIPHEIGHT_ -29
#define _SETCLIPWIDTH_  -28
#define _REMOVESCREENGROUP_     -27
#define _ADDSCREENGROUP_        -26
#define _SETBGPEN_      -25
#define _SETFGPEN_      -24
#define _DELETESCREENGROUP_     -23
#define _SETSCREENCOLORS_       -22
#define _RESETSCREENCOLORS_     -21
#define _SETSCREENCOLOR_        -20
#define _DISABLEHAVG_   -19
#define _ENABLEHAVG_    -18
#define _DISABLEVAVG_   -17
#define _ENABLEVAVG_    -16
#define _SETCLIPORIGIN_ -15
#define _RESETREADADDRESS_      -14
#define _SETREADADDRESS_        -13

#define _CREATESCREENGROUP_     -12
#define _RESETFONT_     -11
//#define _CLOSEFONT_   -10
#define _DRAWTEXT16_    -9
//#define _OPENFILEFONT_        -8
//#define _OPENRAMFONT_ -7
//#define _SETFILEFONTCACHESIZE_        -6
#define _WRITEPIXEL_    -5
#define _GETPIXELADDRESS_       -4
#define _READVDLCOLOR_  -3
#define _READPIXEL_     -2
#define _MAPSPRITE_     -1


#ifdef _GRAPHICS_INTERNAL
#define __swi(x)
#endif


int32 AddScreenGroup( Item screenGroup, TagArg *targs );
//int32 CloseFont( void );
#define CreateBitmap(x) CreateItem(MKNODEID(NODE_GRAPHICS,TYPE_BITMAP),x)
Item CreateScreenGroup( Item *screenItemArray, TagArg *targs );
Err DeleteScreenGroup (Item ScreenGroupItem);
#define DeleteVDL(x) DeleteItem(x)
Err DisableHAVG( Item screenItem );
Err DisableVAVG( Item screenItem );
Err DisplayScreen( Item screenItem0, Item screenItem1 );
Err DrawCels( Item bitmapItem, CCB *ccb );
Err DrawChar( GrafCon *gcon, Item bitmapItem, uint32 character );
Err DrawScreenCels( Item screenItem, CCB *ccb );
Err DrawText16( GrafCon *gcon, Item bitmapItem, uint16 *text );
Err DrawText8( GrafCon *gcon, Item bitmapItem, uint8 *text );
Err DrawTo( Item bitmapItem, GrafCon *grafcon, Coord x, Coord y );
Err EnableHAVG( Item screenItem );
Err EnableVAVG( Item screenItem );
Err FillRect( Item bitmapItem, GrafCon *gc, Rect *r );
```

```
Font *GetCurrentFont( void );
void *GetPixelAddress( Item screenItem, Coord x, Coord y );
void  MapCel( CCB *ccb, Point *quad );
void  MoveTo( GrafCon *gc, Coord x, Coord y );
//int32 OpenFileFont( char *filename );
Err OpenGraphicsFolio( void );
//int32 OpenRAMFont( Font *font );
RGB888 ReadCLUTColor( uint32 index );
Color ReadPixel( Item bitmapItem, GrafCon *gc, Coord x, Coord y );
Err RemoveScreenGroup( Item screenGroup );
Err ResetCurrentFont( void );
Err ResetReadAddress( Item bitmapItem );
Err ResetScreenColors( Item screenItem );
void  SetBGPen( GrafCon *gc, Color c );
Err SetCEControl( Item bitmapItem, int32 controlWord, int32 controlMask );
Err SetCEWatchDog( Item bitmapItem, int32 db_ctr );
Err SetClipHeight( Item bitmapItem, int32 clipHeight );
Err SetClipOrigin( Item bitmapItem, int32 x, int32 y );
Err SetClipWidth( Item bitmapItem, int32 clipWidth );
Err SetCurrentFontCCB( CCB *ccb );
void  SetFGPen( GrafCon *gc, Color c );
//int32 SetFileFontCacheSize( int32 size );
Err SetReadAddress( Item bitmapItem, ubyte *buffer, int32 width );
Err SetScreenColor( Item screenItem, uint32 colorentry );
Err SetScreenColors( Item screenItem, uint32 *entries, int32 count );
Err SetVDL( Item screenItem, Item vdlItem );
Item  SubmitVDL( VDLEntry *VDLDataPtr, int32 length, int32 type );
Err WritePixel( Item bitmapItem, GrafCon *gc, Coord x, Coord y );

Item GetVRAMIOReq (void);
Err SetVRAMPages (Item ioreq, void *dest, int32 val, int32 numpages, int32 mask);
Err CopyVRAMPages (Item ioreq, void *dest, void *src, uint32 numpages, uint32 mask);
Err CloneVRAMPages (Item ioreq, void *dest, void *src, uint32 numpages, uint32 mask);
Err SetVRAMPagesDefer (Item ioreq, void *dest, int32 val, int32 numpages, int32 mask);
Err CopyVRAMPagesDefer (Item ioreq, void *dest, void *src, uint32 numpages, uint32 mask);
Err CloneVRAMPagesDefer (Item ioreq, void *dest, void *src, uint32 numpages, uint32 mask);

Item GetVBLIOReq (void);
Err WaitVBL (Item ioreq, uint32 numfields);
Err WaitVBLDefer (Item ioreq, uint32 numfields);

#ifdef _GRAPHICS_INTERNAL
#undef __swi
#endif


#endif  /* of #define __GRAPHICS_H */
```

Oct 28 12:04 1993 includes/intgraf.h Page 1

```
#pragma force_top_level
#pragma include_only_once

/* ************************************************************************
 *
 * Internal Graphics Include File
 *
 * Copyright (C)        New Technologies Group, Inc.
 * NTG Trade Secrets  -  Confidential and Proprietary
 *
 * The contents of this file were designed with tab stops of 4 in mind
 *
 * DATE   NAME              DESCRIPTION
 * ------ ---------------- ----------------------------------------------
 * 920724 -RJ Mical        Start overhaul
 * 920717 Stephen Landrum  Last edits before July handoff
 *
 * ********************************************************************** */


#ifndef __INTGRAF_H
#define __INTGRAF_H


#define _GRAPHICS_INTERNAL

#include "types.h"
#include "nodes.h"
#include "folio.h"
#include "item.h"
#include "list.h"
#include "driver.h"
#include "device.h"
#include "io.h"

#include "super.h"

#include "graphics.h"

#include "inthard.h"

extern Err ItemOpened (Item, Item);


/* Internal switches for compilation mode */
#define _MODE_developer 0
#define _MODE_runtime   1


#if (MODE==_MODE_developer)
void printnotowner (Item it, Item t);
#define PRINTNOTOWNER(x,y) printnotowner(x,y)
#define DEVBUG(x) Superkprintf x
#else
#define PRINTNOTOWNER(x,y) /* printnotowner(x,y) */
#define DEVBUG(x) /* Superkprintf x */
#endif


/* there's 10 altogether */
/*???#define DEBUG(x) { kprintf x; }*/
#define DEBUG(x) {}
/*??? #define SDEBUG(x)   { Superkprintf x; }*/
#define SDEBUG(x)   {}
/*???#define SDEBUGSPORT(x)   { Superkprintf x; }*/
#define SDEBUGSPORT(x)   {}
/*???#define SDEBUGITEM(x)  { Superkprintf x; }*/
#define SDEBUGITEM(x)  {}
/*???#define SDEBUGGRAF(x)   { Superkprintf x; }*/
#define SDEBUGGRAF(x)   {}
/*???#define DEBUGGRAF(x)   { kprintf x; }*/
#define DEBUGGRAF(x)   {}
/*???#define DEBUGELLIPSE(x)   { kprintf x; }*/
#define DEBUGELLIPSE(x)   {}
/*???#define DEBUGGRAFREGIS(x)  { kprintf x; }*/
#define DEBUGGRAFREGIS(x)  {}
/*???#define DEBUGBLIT(x) { kprintf x; }*/
#define DEBUGBLIT(x) {}
/*???#define SDEBUGVDL(x)  { Superkprintf x; }*/
```

```
#define SDEBUGVDL(x)  {}

/*

#define _CREATESCREENGROUP
//
#define _SUBMITVDL
#define _SETVDL
//
#define _DISPLAYSCREEN
//
//
#define _SETCEWATCHDOG
#define _SETCECONTROL
//
#define _DRAWCELS
#define _DRAWTEXT8
#define _GETCURRENTFONT
#define _SETCURRENTFONTCCB
#define _FILLRECT
//
#define _DRAWTO
#define _COPYLINE
#define _DRAWCHAR
//#define _SUPERCLOSEFONT
#define _DRAWTEXT16
//
#define _SUPEROPENRAMFONT
//#define _SETFILEFONTCACHESIZE
//#define _SUPEROPENFILEFONT
//
#define _DRAWSCREENCELS
//
//
#define _SETCLIPHEIGHT
#define _SETCLIPWIDTH
#define _REMOVESCREENGROUP
#define _ADDSCREENGROUP
#define _SETBGPEN
#define _SETFGPEN
#define _SUPERRESETCURRENTFONT
#define _SETSCREENCOLORS
//
//#define _RESETSYSTEMGRAPHICS
#define _RESETSCREENCOLORS
#define _SETSCREENCOLOR
#define _DISABLEHAVG
#define _ENABLEHAVG
#define _DISABLEVAVG
#define _ENABLEVAVG
//
#define _SETCLIPORIGIN
#define _RESETREADADDRESS
#define _SETREADADDRESS
//



typedef struct SWOFF {
  Stream *stream;
  int32 basechar;
  int32 charcount;
  Font *font;
  int32 chararrayoffset;
} SWOFF;


typedef struct SharedListNode {
  MinNode sl;
  Item sl_TaskItem;
} SharedListNode;


#define MAX_PLUT_SIZE (32*2)


/*???#define GETPIXELADDRESS -4*/
/*???#define READVDLCOLOR -3*/
/*???#define READPIXEL -2*/
```

```
/*???#define QUADMAPSPRITE -1*/


#define BLANKVDL_SIZE 8 /* number of words in the system VDL entry */
#define BLANKVDL_DMACTRL2 (VDL_ENVIDDMA+VDL_PREVSEL+VDL_LDCUR+VDL_LDPREV\
                           +((32+2)<<VDL_LEN_SHIFT)+240)
#define BLANKVDL_DMACTRL1 (VDL_ENVIDDMA+VDL_PREVSEL+VDL_LDCUR+VDL_LDPREV\
                           +(2<<VDL_LEN_SHIFT)+1)
#define VDL_DMACTRLLAST ((2<<VDL_LEN_SHIFT)+0)
#define VDL_DISPCTRLLAST (VDL_DISPCTRL|VDL_HINTEN|VDL_BLSB_NOP|VDL_HSUB_NOP\
                          |VDL_VSUB_NOP|VDL_WINBLSB_NOP|VDL_WINHSUB_NOP\
                          |VDL_WINVSUB_NOP)


/* #define SCREENWIDTH  1024 */
/*???#define DISPLAY_WIDTH      512*/
#define DISPLAY_WIDTH      320
#define DISPLAY_CLIPWIDTH  320
#define DISPLAY_HEIGHT     240

#define DISPLAY_RAMSIZE      (DISPLAY_WIDTH*DISPLAY_HEIGHT*2)
/*???#define FB_OFFSET  (32*4)*/


#define MAKE_REGCTL1(width,height) (((width-1)<<REG_XCLIP_SHIFT)\
                                    |((height-1)<<REG_YCLIP_SHIFT))


/* routine numbers for folio calls */
//#define RESETFONT       -11
//#define CLOSEFONT       -10
//#define DRAWTEXT16       -9
//#define OPENFILEFONT     -8
//#define OPENRAMFONT      -7
//#define SETFONTCACHE     -6
#define WRITEPIXEL       -5
#define GETPIXELADDRESS  -4
#define READVDLCOLOR     -3
#define READPIXEL        -2
#define MAPSPRITE        -1


/*****************************************************************\
* Useful macros                                                   *
\*****************************************************************/

#define SWAP(a,b,cast) {cast swp_; swp_=a; a=b; b=swp_;}


#ifdef __SHERRIE
/*???#define MINSPORTVCOUNT     7*/
#define MINSPORTVCOUNT  10
/*???#define MAXSPORTVCOUNT     16*/
#define MAXSPORTVCOUNT  13
#else
#define MINSPORTVCOUNT  7
#define MAXSPORTVCOUNT  14
#endif


/*****************************************************************\
* Structures                                                      *
\*****************************************************************/


typedef struct CreateScreenArgs {
  int32 st_DisplayHeight;
  int32 st_ScreenCount;
  int32 st_ScreenHeight;
  int32 st_BitmapCount;
  int32 *st_BitmapWidthArray;
  int32 *st_BitmapHeightArray;
  ubyte **st_BitmapBufArray;
  int32 st_VDLType;
  VDLEntry **st_VDLPtrArray;
  int32 *st_VDLLengthArray;
```

```
  int32 st_SPORTBankBits;
  int32 st_bufarrayallocatedflag;
} CreateScreenArgs;


/* This is stuffed here for the moment just so compiles won't complaing */
typedef struct FileFontHeader
        {
        int32 ffh_Width;
        int32 ffh_ImageSize;
        } FileFontHeader;


/*************************************************************\
* Prototypes                                                  *
\*************************************************************/

/* Routine to initialize SPORT transfer device driver */
//Item createSPORTDriver(void);

//extern Item SuperCreateItem (int32,void *);
/*???extern int32 SuperLockSemaphore(Item,int32);*/
//extern int32 SuperUnlockSemaphore(Item);

/* Null routine for placeholder */
Item NULROUTINE(void);

/* Internal routines to manipulate the PSR */
uint32 GDisable (void);
void GEnable (uint32 state);

/* Initialize the graphics folio */
int32 InitGrafBase (GrafFolio *gb);

void SoftCel (GrafCon *gc, CCB *ccb);

void blitrect (uint32 *dest, uint32 *src, uint32 *info);


void graphicRemoveItem(Task *t,Item i);
extern int32 SuperexternalDeleteItem(Item i);

void CalculatePatch(ScreenGroup *sg,VDL *vdl,VDLEntry **PatchPtrPtr,VDLEntry *PatchDMACtrlPtr);
void AddGroupToDisplay(Item sgitem);
void RemoveGroupFromDisplay(Item sgitem);
void MoveGroupInDisplay(Item sgitem,int32 y);

void printgraffolio(void);
void printscreengroup(Item i);
void printscreen(Item i);
void printvdl(Item i);

Item internalCreateVDL( VDL *vdl, void *args );
Item internalOpenVDL( VDL *vdl, void *args );
Err internalDeleteVDL( VDL *vdl, Task *t );
Err internalCloseVDL( VDL *vdl, Task *t );
Item realCreateScreenGroup( Item *screenItemArray, CreateScreenArgs *stargs );
void realSetVRAMPages(void *dest,int32 val,int32 numpages, int32 mask);/*JCR*/


int32 BuildSystemVDLs( void );

Item internalFindGrafItem (int32 ntype, TagArg *p);
int32 internalDeleteGrafItem (Item it, Task *t);
Item internalCreateGrafItem(void *n, uint8 ntype, void *args);
Item internalOpenGrafItem (Node *n, void *args);
int32 internalCloseGrafItem (Item it, Task *t);

void GrafInit( void );
Item InitGraphicsErrors( void );

VDLEntry *ProofVDLEntry(VDLEntry *VDLDataPtr, int32 length);

void  InitFontEntry( void );

int32 InitFontStuff( void );

extern struct KernelBase *KernelBase;

/*??? Get rid of this */
#define PIXELSIZE 1
#define PIXELSHIFT 0
```

Oct 28 12:04 1993 includes/intgraf.h Page 3

```
extern VDLEntry *_VDLControlWord;


//int32  __swi(_SUPERCLOSEFONT)  superCloseFont( void );
int32  __swi(_SUPEROPENRAMFONT)  superOpenRAMFont( Font *font );
//int32  __swi(_SUPEROPENFILEFONT)  superOpenFileFont( SWOFF *swoff );
int32  __swi(_SUPERRESETCURRENTFONT)  superResetCurrentFont( void );


//int32 swiSuperCloseFont( void );
//int32 swiSuperOpenFileFont( SWOFF *swoff );
int32 swiSuperOpenRAMFont( Font *font );
int32 swiSuperResetCurrentFont( void );

int32 InitDefaultFont( void );
void  InsertFontEntry( FontEntry *newentry );



__swi(_DRAWSCREENCELS) int32 __DrawScreenCels( Item screenItem, CCB *ccb );
__swi(_DRAWCELS) int32 __DrawCels( Item bitmapItem, CCB *ccb );
__swi(_ADDSCREENGROUP) int32 __AddScreenGroup( Item screenGroup, TagArg *targs );
__swi(_DISABLEHAVG) int32 __DisableHAVG( Item screenItem );
__swi(_DISABLEVAVG) int32 __DisableVAVG( Item screenItem );
__swi(_DISPLAYSCREEN) int32 __DisplayScreen( Item screenItem0, Item screenItem1 );
__swi(_DRAWCHAR) int32 __DrawChar( GrafCon *gcon, Item bitmapItem, uint32 character );
__swi(_DRAWTEXT16) int32 __DrawText16( GrafCon *gcon, Item bitmapItem, uint16 *text );
__swi(_DRAWTEXT8) int32 __DrawText8( GrafCon *gcon, Item bitmapItem, uint8 *text );
__swi(_DRAWTO) int32 __DrawTo( Item bitmapItem, GrafCon *grafcon, Coord x, Coord y );
__swi(_ENABLEHAVG) int32 __EnableHAVG( Item screenItem );
__swi(_ENABLEVAVG) int32 __EnableVAVG( Item screenItem );
__swi(_FILLRECT) int32 __FillRect( Item bitmapItem, GrafCon *gc, Rect *r );
__swi(_GETCURRENTFONT) Font *__GetCurrentFont( void );
__swi(_REMOVESCREENGROUP) int32 __RemoveScreenGroup( Item screenGroup );
__swi(_RESETREADADDRESS) int32 __ResetReadAddress( Item bitmapItem );
__swi(_RESETSCREENCOLORS) int32 __ResetScreenColors( Item screenItem );
__swi(_SETCECONTROL) int32 __SetCEControl( Item bitmapItem, int32 controlWord, int32 controlMask );
__swi(_SETCEWATCHDOG) int32 __SetCEWatchDog( Item bitmapItem, int32 db_ctr );
__swi(_SETCLIPHEIGHT) int32 __SetClipHeight( Item bitmapItem, int32 clipHeight );
__swi(_SETCLIPORIGIN) int32 __SetClipOrigin( Item bitmapItem, int32 x, int32 y );
__swi(_SETCLIPWIDTH) int32 __SetClipWidth( Item bitmapItem, int32 clipWidth );
__swi(_SETCURRENTFONTCCB) int32 __SetCurrentFontCCB( CCB *ccb );
//__swi(_SETFILEFONTCACHESIZE) int32 __SetFileFontCacheSize( int32 size );
__swi(_SETREADADDRESS) int32 __SetReadAddress( Item bitmapItem, ubyte *buffer, int32 width );
__swi(_SETSCREENCOLOR) int32 __SetScreenColor( Item screenItem, uint32 colorentry );
__swi(_SETSCREENCOLORS) int32 __SetScreenColors( Item screenItem, uint32 *entries, int32 count );
__swi(_SETVDL) Item  __SetVDL( Item screenItem, Item vdlItem );
__swi(_SUBMITVDL) Item  __SubmitVDL( VDLEntry *VDLDataPtr, int32 length, int32 type );

int32 kDrawScreenCels( Item screenItem, CCB *ccb );
int32 kDrawCels( Item bitmapItem, CCB *ccb );
int32 kAddScreenGroup( Item screenGroup, TagArg *targs );
int32 kDisableHAVG( Item screenItem );
int32 kDisableVAVG( Item screenItem );
int32 kDisplayScreen( Item screenItem0, Item screenItem1 );
int32 kDrawChar( GrafCon *gcon, Item bitmapItem, uint32 character );
int32 kDrawText16( GrafCon *gcon, Item bitmapItem, uint16 *text );
int32 kDrawText8( GrafCon *gcon, Item bitmapItem, uint8 *text );
int32 kDrawTo( Item bitmapItem, GrafCon *grafcon, Coord x, Coord y );
int32 kEnableHAVG( Item screenItem );
int32 kEnableVAVG( Item screenItem );
int32 kFillRect( Item bitmapItem, GrafCon *gc, Rect *r );
Font *kGetCurrentFont( void );
int32 kRemoveScreenGroup( Item screenGroup );
int32 kResetReadAddress( Item bitmapItem );
int32 kResetScreenColors( Item screenItem );
int32 kSetCEControl( Item bitmapItem, int32 controlWord, int32 controlMask );
int32 kSetCEWatchDog( Item bitmapItem, int32 db_ctr );
int32 kSetClipHeight( Item bitmapItem, int32 clipHeight );
int32 kSetClipOrigin( Item bitmapItem, int32 x, int32 y );
int32 kSetClipWidth( Item bitmapItem, int32 clipWidth );
int32 kSetCurrentFontCCB( CCB *ccb );
//int32 kSetFileFontCacheSize( int32 size );
int32 kSetReadAddress( Item bitmapItem, ubyte *buffer, int32 width );
int32 kSetScreenColor( Item screenItem, uint32 colorentry );
int32 kSetScreenColors( Item screenItem, uint32 *entries, int32 count );
Item  kSetVDL( Item screenItem, Item vdlItem );
Item  kSubmitVDL( VDLEntry *VDLDataPtr, int32 length, int32 type );


#endif /* of #ifndef kINTGRAF_H */
```

Oct 28 12:07 1993 createscreengroup.c Page 1

```
/* ************************************************************************
 *
 * Graphics routines for the Opera Hardware
 *
 * Copyright (C)     , New Technologies Group, Inc.
 * NTG Trade Secrets  -  Confidential and Proprietary
 *
 * The contents of this file were designed with tab stops of 4 in mind
 *
 * DATE   NAME              DESCRIPTION
 * ------ ---------------- ----------------------------------------------
 * 930630 SHL              Split library into seperate source files
 * 930604 JCR              Re wrote SetVRAMPages()
 * 920724 -RJ Mical        Start overhaul
 * 920717 Stephen Landrum  Last edits before July handoff
 *
 * ********************************************************************** */

#include "types.h"

#include "debug.h"
#include "nodes.h"
#include "kernelnodes.h"
#include "list.h"
#include "folio.h"
#include "io.h"
#include "task.h"
#include "kernel.h"
#include "mem.h"
#include "semaphore.h"

#include "stdarg.h"
#include "strings.h"
#include "operror.h"

#include "intgraf.h"

#include "device.h"
#include "driver.h"
#include "filesystem.h"
#include "filesystemdefs.h"
#include "filefunctions.h"
#include "filestream.h"
#include "filestreamfunctions.h"


__swi(_CREATESCREENGROUP)
     Item _CreateScreenGroup (Item *screenitemArray, CreateScreenArgs *stargs);


Item
CreateScreenGroup( Item *screenItemArray, TagArg *targs )
{
  int32 tagc, *tagp;
  Item retvalue;
  int32 *i32ptr, *i32ptr2;
  int32 i, i2, width, height, bigsize, type;
  CreateScreenArgs stargs;
  ubyte **bufarray;

  if (ItemOpened(KernelBase->kb_CurrentTask->t.n_Item, 2)) {
    return GRAFERR_GRAFNOTOPEN;
  }

  retvalue = 0;

  stargs.st_ScreenCount = 2;
  stargs.st_ScreenHeight = GrafBase->gf_DefaultDisplayHeight;
  stargs.st_BitmapCount = 1;
  stargs.st_BitmapWidthArray = NULL;
  stargs.st_BitmapHeightArray = NULL;
  stargs.st_BitmapBufArray = NULL;
  stargs.st_SPORTBankBits = 0;

  stargs.st_DisplayHeight = GrafBase->gf_DefaultDisplayHeight;

  stargs.st_VDLType = VDLTYPE_SIMPLE;
  stargs.st_VDLLengthArray = NULL;
  stargs.st_VDLPtrArray = NULL;

  /* CreateScreenGroup() TagArgs
```

```
 *   - Display height
 *   - Screen count
 *   - Screen height
 *   - Bitmap count
 *   - Bitmap width array
 *   - Bitmap height array
 *   - Bitmap buffer ptr array
 *   - Build VDL of type xxx request
 *   - VDL ptr array
 *   - Control Flags
 */
tagp = (int32 *)targs;
if ( tagp ) {
  while ( (tagc = *tagp++) != CSG_TAG_DONE ) {
    switch ( tagc ) {
    case CSG_TAG_DISPLAYHEIGHT:
      stargs.st_DisplayHeight = *tagp++;
      break;
    case CSG_TAG_SCREENCOUNT:
      stargs.st_ScreenCount = *tagp++;
      break;
    case CSG_TAG_SCREENHEIGHT:
      stargs.st_ScreenHeight = *tagp++;
      break;
    case CSG_TAG_BITMAPCOUNT:
      stargs.st_BitmapCount = *tagp++;
      break;
    case CSG_TAG_BITMAPWIDTH_ARRAY:
      stargs.st_BitmapWidthArray = (int32 *)*tagp++;
      break;
    case CSG_TAG_BITMAPHEIGHT_ARRAY:
      stargs.st_BitmapHeightArray = (int32 *)*tagp++;
      break;
    case CSG_TAG_BITMAPBUF_ARRAY:
      stargs.st_BitmapBufArray = (ubyte **)*tagp++;
      break;
    case CSG_TAG_VDLTYPE:
      stargs.st_VDLType = *tagp++;
      break;
    case CSG_TAG_VDLPTR_ARRAY:
      stargs.st_VDLPtrArray = (VDLEntry **)*tagp++;
      break;
    case CSG_TAG_VDLLENGTH_ARRAY:
      stargs.st_VDLLengthArray = (int32 *)*tagp++;
      break;
    case CSG_TAG_SPORTBITS:
      stargs.st_SPORTBankBits = *tagp++;
      break;
    default:
      retvalue = GRAFERR_BADTAG;
      goto DONE;
    }
  }
}

#if(0)
#define DEB kprintf
DEB("stargs.st_DisplayHeight=$%lx ", (unsigned long)(stargs.st_DisplayHeight));
DEB("stargs.st_ScreenCount=$%lx ", (unsigned long)(stargs.st_ScreenCount));
DEB("stargs.st_ScreenHeight=$%lx ", (unsigned long)(stargs.st_ScreenHeight));
DEB("\n");
DEB("stargs.st_BitmapCount=$%lx ", (unsigned long)(stargs.st_BitmapCount));
DEB("stargs.st_BitmapWidthArray=$%lx ", (unsigned long)(stargs.st_BitmapWidthArray));
DEB("stargs.st_BitmapHeightArray=$%lx ", (unsigned long)(stargs.st_BitmapHeightArray));
DEB("\n");
DEB("stargs.st_BitmapBufArray=$%lx ", (unsigned long)(stargs.st_BitmapBufArray));
DEB("stargs.st_VDLType=$%lx ", (unsigned long)(stargs.st_VDLType));
DEB("stargs.st_VDLPtrArray=$%lx ", (unsigned long)(stargs.st_VDLPtrArray));
DEB("\n");
DEB("stargs.st_SPORTBankBits=$%lx ", (unsigned long)(stargs.st_SPORTBankBits));
DEB("\n");
#undef DEB
#endif

  if ( (stargs.st_DisplayHeight < 1)
      || (stargs.st_DisplayHeight > GrafBase->gf_DefaultDisplayHeight) ) {
    /* bad height */
    retvalue = GRAFERR_BADDISPDIMS;
    goto DONE;
  }

  if ( stargs.st_VDLPtrArray && (stargs.st_VDLLengthArray == NULL) ) {
```

```
    retvalue = GRAFERR_VDL_LENGTH;
    goto DONE;
  }

  if ( stargs.st_ScreenCount < 1 ) {
    /* bad screen count */
    retvalue = GRAFERR_BADDISPDIMS;
    goto DONE;
  }

  if ( stargs.st_ScreenHeight < stargs.st_DisplayHeight ) {
    /* bad screen height */
    retvalue = GRAFERR_BADDISPDIMS;
    goto DONE;
  }

  if ( ( stargs.st_BitmapCount < 0 ) || ( (stargs.st_BitmapCount > 1)
                                          && (stargs.st_BitmapHeightArray == NULL) ) ) {
    /* bad bitmap setup */
    retvalue = GRAFERR_BADBITMAPSPEC;
    goto DONE;
  }

  stargs.st_bufarrayallocatedflag = FALSE;
  if ( stargs.st_BitmapBufArray == NULL ) {
    /* No bitmap buffers?  We must allocate bitmap buffers for the caller
     * out of the caller's memory space before we slip below the fence
     */
    bufarray = (ubyte **)USER_ALLOCMEM( stargs.st_ScreenCount
                                        * stargs.st_BitmapCount * sizeof( ubyte * ), 0 );
    if ( bufarray == NULL ) {
      /* out of memory */
      retvalue = GRAFERR_NOMEM;
      goto DONE;
    }
    stargs.st_bufarrayallocatedflag = TRUE;
    stargs.st_BitmapBufArray = bufarray;

    for ( i = 0; i < stargs.st_ScreenCount; i++ ) {
      i32ptr = stargs.st_BitmapHeightArray;
      i32ptr2 = stargs.st_BitmapWidthArray;
      height = GrafBase->gf_DefaultDisplayHeight;
      width = GrafBase->gf_DefaultDisplayWidth;
      for ( i2 = 0; i2 < stargs.st_BitmapCount; i2++ ) {
        if ( i32ptr ) height = *i32ptr++;
        if ( i32ptr2 ) width = *i32ptr2++;
        bigsize = width * 2 * height;
        type = MEMTYPE_VRAM | MEMTYPE_CEL;
        if ( stargs.st_SPORTBankBits ) {
          /* The presence of SPORTBankBits implies that
           * SPORT transfers with this bitmap will take place,
           * so the correct SPORT care must be taken
           */
          bigsize = ( bigsize + (GrafBase->gf_VRAMPageSize-1) )
            / GrafBase->gf_VRAMPageSize;
          bigsize *= GrafBase->gf_VRAMPageSize;
          type |= stargs.st_SPORTBankBits | MEMTYPE_STARTPAGE;
        }
        *bufarray = (ubyte *)USER_ALLOCMEM( bigsize, type );

DEBUGGRAF(("--- width=%ld ", (unsigned long)(width)));
DEBUGGRAF(("height=%ld ", (unsigned long)(height)));
DEBUGGRAF(("bigsize=%ld ", (unsigned long)(bigsize)));
DEBUGGRAF(("($%lx) ", (unsigned long)(bigsize)));
DEBUGGRAF(("type=$%lx ", (unsigned long)(type)));
DEBUGGRAF(("*bufarray=$%lx ", (unsigned long)(*bufarray)));
DEBUGGRAF(("\n"));

        if ( *bufarray == NULL ) {
          /* out of memory */
          retvalue = GRAFERR_NOMEM;
          goto DONE;
        }
        bufarray++;
      }
    }
  }

/*??? Check that bitmap Widths have valid values */

  retvalue = _CreateScreenGroup( screenItemArray, &stargs );
```

```
DONE:
  if (stargs.st_bufarrayallocatedflag) {
    FREEMEM (stargs.st_BitmapBufArray, stargs.st_ScreenCount*stargs.st_BitmapCount*sizeof(ubyte*));
  }
  return( retvalue );
}


Err
DeleteScreenGroup (Item sgi)
{
  ScreenGroup *sgptr;
  Item si, bi;
  Screen *sptr;
  Bitmap *bptr;

  sgptr = (ScreenGroup*)LookupItem (sgi);
  if ((int32)sgptr < 0) {
    return (Err)sgptr;
  }
  RemoveScreenGroup (sgi);      /* remove screengroup from active groups */
  for (sptr = (Screen*)FIRSTNODE(&sgptr->sg_ScreenList); ISNODE(&sgptr->sg_ScreenList,sptr);
       sptr = (Screen*)FIRSTNODE(&sgptr->sg_ScreenList)) {
    si = sptr->scr.n_Item;
    for (bptr = (Bitmap*)FIRSTNODE(&sptr->scr_BitmapList); ISNODE(&sptr->scr_BitmapList,bptr);
         bptr = (Bitmap*)FIRSTNODE(&sptr->scr_BitmapList)) {
      bi = bptr->bm.n_Item;
      if (bptr->bm_SysMalloc) {         /* check to make sure we allocated bitmap memory */
        FREEMEM (bptr->bm_Buffer, bptr->bm_Width*bptr->bm_Height*2);    /* Free bitmap memory */
      }
      DeleteItem (bi);  /* delete the bitmap Item */
    }
    DeleteItem (sptr->scr_VDLItem);     /* delete the VDL Item */
    DeleteItem (si);    /* delete the screen Item */
  }
  return DeleteItem (sgi);      /* delete the screengroup Item (Whew!) */
}
```

Oct 28 12:07 1993 screen.c Page 1

```
/* ************************************************************************
 *
 * Screen routines for the Opera Hardware
 *
 * Copyright (C)      New Technologies Group, Inc.
 * NTG Trade Secrets  -  Confidential and Proprietary
 *
 * The contents of this file were designed with tab stops of 4 in mind
 *
 * DATE   NAME              DESCRIPTION
 * ------ ---------------- ---------------------------------------------
 * 930830 SHL               Split CreateBitmap out of CreateScreenGroup
 * 930706 SHL               Commented out pre-red support
 * 930609 -JCR              Added ALLOC_MEM for bitmaps if not passed in.
 * 930421 -JCR              Completed VDL struct usage, added user VDL verify hook.
 * 921118 -RJ               Changed CCBCTL0 default to include CFBDSUB
 * 921010 -RJ Mical         Created this file!
 *
 * ********************************************************************** */


/*************************************************************\
* Header files                                                *
\*************************************************************/

#define SHLDBUG(x) /* Superkprintf x */

#define SUPER
#include "types.h"

#include "debug.h"
#include "item.h"
#include "nodes.h"
#include "interrupts.h"
#include "kernel.h"
#include "mem.h"
#include "list.h"
#include "task.h"
#include "folio.h"
#include "kernelnodes.h"
#include "super.h"

#include "intgraf.h"

#include "stdarg.h"
#include "strings.h"


extern MemHdr *vram;    /* pts to systems MemHdr for VRAM */
extern int32 ValidateMem(Task *t,uint8 *p,int32 size);


/* template tag list for bitmap creation */
/* !!! DO NOT CHANGE THE ORDER OF ELEMENTS IN TEMPLATE WITHOUT CHECKING CODE BELOW !!! */
TagArg _cbmta[] = {
  {CBM_TAG_WIDTH, 0,},
  {CBM_TAG_HEIGHT, 0,},
  {CBM_TAG_BUFFER, 0,},
  {CBM_TAG_DONE, 0,},
};


/*******************************************************/
Item
realCreateScreenGroup( Item *screenItemArray, CreateScreenArgs *stargs )
{
  VDL *VDL_p;
  Item sgitem,vdlitem;
  ScreenGroup *sgptr;
  Screen *screen;
  Item retvalue;
  int32 currentHeight, width, *user_vdlLengths;
  VDLEntry *vdl, *vdl2, *vdl_PatchPost, **user_vdlList;
  Bitmap *bitmap;
  Item bitmapitem;
  ubyte **bufptr, **bufptr2, *zbufptr, *prevbufptr;
  int32 *widthptr, *heightptr;
  Item *iptr;
  int32 vdl_len, total_vdl_len, i, i2, i3, size, color;
  VDLEntry displayControl;
```

```
  retvalue = 0;
  sgitem = 0;

  sgitem = SuperCreateItem( MKNODEID(NODE_GRAPHICS,TYPE_SCREENGROUP), NULL );
  if ( (int32)sgitem < 0 ) {
    /* couldn't allocate screen group item */
    retvalue = (int32)sgitem;
    goto DONE;
  }

  /* Initialize the ScreenGroup item */
  sgptr = (ScreenGroup *)LookupItem( sgitem );

  InitList (&sgptr->sg_ScreenList, "ScreenList");

/*???   sgptr->sg_DisplayHeight = sgptr->sg_CurrentDisplayHeight */
  sgptr->sg_DisplayHeight = stargs->st_DisplayHeight;
  sgptr->sg_ScreenHeight = stargs->st_ScreenHeight;
  sgptr->sg_Add_SG_Called = 0;

  retvalue = SuperValidateMem (CURRENTTASK, (uint8*)screenItemArray,
                               stargs->st_ScreenCount*sizeof(Item));
  if (retvalue<0) {
    goto DONE;
  }
  iptr = screenItemArray;
  bufptr = stargs->st_BitmapBufArray;
  stargs->st_BitmapCount = 1; /* DDD Force, for 1st release. JCR */
  /* Point to user-supplied VDL data/length arrays */
  user_vdlList = stargs->st_VDLPtrArray;
  user_vdlLengths = stargs->st_VDLLengthArray;
  total_vdl_len = 0;

  /* MAJOR "FOR EACH SCREEN" LOOP */
  for ( i = 0; i < stargs->st_ScreenCount; i++ ) {
    *iptr = SuperCreateItem (MKNODEID(NODE_GRAPHICS,TYPE_SCREEN), NULL);
    if( *iptr < 0 ) {
      retvalue = *iptr; /* couldn't allocate screen item */
      goto DONE;
    }
    screen = (Screen *)LookupItem( *iptr );
    screen->scr_ScreenGroupPtr = sgptr;
    iptr++;

    AddHead (&sgptr->sg_ScreenList, (Node*)screen);

    /* DO VDL FOR THIS SCREEN */
    if ( user_vdlList ) {
      /* USER */
      /* User is supplying HIS OWN VDL. Verify, & copy ->sys RAM*/
      int32 len;
      VDLEntry *user_vdl;
      user_vdl = *user_vdlList++;
      len = *user_vdlLengths++;
      if ( user_vdl==NULL || len<4 ) {  /* Proof will look closer at len */
        retvalue = GRAFERR_BADTAGVAL;
        goto DONE;
      }
      /* Proof user's VDLEntry list, and return 0 if OK. */
      /* set vdl to pt. to VDLEntry data, as do 4 cases below */
      vdl = ProofVDLEntry(user_vdl,len);
      if (vdl < (VDLEntry *)0) {
        retvalue = (Item)vdl;
        goto DONE;
      }
      total_vdl_len = len;
    } else {    /* else user has NOT supplied his own VDL. Default. */
      switch ( stargs->st_VDLType ) {
      case VDLTYPE_FULL:
//      size = 4 + 1 + 1;
/*???*/
size = 8;
        bufptr2 = bufptr;
        widthptr = stargs->st_BitmapWidthArray;
        heightptr = stargs->st_BitmapHeightArray;
        vdl = NULL;
        vdl_PatchPost = NULL;
        for ( i2 = 0; i2 < stargs->st_BitmapCount; i2++ ) {
          if ( heightptr ) currentHeight = *heightptr++;
          else currentHeight = GrafBase->gf_DefaultDisplayHeight;
          vdl_len = size * currentHeight + 32;
```

```
//          total_vdl_len += vdl_len;
total_vdl_len = vdl_len;
          vdl2 = (VDLEntry *)SUPER_ALLOCMEM ((sizeof(VDLEntry)*vdl_len),
                                              MEMTYPE_VRAM | MEMTYPE_DMA );
          if ( vdl2 == NULL ) {
            /* out of memory */
            retvalue = GRAFERR_NOMEM;
            goto DONE;
          }
          zbufptr = *bufptr2++;
          prevbufptr = zbufptr;

/*???                       if ( widthptr ) width = (*widthptr++) * 2;*/
/*???                       else width = GrafBase->gf_DefaultDisplayWidth * 2;*/

          if ( widthptr ) width = (*widthptr++);
          else width = GrafBase->gf_DefaultDisplayWidth;

/*??? Must handle starting on odd-line boundaries */
          for ( i3 = 0; i3 < currentHeight; i3++ ) {
            /* Assign the address of the first to vdl, else
             * if we're beyond the first entry, patch the
             * previous entry to point to this one
             */
            if ( vdl == NULL ) {
              vdl = vdl2;
            } else {
              *vdl_PatchPost = (VDLEntry)vdl2;
            }
            /* Build this vdl entry */
/*???*/
            if ( i3 == 0 ) {
              *vdl2++ = VDL_ENVIDDMA | VDL_LDCUR | VDL_LDPREV
                | ( (32+1+1) << VDL_LEN_SHIFT )
                  | (1 << VDL_LINE_SHIFT );
            } else {
              *vdl2++ = VDL_ENVIDDMA | VDL_LDCUR | VDL_LDPREV
                | ( (2) << VDL_LEN_SHIFT )
                  | (1 << VDL_LINE_SHIFT );
            }
            /* Link previous to the data line before this one */
            *vdl2++ = (VDLEntry)zbufptr;
            *vdl2++ = (VDLEntry)prevbufptr;
            prevbufptr = zbufptr;
            if (( i3 & 1 ) == 0 ) zbufptr += 2;
            else zbufptr = zbufptr - 2 + width * 2 * 2;
            /* Save a pointer to the field to be patched */
            vdl_PatchPost = vdl2++;

            displayControl = DEFAULT_DISPCTRL;
            {
              displayControl &= ~VDL_DISPMOD_MASK;
              switch ( width ) {
              case 320:
                displayControl |= VDL_DISPMOD_320;
                break;
              case 384:
                displayControl |= VDL_DISPMOD_384;
                break;
              case 512:
                displayControl |= VDL_DISPMOD_512;
                break;
              case 640:
                displayControl |= VDL_DISPMOD_640;
                break;
              case 1024:
                displayControl |= VDL_DISPMOD_1024;
                break;
              default:
                retvalue = GRAFERR_VDLWIDTH;
                goto DONE;
              }
            }
            *vdl2++ = displayControl;

            if ( i3 == 0 ) {
              for ( size = 0; size < 32; size++ ) {
                color = (ubyte)(( size * 255 ) / 31);
                *vdl2++ = MakeCLUTColorEntry (size, color, color, color);
              }
              *vdl2++ = MakeCLUTBackgroundEntry (0, 0, 0);
              *vdl2++ = VDL_NULLVDL;
```

```
            *vdl2++ = VDL_NULLVDL;
          } else {
            *vdl2++ = VDL_NULLVDL;
            *vdl2++ = VDL_NULLVDL;
            *vdl2++ = VDL_NULLVDL;
          }
        }
      }

      /* point the last vdl to the end vdl entry */
      if ( vdl_PatchPost ) {
        *vdl_PatchPost = (VDLEntry)GrafBase->gf_VDLPostDisplay;
      }
      break;
    case VDLTYPE_COLOR:
      /* type not yet implemented */
      retvalue = GRAFERR_NOTYET;
      goto DONE;
      break;
    case VDLTYPE_ADDRESS:
      /* type not yet implemented */
      retvalue = GRAFERR_NOTYET;
      goto DONE;
      break;
    case VDLTYPE_SIMPLE:
      size = 4 + 32 + 1 + 1;
      bufptr2 = bufptr;
      widthptr = stargs->st_BitmapWidthArray;
      vdl = NULL;
      vdl_PatchPost = NULL;

      for ( i2 = 0; i2 < stargs->st_BitmapCount; i2++ ) {
        if ( widthptr ) {
          width = (*widthptr++);
        } else {
          width = GrafBase->gf_DefaultDisplayWidth;
        }

        vdl_len = size;
//      total_vdl_len += vdl_len;
total_vdl_len = vdl_len;
        vdl2 = (VDLEntry *)SUPER_ALLOCMEM ((sizeof(VDLEntry)*size), MEMTYPE_VRAM|MEMTYPE_DMA);
        if ( vdl2 == NULL ) {
          /* out of memory */
          retvalue = GRAFERR_NOMEM;
          goto DONE;
        }
        /* Assign the address of the first to vdl, else
         * if we're beyond the first bitmap, patch the previous
         * bitmap to point to this one
         */
        if ( i2 == 0 ) {
          vdl = vdl2;
        } else {
          *vdl_PatchPost = (VDLEntry)vdl2;
        }

        /* Build this vdl entry */
        /*??? Shouldn't use 240, should use height */
        *vdl2++ = VDL_ENVIDDMA
          | VDL_LDCUR | VDL_LDPREV
            | ( (size-4) << VDL_LEN_SHIFT )
              | (240 << VDL_LINE_SHIFT );

        *vdl2++ = (VDLEntry)(*bufptr2);
        *vdl2++ = (VDLEntry)(*bufptr2++);

        /* Save a pointer to the field to be patched */
        vdl_PatchPost = vdl2++;

        displayControl = DEFAULT_DISPCTRL;
        {
          displayControl &= ~VDL_DISPMOD_MASK;
          switch ( width ) {
          case 320:
            displayControl |= VDL_DISPMOD_320;
            break;
          case 384:
            displayControl |= VDL_DISPMOD_384;
            break;
          case 512:
            displayControl |= VDL_DISPMOD_512;
```

```
            break;
          case 640:
            displayControl |= VDL_DISPMOD_640;
            break;
          case 1024:
            displayControl |= VDL_DISPMOD_1024;
            break;
          default:
            retvalue = GRAFERR_VDLWIDTH;
            goto DONE;
          }
        }
        *vdl2++ = displayControl;

        for ( i3 = 0; i3 < 32; i3++ ) {
/*???                                color = 16 + (( i3 * (235-16) ) / 31);*/
          color = (int32)(( i3 * 255 ) / 31);
          *vdl2++ = (VDLEntry) MakeCLUTColorEntry (i3, color, color, color);
        }
        *vdl2++ = MakeCLUTBackgroundEntry (0, 0, 0);
      }

      /* point the last vdl to the end vdl entry */
      if ( vdl_PatchPost ) {
        *vdl_PatchPost = (VDLEntry)GrafBase->gf_VDLPostDisplay;
      }
      break;
    case VDLTYPE_DYNAMIC:
      /* type not yet implemented */
      retvalue = GRAFERR_NOTYET;
      goto DONE;
      break;
    default:
      /* Illegal VDL type. */
      retvalue = GRAFERR_BADTAGVAL;
      goto DONE;
      break;
    } /* end of "switch st_args type */
  }

  /* JCR */
  /* vdl now pts to a valid concat. of VDLEntry's in sys RAM. */
  /* total_vdl_len = size in words */

  /* Create a struct to hold this, & interlink it w/ screen*/
  vdlitem = SuperCreateItem(MKNODEID(NODE_GRAPHICS,TYPE_VDL), NULL );
  if ( (int32)vdlitem < 0 ) {
    /* couldn't allocate VDL item */
    retvalue = (int32)vdlitem;
    goto DONE;
  }

  /* Initialize the VDL */
  VDL_p = (VDL *)LookupItem( vdlitem );
  VDL_p->vdl_ScreenPtr = screen;
  screen->scr_VDLPtr = VDL_p; /* Back Acha */
  screen->scr_VDLItem = vdlitem; /* for SetVDL(). JCR */
  VDL_p->vdl_Type = stargs->st_VDLType;
  /* Each of the 4 cases has left vdl pointing to actual VDLEntry data*/
  /* (Or code for user_VDLdata did). */
  /* and has also set total_vdl_len. */
  VDL_p->vdl_DataPtr = vdl;  /* for SUPER_FREEMEM() */
  /* store size IN BYTES, for SUPER_FREEMEM() */
  VDL_p->vdl_DataSize = total_vdl_len*sizeof(VDLEntry);
  screen->scr_VDLType = stargs->st_VDLType;

/*****************************************************************/
        /* END OF VDL PROCESSING FOR THIS SCREEN. */
        /* DO BITMAP STUFF FOR THIS SCREEN. */
/*****************************************************************/

  InitList( &screen->scr_BitmapList, "ScreenBitmapList" );

  heightptr = stargs->st_BitmapHeightArray;
  widthptr = stargs->st_BitmapWidthArray;
  currentHeight = 0;
  for ( i2 = 0; i2 < stargs->st_BitmapCount; i2++ ) {
    TagArg ta[sizeof(_cbmta)/sizeof(_cbmta[0])];
    memcpy (ta, _cbmta, sizeof(_cbmta));


    /* JCR */
```

```
      if ( widthptr ) ta[0].ta_Arg = (void*)*widthptr++;
      else ta[0].ta_Arg = (void*)GrafBase->gf_DefaultDisplayWidth;
      if ( heightptr ) ta[1].ta_Arg = (void*)*heightptr++;
      else ta[1].ta_Arg = (void*)stargs->st_ScreenHeight;
      /*JCR: NOTE, st_BitmapBufArray could be NULL, so we ALLOC here */
      if (bufptr == (ubyte **)NULL) {
        retvalue = GRAFERR_INTERNALERROR;
        goto DONE;
      } else {
        ta[2].ta_Arg = (void*)*bufptr++;
      }
      bitmapitem = SuperCreateItem (MKNODEID(NODE_GRAPHICS,TYPE_BITMAP), &ta);
      if ( bitmapitem < 0 ) {
        retvalue = bitmapitem; /* couldn't allocate bitmap item */
        goto DONE;
      }
      bitmap = (Bitmap *)LookupItem( bitmapitem );

      screen->scr_TempBitmap = bitmap;
      AddHead (&screen->scr_BitmapList, (Node*)bitmap);

      bitmap->bm_VerticalOffset = currentHeight;
      if (stargs->st_bufarrayallocatedflag) {
        bitmap->bm_SysMalloc = TRUE;
      }
      currentHeight += bitmap->bm_Height;
    }
  } /* END OF MAJOR "FOR EACH SCREEN" LOOP */

  retvalue = sgitem;

DONE:
  if ( retvalue < 0 ) {
    if ( sgitem > 0 ) SuperDeleteItem( sgitem );        /* 9606.15 - SHL */
  }
  return( retvalue );
}  /* end of realCreateScreenGroup() */


int32
DisplayScreen( Item ScreenItem0, Item ScreenItem1 )
{
  Screen *scr0, *scr1;
  ScreenGroup *sg;

  scr0 = (Screen *)CheckItem( ScreenItem0, NODE_GRAPHICS, TYPE_SCREEN );
  if ( ScreenItem1 ) {
    scr1 = (Screen *)CheckItem( ScreenItem1, NODE_GRAPHICS, TYPE_SCREEN );
  } else {
    scr1 = scr0;
  }
  if (( scr0 == NULL ) || ( scr1 == NULL )) {
    /* invalid screen items */
    return GRAFERR_BADITEM;
  }
  if (scr0->scr.n_Owner != CURRENTTASK->t.n_Item) {
    if (ItemOpened(CURRENTTASK->t.n_Item,scr0->scr.n_Item)<0) {
      PRINTNOTOWNER (scr0->scr.n_Item, CURRENTTASK->t.n_Item);
      return GRAFERR_NOTOWNER;
    }
  }
  if (scr1->scr.n_Owner != CURRENTTASK->t.n_Item) {
    if (ItemOpened(CURRENTTASK->t.n_Item,scr1->scr.n_Item)<0) {
      PRINTNOTOWNER (scr1->scr.n_Item, CURRENTTASK->t.n_Item);
      return GRAFERR_NOTOWNER;
    }
  }

  if (!scr0->scr_ScreenGroupPtr) {
    return GRAFERR_INTERNALERROR;
  }
  if (!CheckItem(scr0->scr_ScreenGroupPtr->sg.n_Item,NODE_GRAPHICS,TYPE_SCREENGROUP)) {
    return GRAFERR_SGNOTINUSE;
  }
  sg = scr0->scr_ScreenGroupPtr;
  if ( sg != scr1->scr_ScreenGroupPtr ) {
    /* screen items must be in the same screen group */
    return GRAFERR_MIXEDSCREENS;
  }

  /* graphicsFIRQ() will load these 2 addresses for HW */
```

```
  GrafBase->gf_CurrentVDLEven = scr0->scr_VDLPtr->vdl_DataPtr;
  GrafBase->gf_CurrentVDLOdd =  scr1->scr_VDLPtr->vdl_DataPtr;

  return 0;
}


int32
AddScreenGroup( Item ScreenGroupItem, TagArg *targs )
/* Adds the screenGroup to the display.  After this call, the screens
 * of the screen group are made visible with calls to DisplayScreen().
 *
 * The targs argument allows the caller to specify initial values
 * such as:
 *          * Vertical offset
 *          * Depth from front (0 means frontmost, negative value
 *            means backmost)
 */
{
  ScreenGroup *sg;

  sg = (ScreenGroup *)CheckItem (ScreenGroupItem, NODE_GRAPHICS, TYPE_SCREENGROUP);
  if( !sg ) {
    return GRAFERR_BADITEM;      /* bad scr group Item number */
  }
  if (sg->sg.n_Owner != CURRENTTASK->t.n_Item) {
    if (ItemOpened(CURRENTTASK->t.n_Item,sg->sg.n_Item)<0) {
      PRINTNOTOWNER (sg->sg.n_Item, CURRENTTASK->t.n_Item);
      return GRAFERR_NOTOWNER;
    }
  }
  if (sg->sg_Add_SG_Called) {
    return GRAFERR_SGINUSE; /* Called TWICE */
  }
  sg->sg_Add_SG_Called = 1;  /* Prove he called this routine. */
  return( 0 );
}


int32
RemoveScreenGroup( Item ScreenGroupItem )
/* Removes the screen group from the display.  After this call,
 * the screens of the group will not be visible.
 */
{
  ScreenGroup *sg;
  sg = (ScreenGroup *)CheckItem (ScreenGroupItem, NODE_GRAPHICS, TYPE_SCREENGROUP );
  if( !sg ) {
    return GRAFERR_BADITEM;  /* bad scr group Item number */
  }
  if (sg->sg.n_Owner != CURRENTTASK->t.n_Item) {
    if (ItemOpened(CURRENTTASK->t.n_Item,sg->sg.n_Item)<0) {
      PRINTNOTOWNER (sg->sg.n_Item, CURRENTTASK->t.n_Item);
      return GRAFERR_NOTOWNER;
    }
  }
  if (!sg->sg_Add_SG_Called) {
    /* This SG wasn't previously added. */
    return GRAFERR_SGNOTINUSE;
  }
  return( 0 );
}
```

Oct 28 12:07 1993 vdl.c Page 1

```
/* ************************************************************************
 *
 * VDL (Video Display List) routines for the Opera Hardware
 *
 * Copyright (C)      New Technologies Group, Inc.
 * NTG Trade Secrets  -  Confidential and Proprietary
 *
 * The contents of this file were designed with tab stops of 4 in mind
 *
 * DATE   NAME              DESCRIPTION
 * ------ ---------------- ---------------------------------------------
 * 930708 SHL               Fixed last line of display VDL glitch
 * 930706 SHL               Commented out blue support
 * 930612 SHL               Patched a bunch of stuff in SubmitVDL()
 * 930316 -RJ               Took out the WaitForLine( 7 );
 * 921010 -RJ Mical         Created this file!
 *
 * ********************************************************************** */


/*************************************************************\
* Header files                                                *
\*************************************************************/

#define SUPER
#include "types.h"

#include "debug.h"
#include "item.h"
#include "nodes.h"
#include "interrupts.h"
#include "kernel.h"
#include "mem.h"
#include "list.h"
#include "task.h"
#include "folio.h"
#include "kernelnodes.h"
#include "super.h"

#include "intgraf.h"

#include "stdarg.h"
#include "strings.h"


long
BuildSystemVDLs( void )
{
  VDLEntry *Ptr5, *Ptr19, *Ptr20, *Ptr262, *PtrBlank;
  int32 nullvalue;
  int32 loop;
  int32 retvalue;
  int32 color;
  MemHdr *vram;

  nullvalue = VDL_NULLVDL;
/*???   GrafBase->gf_NullVDLValue = nullvalue;*/

/* ??? -- the 8 should be 6, or 5, or whatever depending on AMY stuff
 * and minimum VDL length.  The STARTPAGE directive should be removed, as
 * it may waste mucho bytes
 */

/* Allocate all system VDLs */
  Ptr5 = (VDLEntry *)SUPER_ALLOCMEM( sizeof(VDLEntry)
                                     * (8 + 8 + (4+32+4) + (4+32+4)),
                                     MEMTYPE_VRAM | MEMTYPE_DMA);
  Ptr20 = Ptr5 + 8;
  Ptr262 = Ptr20 + (4+32+4);
  Ptr19 = Ptr262 + 8;
  PtrBlank = (VDLEntry *)SUPER_ALLOCMEM(sizeof(VDLEntry) * (4+32+4), MEMTYPE_VRAM | MEMTYPE_DMA);

/*??? this comes out for blue */
/*???   if( ((uint32)Ptr5 & 0x7ff) > 0x7c0)*/
/*???           {*/
/*???           retvalue = -4001;*/
/*???           goto DONE;*/
/*???           }*/

  if ( !Ptr5 || !Ptr19 || !Ptr20 || !Ptr262 || !PtrBlank ) {
    retvalue = GRAFERR_NOMEM;
```

```
    goto DONE;
  }


  GrafBase->gf_VDLForcedFirst = Ptr5;
  GrafBase->gf_VDLPreDisplay = Ptr20;
  GrafBase->gf_VDLPostDisplay = Ptr262;
  GrafBase->gf_VDLBlank = GrafBase->gf_CurrentVDLEven = GrafBase->gf_CurrentVDLOdd = PtrBlank;

  /* The forced VDL really seems to correspond to graphics on line 6, not 5 */
  *Ptr5++ = VDL_LDPREV | VDL_LDCUR | (6-4 << VDL_LEN_SHIFT) | 13;
  *Ptr5++ = (long)GrafBase->gf_ZeroPage;
  *Ptr5++ = (long)GrafBase->gf_ZeroPage;
  *Ptr5++ = (long)Ptr19;

  *Ptr5++ = nullvalue;
  *Ptr5++ = nullvalue;
  *Ptr5++ = nullvalue;
  *Ptr5++ = nullvalue;

  *Ptr20++ = (34 << VDL_LEN_SHIFT) | 2;
  *Ptr20++ = (long)GrafBase->gf_ZeroPage;
  *Ptr20++ = (long)GrafBase->gf_ZeroPage;
  /* Set the variable in GrafBase where interrupt code will patch from
   * this system header VDL into the user's display start VDL.
   *
   * The DisplayLink field contains the address of the system's link field
   * that points to the VDL entry for the top of the display
   */
  GrafBase->gf_VDLDisplayLink = Ptr20;
  *Ptr20++ = (long)PtrBlank;

  for ( loop = 0; loop < 32; loop++ ) {
    color = (loop * 255) / 31;
    *Ptr20++ = MakeCLUTColorEntry (loop, color, color, color);
  }
  *Ptr20++ = MakeCLUTBackgroundEntry (0, 0, 0);
  *Ptr20++ = DEFAULT_DISPCTRL|VDL_ONEVINTDIS;

  *Ptr262++ = VDL_DMACTRLLAST;
  *Ptr262++ = (long)GrafBase->gf_ZeroPage;
  *Ptr262++ = (long)GrafBase->gf_ZeroPage;
  *Ptr262++ = (long)GrafBase->gf_VDLForcedFirst;

  *Ptr262++ = VDL_DISPCTRLLAST;
  *Ptr262++ = nullvalue;
  *Ptr262++ = nullvalue;
  *Ptr262++ = nullvalue;

  *Ptr19++ = VDL_ENVIDDMA | VDL_LDCUR | VDL_LDPREV | (34<<VDL_LEN_SHIFT) | 1;
  *Ptr19++ = (long)GrafBase->gf_VIRSPage;
  *Ptr19++ = (long)GrafBase->gf_VIRSPage;
  *Ptr19++ = (long)GrafBase->gf_VDLPreDisplay;

  *Ptr19++ = MakeCLUTColorEntry (0, 0, 0, 0);
  *Ptr19++ = MakeCLUTColorEntry (1, 160, 181, 57);
  *Ptr19++ = MakeCLUTColorEntry (2, 109, 109, 109);
  for ( loop = 3; loop < 32; loop++ ) {
    color = (loop * 255) / 31;
    *Ptr19++ = MakeCLUTColorEntry (loop, color, color, color);
  }

  *Ptr19++ = MakeCLUTBackgroundEntry (0, 0, 0);
  *Ptr19++ = DEFAULT_DISPCTRL|VDL_ONEVINTDIS;

/*??? blank vdl is eight entries long.  it could be six; the normal four,
 * plus color zero and a display control word to select some overlay stuff
 * (ask RJ).  it could be just four or five if we can get a hardware bit to
 * ignore the current and previous and get it placed in the dma control word
 */
  /* Build a "blank screen" VDL */
  {
    List *l = KernelBase->kb_MemHdrList;
    MemHdr *m;
    for (m = (MemHdr *)FIRSTNODE(l); ISNODE(l,m); m = (MemHdr *)NEXTNODE(m) ) {
      if (m->memh_Types & MEMTYPE_VRAM) break;
    }
    if (ISNODE(l,m) == 0) {
      SDEBUGVDL(("BuildSystemVDLs fail, could not find VRAM\n"));
      return NOMEM;
    }
    /* Found VRAM description header, save here */
```

```
    vram = m;
  }
  *PtrBlank++ = BLANKVDL_DMACTRL2;
  *PtrBlank++ = (long)vram->memh_MemBase;
  *PtrBlank++ = (long)vram->memh_MemBase;
  *PtrBlank++ = (long)GrafBase->gf_VDLPostDisplay;
  for ( loop = 0; loop < 32; loop++ ) {
    *PtrBlank++ = MakeCLUTColorEntry (loop, 0, 0, 0);
  }
  *PtrBlank++ = MakeCLUTBackgroundEntry (0, 0, 0);
  *PtrBlank++ = DEFAULT_DISPCTRL;

  /*??? reference to absolute hardware address */
  *((volatile VDLEntry **)CLUTMIDctl) = GrafBase->gf_VDLForcedFirst;

  retvalue = 0;

DONE:
  return( retvalue );
}



/* JCR */
bool
IsVDLInUse(VDL *vdl)
/* Return TRUE if the vdl is in use, FALSE if it is not.
 * A vdl is in use if it is accessed by
 * a group structure that is displayed, or if it matches the "current vdl"
 * in the group field.
 *
 * A vdl is in use even if the group is temporarily not in the list
 * of those displayed.
 */
/* CURRENT ASSUMPTION: there is ONE sg, each w/ TWO VDL's. JCR*/
/* Sc group lists are NOT implemented; we look directly at the Even/Odd ptrs */
/* 5-10-93 */
{
        VDLEntry *vdle;
        /* Since this is an internal routine (not called by user), */
        /* I'm not going to check validity of ptrs, item #'s, etc */
        /* JCR Later, we must check via the screen group list mechanism. */
        vdle = vdl->vdl_DataPtr;
        if (GrafBase->gf_CurrentVDLEven == vdle)
                return(TRUE);
        if (GrafBase->gf_CurrentVDLOdd == vdle)
                return(TRUE);
        return(FALSE);
}



Item
SubmitVDL( VDLEntry *VDLDataPtr, int32 length, int32 type )
        /* Input: ptr to his list of VDLEntry's, and its length in words */
{
        Item retvalue,vdlItem;
        VDL *vdl;
        VDLEntry *Proof_new_loc; /* source,dest of copy */

        switch (type)  /* JCR */
                {
                case VDLTYPE_FULL:
                        break;
                case VDLTYPE_SIMPLE:
                        break;
                case VDLTYPE_COLOR:
                        break;
                case VDLTYPE_ADDRESS:
                        /* type not yet implemented */
                        retvalue = GRAFERR_NOTYET;
                        goto DONE;
                        break;
                case VDLTYPE_DYNAMIC:
                        /* type not yet implemented */
                        retvalue = GRAFERR_NOTYET;
                        goto DONE;
                        break;
                }

        /* Proof and relocate user's VDLEntry list. */
        /* Return ptr to new sys ram location. */
```

```
        Proof_new_loc = ProofVDLEntry(VDLDataPtr,length);
        if ((int32)Proof_new_loc < 0)
                {
                retvalue = (int32) Proof_new_loc;
                goto DONE; /* Invalid VDLEntry(s) */
                }
        vdlItem = SuperCreateItem( MKNODEID(NODE_GRAPHICS, TYPE_VDL), NULL );
        if ( (int32)vdlItem < 0 )
                {
                retvalue = (int32)vdlItem;
                goto DONE;
                }
        /* Pt. to VDL struct just created */
        vdl = (VDL *)LookupItem( vdlItem );
        vdl->vdl_Type = type;
        vdl->vdl_DataPtr = Proof_new_loc;
        vdl->vdl_DataSize = length*sizeof(VDLEntry); /* for SUPER_FREEMEM() */
        retvalue=vdlItem;
DONE:
        return( (Item)retvalue );
}


Item
SetVDL( Item screenItem, Item vdlItem )
/* Connect the screen and the vdl so that submitting the screen for display
 * will result in the display of the vdl.
 *
 * If the vdl is currently being displayed, an error is returned.
 * If the screen will be displayed
 * (as seen by the group's screen pointers), then this returns an error.
 * If the screen is currently
 * being displayed but another screen has already been specified to take over,
 * no error arises.
 */
{
  VDL *vdl;
  Screen *screen;
  Item cur_vdl_item;

  if ( (vdl = (VDL *)CheckItem( vdlItem, NODE_GRAPHICS, TYPE_VDL )) == 0 ) {
    /* bad VDL Item number */
    return GRAFERR_BADITEM;
  }
  if (vdl->vdl.n_Owner != CURRENTTASK->t.n_Item) {
    PRINTNOTOWNER (vdl->vdl.n_Item, CURRENTTASK->t.n_Item);
    return GRAFERR_NOTOWNER;
  }

  if ( (screen = (Screen *)CheckItem( screenItem, NODE_GRAPHICS, TYPE_SCREEN )) == 0 ) {
    /* bad screen Item number */
    return GRAFERR_BADITEM;
  }
  if (screen->scr.n_Owner != CURRENTTASK->t.n_Item) {
    PRINTNOTOWNER (screen->scr.n_Item, CURRENTTASK->t.n_Item);
    return GRAFERR_NOTOWNER;
  }

#if 0
/* It seems to me that there's no problem linking an in use VDL to a screen - SHL 9307.23 */
  if ( IsVDLInUse( vdl ) ) {
    /* VDL in use */
    return GRAFERR_VDLINUSE;
  }
#endif

  cur_vdl_item= screen->scr_VDLItem; /* save, for return */

  /* Now we must interlink VDL and Screen, as we do in CreateScreenGroup()*/
  vdl->vdl_ScreenPtr = screen;
  screen->scr_VDLPtr = vdl; /* Back Acha */
  /* JCR */
  screen->scr_VDLItem = vdlItem; /* for next call */
  screen->scr_VDLType = vdl->vdl_Type;

  return cur_vdl_item;
}

void  /* Temp, until WaitVBL truely works */
jacks_waitVBL()         /* rewritten 9606.15 - SHL */
        {
        int32 i=GrafBase->gf_VBLNumber;
```

```
        while(i==GrafBase->gf_VBLNumber);
        }

void
ween_HW_from_VDL(VDLEntry *addr)        /* rewritten 9606.15 - SHL */
        {
#if 0
        int32 waited=0;
        if ( GrafBase->gf_CurrentVDLEven == addr )
                {
                jacks_waitVBL();
                waited=1;
                GrafBase->gf_CurrentVDLEven = GrafBase->gf_VDLBlank;
                }
        if ( GrafBase->gf_CurrentVDLOdd == addr )
                {
                if (!waited)
                        {
                        jacks_waitVBL();
                        }
                GrafBase->gf_CurrentVDLOdd = GrafBase->gf_VDLBlank;
                }
#endif
        if (GrafBase->gf_CurrentVDLEven == addr) {
          GrafBase->gf_CurrentVDLEven = GrafBase->gf_VDLBlank;
        }
        if (GrafBase->gf_CurrentVDLOdd == addr)  {
          GrafBase->gf_CurrentVDLOdd = GrafBase->gf_VDLBlank;
        }
        jacks_waitVBL();
        jacks_waitVBL();
        }


Item
internalCreateVDL( VDL *vdl, void *args )
{
  return vdl->vdl.n_Item;
}


Item
internalOpenVDL( VDL *vdl, void *args )
{
  return GRAFERR_NOTYET;
}



int32
internalCloseVDL (VDL *vdl, Task *t)
{
  return GRAFERR_NOTYET;
}


int32
internalDeleteVDL (VDL *vdl, Task *t)
{
  /* JCR */
  VDLEntry *addr;
  /* Free sys RAM used to store VDLEntry's */
  /* Save addr to free. */
  addr = vdl->vdl_DataPtr;
  /* Dont change horses in the middle of a screen. */
  /* IF the HW is currently dependent on this addr, ween it */
  ween_HW_from_VDL(addr);
  /* ALLOC for VDL data could have failed! JCR */
  if (addr != (VDLEntry *)NULL) {
    SUPER_FREEMEM(addr,vdl->vdl_DataSize);
  }
  return 0;
}


/*************************************************/
/* Proof user supplied VDLEntry list for a screen. */
/* As we proof, we copy into sys ram. The new VDL */
/* list will be compressed, eg. spaces due to "skipping" ptrs */
/* in the submitted VDL list will be squeezed out. */

/* RETURN: address of sys ram holding proofed ('proven'?) VDl list.*/
```

```
#define VDL_BADMASK (0xf8000000|VDL_640SC|VDL_SLIPEN|VDL_SLIPCOMMSEL)
#define VDL_BADCTRLMASK (VDL_NULLAMY|VDL_PALSEL|VDL_S640SEL)

VDLEntry
*ProofVDLEntry(VDLEntry *VDLDataPtr, int32 length)
{
  register int32 Vword;
  register VDLEntry *CLUTptr, *CEnd;
  register VDLEntry *curD, *DEnd;
  int32 rel,p,len,cur_base,numlines;
  VDLEntry *post_patch,*patch_ptr,*retvalue,mode,*CLUTptrN;

  CLUTptr = VDLDataPtr;

  if (length < 5) {              /* SHL 9306.12 */
    DEVBUG (("VDL Rejected - bad length (%ld)\n", length));
    goto ERR;                    /* SHL 9306.12 */
  }
  cur_base = (int32)CLUTptr;     /* (int32)ptr to base of his current VDL */
  curD = (VDLEntry*)SUPER_ALLOCMEM ((sizeof(VDLEntry)*length), MEMTYPE_VRAM|MEMTYPE_DMA);
  if ( curD == NULL ) {
    /* out of memory */
    DEVBUG (("VDL Rejected - unable to allocate VRAM\n"));
    return (VDLEntry *)GRAFERR_NOMEM;
  }
  retvalue = curD;
  DEnd = curD+length;                    /* SHL 9306.12 */
  CEnd = CLUTptr+length;                 /* SHL 9306.12 */
  numlines = 240;                        /* SHL 9306.12 */

  do {
    if (curD+4>DEnd) {
      DEVBUG (("VDL Rejected - system copy of VDL exceeded specified length\n"));
      goto ERR;
    }

    Vword = (int32) *CLUTptr++; /* Get DMA CTRL word */
    if (Vword & VDL_BADMASK) {
      DEVBUG (("VDL Rejected - DMA control word at 0x%lx has illegal/reserved bits set\n",
               (int32)(CLUTptr-1)));
      goto ERR; /* Any bits set in the BADMASK are currently disallowed */
    }
    len = (Vword & VDL_LEN_MASK) >> VDL_LEN_SHIFT;
    if (len<1||len>34) {                 /* SHL 9306.12 */
      DEVBUG (("VDL Rejected - DMA control word at 0x%lx specifies bad length\n",
               (int32)(CLUTptr-1)));
      DEVBUG (("SC portion of VDL must be at least 1 and no more than 34 words\n"));
      goto ERR;                  /* SHL 9306.12 */
    }
    p = (Vword & VDL_LINE_MASK) >> VDL_LINE_SHIFT;
    numlines -= p;                       /* SHL 9306.12 */
    if (p==0) {
      Vword |= (numlines<<VDL_LINE_SHIFT);
      numlines = 0;              /* SHL 9306.12 */
    }
    mode = (Vword & VDL_DISPMOD_MASK) >> 23;
    if ( mode>=5) {
      DEVBUG (("VDL Rejected - DMA control work at 0x%lx contains illegal display mode\n",
               (int32)(CLUTptr-1)));
      goto ERR;  /* 5,6,7 illegal */
    }
    rel = Vword & VDL_RELSEL; /* set if ptr to next CLUT relative */
    /* Word 0 ok. Copy. */
    *curD++ = Vword & ~VDL_RELSEL; /* Do abs, regardless of his scheme*/
    /* copy 2 FB ptrs */
    *curD++ = *CLUTptr++;
    *curD++ = *CLUTptr++;
    /* calc ptr to user's next VDL */
    CLUTptrN =  (VDLEntry *)*CLUTptr++;
    if (rel) {
      CLUTptrN += cur_base/sizeof(VDLEntry) + 4;        /* SHL 9306.12 */
    }
    cur_base = (int32)CLUTptrN;
    post_patch = patch_ptr = curD++;
    if (curD+len>DEnd) {
      DEVBUG (("VDL Rejected - system copy of VDL exceeded specified length\n"));
      goto ERR;
    }
    /* copy pallete as is */
    for (p=0; p< len; p++) {
      VDLEntry v;
```

Oct 28 12:07 1993 vdl.c Page 4

```
      v = *CLUTptr++;
      if (v&VDL_CONTROL) {
        if ((v&VDL_DISPCTRL)==VDL_DISPCTRL) {
          if ((v&VDL_BADCTRLMASK)&&((v&0x1e000000)||(v&VDL_BACKGROUND))) {
            DEVBUG (("VDL Rejected - display control word at 0x%lx has illegal/reserved flags\n",
                     (int32)(CLUTptr-1)));
            goto ERR;
          }
        } else {
          DEVBUG (("VDL Rejected - AMY control code at 0x%lx\n", (int32)(CLUTptr-1)));
          goto ERR;
        }
      }
      *curD++ = v;
    }
    curD = (VDLEntry *)(((int32)curD+15)&0xfffffff0);   /* force 4 word alignment - SHL 9306.12 */
    *patch_ptr = (VDLEntry)curD;
    CLUTptr = CLUTptrN; /*  follow link to next VDL in source */
  } while (CLUTptr<CEnd && curD<DEnd && numlines>0);    /* SHL 9306.12 */
  if (numlines<0) {                                     /* SHL 9306.12 */
    DEVBUG (("VDL Rejected - VDL list attempts too many lines of display\n"));
    goto ERR;                                           /* SHL 9306.12 */
  }
  if (curD>DEnd) {
    Superkprintf ("Error - VDL size overrun - possible security breach!\n");
    Superkprintf ("curD: %08lx  DEnd: %08lx\n", curD, DEnd);
    while (1);
  }
  *post_patch = (VDLEntry)GrafBase->gf_VDLPostDisplay;

  return retvalue;


ERR:
  return (VDLEntry *)GRAFERR_PROOF_ERR;
}
```

Oct 28 12:07 1993 intgraf.c Page 1

```
/* ************************************************************************
 *
 * Graphics routines for the Opera Hardware
 *
 * Copyright (C)        New Technologies Group, Inc.
 * NTG Trade Secrets  -  Confidential and Proprietary
 *
 * The contents of this file were designed with tab stops of 4 in mind
 *
 * DATE   NAME              DESCRIPTION
 * ------ ---------------- ----------------------------------------------
 * 930830 SHL               Split CreateBitmap out of CreateScreenGroup
 * 930706 SHL               Commented out all pre-red support
 * 930617 SHL               changed all GEnable/GDisable to Enable/Disable
 * 930301 -RJ               Moved MSYSBits bit setting to MCTL
 * 920909 -RJ               Incorporate recent changes from Dale & Stephen
 * 920724 -RJ Mical         Start overhaul
 * 920717 Stephen Landrum   Last edits before July handoff
 *
 * ********************************************************************** */

#define SSSDBUG(x) /* Superkprintf x */

/*****************************************************************\
* Header files
\*****************************************************************/

#include "types.h"

#include "mem.h"

#include "debug.h"
#include "item.h"
#include "nodes.h"
#include "interrupts.h"
#include "kernel.h"
#include "list.h"
#include "task.h"
#include "folio.h"
#include "kernelnodes.h"
#include "super.h"

#include "intgraf.h"

#include "stdarg.h"
#include "strings.h"
#include "stdio.h"

#include "inthard.h"
#include "clio.h"


/*****************************************************************\
* Data & necessary structures
\*****************************************************************/


void *(*GrafSWIFuncs[])() = {
  (void *(*)())realCreateScreenGroup,   /* 50 */
  (void *(*)())NULROUTINE,       /* 49 */
  (void *(*)())SubmitVDL,        /* 48 */
  (void *(*)())SetVDL,           /* 47 */
//  (void *(*)())DeleteVDL,      /* 46 */
  (void *(*)())NULROUTINE,       /* 46 */
  (void *(*)())DisplayScreen,    /* 45 */
//  (void *(*)())DeleteScreenGroup,     /* 44 */
  (void *(*)())NULROUTINE,       /* 44 */
  (void *(*)())NULROUTINE,       /* 43 */
//  (void *(*)())CopyRect,       /* 42 */
  (void *(*)())SetCEWatchDog,    /* 42 */
  (void *(*)())SetCEControl,     /* 41 */
  (void *(*)())NULROUTINE,       /* 40 */
  (void *(*)())DrawCels,         /* 39 */
  (void *(*)())DrawText8,        /* 38 */
  (void *(*)())GetCurrentFont,   /* 37 */
  (void *(*)())SetCurrentFontCCB,       /* 36 */
```

```
  (void *(*)())FillRect,          /* 35 */
  (void *(*)())NULROUTINE,        /* 34 */
  (void *(*)())DrawTo,            /* 33 */
  (void *(*)())NULROUTINE,        /* 32 */
  (void *(*)())DrawChar,          /* 31 */

//  (void *(*)())swiSuperCloseFont,      /* 30 */
  (void *(*)())NULROUTINE,        /* 30 */
  (void *(*)())DrawText16,        /* 29 */
//??? (void *(*)())NULROUTINE,    /* 30 */
//??? (void *(*)())NULROUTINE,    /* 29 */

//???   (void *(*)())OpenFileFont,       /* 28 */
  (void *(*)())NULROUTINE,        /* 28 */

  (void *(*)())swiSuperOpenRAMFont,      /* 27 */
//  (void *(*)())SetFileFontCacheSize,   /* 26 */
  (void *(*)())NULROUTINE,        /* 26 */
//??? (void *(*)())NULROUTINE,    /* 26 */

//  (void *(*)())swiSuperOpenFileFont,   /* 25 */
  (void *(*)())NULROUTINE,        /* 25 */
//  (void *(*)())FillEllipse,       /* 24 */
  (void *(*)())NULROUTINE,        /* 24 */
  (void *(*)())DrawScreenCels,    /* 23 */
  (void *(*)())NULROUTINE,        /* 22 */
  (void *(*)())NULROUTINE,                /* 21 */
  (void *(*)())SetClipHeight,     /* 20 */
  (void *(*)())SetClipWidth,      /* 19 */
  (void *(*)())RemoveScreenGroup,         /* 18 */
  (void *(*)())AddScreenGroup,    /* 17 */
  (void *(*)())NULROUTINE,        /* 16 */
  (void *(*)())NULROUTINE,        /* 15 */
  (void *(*)())swiSuperResetCurrentFont,          /* 14 */
  (void *(*)())SetScreenColors, /* 13 */
  (void *(*)())NULROUTINE,        /* 12 */
//  (void *(*)())ResetSystemGraphics,    /* 11 */
  (void *(*)())NULROUTINE,        /* 11 */
  (void *(*)())ResetScreenColors,         /* 10 */
  (void *(*)())SetScreenColor,    /* 9 */
  (void *(*)())DisableHAVG,       /* 8 */
  (void *(*)())EnableHAVG,        /* 7 */
  (void *(*)())DisableVAVG,       /* 6 */
  (void *(*)())EnableVAVG,        /* 5 */
//  (void *(*)())WaitForLine,       /* 4 DEFUNCT. 5-10-93 JCR */
  (void *(*)())NULROUTINE,        /* 4 */
  (void *(*)())SetClipOrigin,     /* 3 */
  (void *(*)())ResetReadAddress,          /* 2 */
  (void *(*)())SetReadAddress,    /* 1 */
//  (void *(*)())GrafInit,          /* 0 */
  (void *(*)())NULROUTINE,        /* 0 */
};


void *(*GrafUserFuncs[])() = {
  /* Front end patches for kludgy routines that should be rewritten */
  (void *(*)())NULROUTINE,        /* -49 */
  (void *(*)())NULROUTINE,        /* -48 */
  (void *(*)())NULROUTINE,        /* -47 */
  (void *(*)())NULROUTINE,        /* -46 */
  (void *(*)())kSetCEWatchDog,    /* -45 */
  (void *(*)())kDrawScreenCels, /* -44 */
  (void *(*)())kDrawCels,         /* -43 */
  (void *(*)())kSubmitVDL,        /* -42 */
  (void *(*)())kSetVDL, /* -41 */
  (void *(*)())kDisplayScreen,    /* -40 */
  (void *(*)())NULROUTINE,        /* -39 */
  (void *(*)())kSetCEControl,     /* -38 */
  (void *(*)())kDrawText8,        /* -37 */
  (void *(*)())kGetCurrentFont, /* -36 */
  (void *(*)())kSetCurrentFontCCB,        /* -35 */
  (void *(*)())kFillRect,         /* -34 */
  (void *(*)())kDrawTo, /* -33 */
  (void *(*)())kDrawChar,         /* -32 */
  (void *(*)())NULROUTINE,        /* -31 */
  (void *(*)())MoveTo,  /* -30 */
  (void *(*)())kSetClipHeight,    /* -29 */
  (void *(*)())kSetClipWidth,     /* -28 */
  (void *(*)())kRemoveScreenGroup,        /* -27 */
  (void *(*)())kAddScreenGroup, /* -26 */
  (void *(*)())SetBGPen,          /* -25 */
```

Oct 28 12:07 1993 intgraf.c Page 2

```
  (void *(*)())SetFGPen,          /* -24 */
  (void *(*)())DeleteScreenGroup,         /* -23 */
  (void *(*)())kSetScreenColors,          /* -22 */
  (void *(*)())kResetScreenColors,        /* -21 */
  (void *(*)())kSetScreenColor, /* -20 */
  (void *(*)())kDisableHAVG,      /* -19 */
  (void *(*)())kEnableHAVG,       /* -18 */
  (void *(*)())kDisableVAVG,      /* -17 */
  (void *(*)())kEnableVAVG,       /* -16 */
  (void *(*)())kSetClipOrigin,  /* -15 */
  (void *(*)())kResetReadAddress,         /* -14 */
  (void *(*)())kSetReadAddress, /* -13 */

  /* User functions for graphics folio */
  (void *(*)())CreateScreenGroup,         /* -12 */
  (void *(*)())ResetCurrentFont,          /* -11 */
//  (void *(*)())CloseFont,       /* -10 */
  (void *(*)())NULROUTINE,        /* -10 */

  (void *(*)())kDrawText16,       /* -9 */
//  (void *(*)())NULROUTINE,      /* -9 */

//  (void *(*)())OpenFileFont,    /* -8 */
  (void *(*)())NULROUTINE,        /* -8 */
//  (void *(*)())OpenRAMFont,     /* -7 */
  (void *(*)())NULROUTINE,        /* -7 */

//  (void *(*)())kSetFileFontCacheSize, /* -6 */
  (void *(*)())NULROUTINE,        /* -6 */

  (void *(*)())WritePixel,        /* -5 */
  (void *(*)())GetPixelAddress, /* -4 */
  (void *(*)())ReadCLUTColor,     /* -3 */
  (void *(*)())ReadPixel,         /* -2 */
  (void *(*)())MapCel,  /* -1 */
};

#define NUM_GRAFSWIFUNCS (sizeof(GrafSWIFuncs)/sizeof(void *))
#define NUM_GRAFUSERFUNCS (sizeof(GrafUserFuncs)/sizeof(void *))

struct NodeData GrafNodeData[] = {
  { 0, 0 },
  { sizeof(ScreenGroup), NODE_ITEMVALID },
  { sizeof(Screen), NODE_ITEMVALID },
  { sizeof(Bitmap), NODE_ITEMVALID },
  { sizeof(VDL), NODE_ITEMVALID },
};

#define GRAFNODECOUNT (sizeof(GrafNodeData)/sizeof(NodeData))


TagArg GrafFolioTags[] = {
  /* size of graphics folio */
  { CREATEFOLIO_TAG_DATASIZE,   (void *) sizeof (GrafFolio) },
  /* number of SWI functions */
  { CREATEFOLIO_TAG_NSWIS,      (void *) NUM_GRAFSWIFUNCS },
  /* number of user functions */
  { CREATEFOLIO_TAG_NUSERVECS,  (void *) NUM_GRAFUSERFUNCS },
  /* list of swi functions */
  { CREATEFOLIO_TAG_SWIS,       (void *) GrafSWIFuncs },
  /* list of user functions */
  { CREATEFOLIO_TAG_USERFUNCS,  (void *) GrafUserFuncs },
  /* name of graphics folio */
  { TAG_ITEM_NAME,      (void *) "Graphics" },
  /* initialization code */
  { CREATEFOLIO_TAG_INIT,       (void *) ((long)InitGrafBase) },
  /* we have to be item #1 */
  { CREATEFOLIO_TAG_ITEM,       (void *) GRAPHICSFOLIO },
  /* for lack of a better value */
  { TAG_ITEM_PRI,       (void *) 0 },
  /* Graphics node database */
  { CREATEFOLIO_TAG_NODEDATABASE,       (void *) GrafNodeData },
  /* number of nodes */
  { CREATEFOLIO_TAG_MAXNODETYPE,        (void *) GRAFNODECOUNT },
  /* end of tag list */
  { 0,                          (void *) 0 },
};

extern void graphicsFirq (void);

TagArg GraphicsFirqTags[] =
        {
```

```
        TAG_ITEM_PRI,    (void *)250,
        TAG_ITEM_NAME,   (void *)"Graphics FIRQ",
        CREATEFIRQ_TAG_CODE,     (void *)((long)graphicsFirq),
        CREATEFIRQ_TAG_NUM,      (void *)INT_V1,
        TAG_ITEM_END,    (void *)0,
        };

TagArg CelSemaphoreTags[] =
        {
        TAG_ITEM_NAME,   (void *)"Graphix Cel",
        TAG_ITEM_END,    (void *)0,
        };

TagArg TimeoutTimerTags[] = {
  CREATETIMER_TAG_NUM,  (void *)2,
  0, 0,
};


int32 _rwmod[][2] = {
  32,    RMOD_32    | WMOD_32,
  64,    RMOD_64    | WMOD_64,
  96,    RMOD_96    | WMOD_96,
  128,   RMOD_128   | WMOD_128,
  160,   RMOD_160   | WMOD_160,
  256,   RMOD_256   | WMOD_256,
  320,   RMOD_320   | WMOD_320,
  384,   RMOD_384   | WMOD_384,
  512,   RMOD_512   | WMOD_512,
  576,   RMOD_576   | WMOD_576,
  640,   RMOD_640   | WMOD_640,
  1024,  RMOD_1024  | WMOD_1024,
  1056,  RMOD_1056  | WMOD_1056,
  1088,  RMOD_1088  | WMOD_1088,
  1152,  RMOD_1152  | WMOD_1152,
  1280,  RMOD_1280  | WMOD_1280,
  1536,  RMOD_1536  | WMOD_1536,
  2048,  RMOD_2048  | WMOD_2048,
  0,     0,
};

extern long linewidth;  /* set by main() in operator.c */

List ScreenGroupList, ScreenList;


extern bool isUser(void);

/*****************************************************************\
* Code
\*****************************************************************/


#if (MODE==_MODE_developer)
void
printnotowner(Item it, Item t)
{
  if (isUser()) {
    printf ("Task %lx does not own item %lx\n", t, it);
  } else {
    Superkprintf ("Task %lx does not own item %lx\n", t, it);
  }
}
#endif

Item
NULROUTINE (void)
{
        return GRAFERR_NOTYET;
}


long
InitGrafBase (GrafFolio *gb)
{
  Item firql;
  long retvalue;
  int32 i;

  SDEBUGGRAF (("Initializing Graphics folio\n"));

  GrafBase = gb;                                        /* Where am I located? */
```

Oct 28 12:07 1993 intgraf.c Page 3

```
  SDEBUGGRAF (("GrafBase = %lx\n", GrafBase));

  GrafBase->gf.f_ItemRoutines->ir_Delete = (internalDeleteGrafItem);
  GrafBase->gf.f_ItemRoutines->ir_Find = (internalFindGrafItem);
  GrafBase->gf.f_ItemRoutines->ir_Open = (internalOpenGrafItem);
  GrafBase->gf.f_ItemRoutines->ir_Close = (internalCloseGrafItem);
  GrafBase->gf.f_ItemRoutines->ir_Create = (internalCreateGrafItem);

  GrafBase->gf_VBLNumber = 0;
  GrafBase->gf_VRAMPageSize = (ulong)GetPageSize(MEMTYPE_VRAM);

  /*??? GrafBase->gf_DefaultDisplayWidth = DISPLAY_WIDTH;*/
  GrafBase->gf_DefaultDisplayWidth = linewidth;
  GrafBase->gf_DefaultDisplayHeight = DISPLAY_HEIGHT;

  GrafBase->gf_VBLTime = 16684; /* number of usec between VBLs */
  /* calculate approximate frequency of VBL in Hz */
  GrafBase->gf_VBLFreq = (1000000+GrafBase->gf_VBLTime/2)/GrafBase->gf_VBLTime;

    {
      uint32 *mctlptr, cpsr;
      mctlptr = (ulong *)(MCTL);
      cpsr = Disable ();
      *mctlptr |= (CLUTXEN | VSCTXEN);
      Enable(cpsr);
    }

  /* Dale added some stuff here */
    {
      /* create a semaphore for access to the cel engine */
      GrafBase->gf_CelSemaphore =
        SuperCreateItem(MKNODEID(KERNELNODE,SEMA4NODE), &CelSemaphoreTags);
      if (GrafBase->gf_CelSemaphore < 0)
        {
          SDEBUG(("Unable to create Semaphore for Cel Engine\n"));
          retvalue = GrafBase->gf_CelSemaphore;
          goto DONE;
        }

    }

  GrafBase->gf_Flags = 0;

  SDEBUGGRAF(("Alloc memory for zero and one pages for SPORT transfer\n"));
  GrafBase->gf_VIRSPage = SUPER_ALLOCMEM ((int32)(2*GrafBase->gf_VRAMPageSize),
                                          (uint32)MEMTYPE_VRAM|MEMTYPE_STARTPAGE);
  if (!GrafBase->gf_VIRSPage)
    {
      SDEBUG (("Unable to allocate memory for VIRS line\n"));
      retvalue = GRAFERR_NOMEM;
      goto DONE;
    }
  memset(GrafBase->gf_VIRSPage, 0, (int32)(2*GrafBase->gf_VRAMPageSize));

  {
    uint32 *p;
    p = (uint32*)GrafBase->gf_VIRSPage + 17;     /* 35 */
    i = 148;                                     /* 295 */
    while (--i>=0) {
      *p++ = MakeRGB15Pair(1,1,1);
    }
    i = 73;                                      /* 147 */
    while (--i>=0) {
      *p++ = MakeRGB15Pair(2,2,2);
    }
  }

  GrafBase->gf_ZeroPage = (void *)((int32)GrafBase->gf_VIRSPage+GrafBase->gf_VRAMPageSize);

  retvalue = BuildSystemVDLs();
  if ( retvalue < 0 ) goto DONE;

/*???   InitList( &ScreenGroupList, "ScreenGroupList" );*/
/*???   GrafBase->gf_ScreenGroupListPtr = &ScreenGroupList;*/
/*???   InitList( &ScreenList, "ScreenList" );*/
/*???   GrafBase->gf_ScreenListPtr = &ScreenList;*/

  {
    ulong temp;
    temp = Disable ();
```

```
    SDEBUGGRAF (("Adding Graphics FIRQ handler\n"));
    firql = SuperCreateItem(MKNODEID(KERNELNODE,FIRQNODE), GraphicsFirqTags);
    if ( (int32)firql < 0 )
      {
        SDEBUG (("Unable to add Graphics FIRQ handler (%d)\n", firql));
        retvalue = (int32)firql;
        goto DONE;
      }

#if 0
    SDEBUGGRAF (("Adding SPORT transfer FIRQ handler\n"));
    if ( (i = (int32)createSPORTDriver()) < 0 )
      {
        SDEBUG (("Error initializing SPORT Firq handler\n"));
        retvalue = i;
        goto DONE;
      }
#endif

    SDEBUGGRAF (("CPSR = 0x%lx\n", temp));

    Enable (temp);
  ]

  {
    int32 height;
    height = (GrafBase->gf_DefaultDisplayHeight / 2);
/*???   for ( color = 255 - (64 * 3); color <= 255; color += 64 )*/
/*???           {*/
/*???           ptr = (long *)GrafBase->gf_VDLBlank;*/
/*???           color2 = (color * 3) / 4;*/
/*???           for ( loop = 0; loop < height; loop++ )*/
/*???                   {*/
/*???                   ptr++;*/
/*???                   ptr++;*/
/*???                   ptr++;*/
/*???*/
/*???                   nextptr = (long *)*ptr++;*/
/*???*/
/*???                   ptr++;*/
/*???                   *ptr++ = VDL_DISPCTRL|VDL_BACKGROUND*/
/*???                           | (color << 16) | (0x10 << 8) | (color << 0);*/
/*???                           | (color << 16) | (color2 << 8) | (0x10 << 0);*/
/*???                   ptr = nextptr;*/
/*???                   }*/
/*???           WaitVBL();*/
/*???           }*/

  }

//??? #ifdef WHOLE_THING_NOT_IN_LIB
//???   InitFontTree();
//??? #endif

  {
    Item t;
    t = SuperCreateItem (MKNODEID(KERNELNODE,TIMERNODE), TimeoutTimerTags);
    if (t<0) {
      retvalue = t;
      goto DONE;
    }
    GrafBase->gf_TimeoutTimer = (Timer*) LookupItem (t);
  }

  retvalue = InitFontStuff();
  if ( retvalue < 0 ) goto DONE;

  retvalue = 0;

  SDEBUGGRAF (("Returning from InitGrafBase\n"));

DONE:
  return( retvalue );
}


int32
SetCEControl( Item bitmapItem, int32 controlWord, int32 controlMask )
{
  Bitmap *bitmap;
```

```
  SDEBUG(("SetCEControl( "));
  SDEBUG(("bitmapItem=$%lx ", (unsigned long)(bitmapItem)));
  SDEBUG(("controlWord=$%lx ", (unsigned long)(controlWord)));
  SDEBUG(("controlMask=$%lx ", (unsigned long)(controlMask)));
  SDEBUG((" )\n"));

  bitmap = (Bitmap *)CheckItem( bitmapItem, NODE_GRAPHICS, TYPE_BITMAP );
  if ( !bitmap ) {
    return GRAFERR_BADITEM;
  }
  if (bitmap->bm.n_Owner != CURRENTTASK->t.n_Item) {
    if (ItemOpened(CURRENTTASK->t.n_Item,bitmapItem)<0) {
      PRINTNOTOWNER (bitmap->bm.n_Item, CURRENTTASK->t.n_Item);
      return GRAFERR_NOTOWNER;
    }
  }

  bitmap->bm_CEControl = (bitmap->bm_CEControl & ~controlMask) | (controlWord & controlMask);

  return 0;
}


void *
GetPixelAddress( Item screenItem, Coord x, Coord y )
/*
 * Return the address of the specified pixel in the screen.
 * A read outside the bitmap boundaries returns a value of NULL.
 */
{
  void *retvalue;
  Bitmap *bitmap;
  Screen *screen;

  retvalue = NULL;

  screen = (Screen *)CheckItem( screenItem, NODE_GRAPHICS, TYPE_SCREEN );
  if ( !screen ) {
    goto DONE;
  }

/*???*/
  bitmap = screen->scr_TempBitmap;

  if ( x < 0 || x >= (bitmap->bm_ClipWidth) || y < 0 || y >= (bitmap->bm_ClipHeight) )
    goto DONE;

  retvalue = (void *)(bitmap->bm_Buffer + (((y>>1)*bitmap->bm_Width)<<2) + ((y&1)<<1) + (x<<2));

DONE:
  return( retvalue );
}


int32
DrawScreenCels( Item screenItem, CCB *ccb)
/*
 * Draw cels into the display, following the CCB chain
 */
{
  Screen *screen;

  SDEBUG(("DrawScreenCels( "));
  SDEBUG(("screenItem=$%lx ", (unsigned long)(screenItem)));
  SDEBUG(("ccb=$%lx ", (unsigned long)(ccb)));
  SDEBUG((" )\n"));

  screen = (Screen *)CheckItem( screenItem, NODE_GRAPHICS, TYPE_SCREEN );
  if ( !screen ) {
    return GRAFERR_BADITEM;
  }
  if (screen->scr.n_Owner != CURRENTTASK->t.n_Item) {
    if (ItemOpened(CURRENTTASK->t.n_Item,screenItem)<0) {
      PRINTNOTOWNER (screen->scr.n_Item, CURRENTTASK->t.n_Item);
      return GRAFERR_NOTOWNER;
    }
  }

/*???*/
  return DrawCels( screen->scr_TempBitmap->bm.n_Item, ccb );
```

```
}

#ifdef UNDEF
int32
bigpad1( int32 arg )
{
        int32 i;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;

        return( i );
}

int32
bigpad2( int32 arg )
{
        int32 i;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;

        return( i );
```

```
}

int32
bigpad3( int32 arg )
{
        int32 i;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;

        return( i );
}

int32
bigpad4( int32 arg )
{
        int32 i;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;

        return( i );
}
```

```
int32
bigpad5( int32 arg )
{
        int32 i;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;

        return( i );
}

int32
bigpad6( int32 arg )
{
        int32 i;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;

        return( i );
}

int32
bigpad7( int32 arg )
```

```
{
        int32 i;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;

        return( i );
}

int32
bigpad8( int32 arg )
{
        int32 i;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
        arg = i * 2 * arg;
        for ( ; i < 256; i++ ) arg *= 2;
        i++;
        i = arg;
/*???   arg = i * 2 * arg;*/
        for ( ; i < 256; i++ ) arg *= 2;
        i++;

/*???   i = i * 2 * arg;*/
        i = i * 2 * arg;

        return( i );
}

void postbig1( void )
```

```
[
}

#endif /* of #ifdef UNDEF */


/* WARNING WARNING WARNING WARNING WARNING WARNING WARNING WARNING */
/*                                                                 */
/* The cel engine hardware has              bugs in it.            */
/* Do not attempt mess with the DrawCels routine.                  */
/*                                                                 */
/* WARNING WARNING WARNING WARNING WARNING WARNING WARNING WARNING */

int32
DrawCels( Item bitmapItem, CCB *ccb )
/*
 * Draw cels into the display, following the CCB chain
 */
{
  int32 retvalue;
  Bitmap *bitmap;
  uint32 t1, tid, state;
  Timer *timer;
  /* This routine should be in supervisor mode */

  SDEBUG(("DrawCels( "));
  SDEBUG(("bitmapItem=$%lx ", (unsigned long)(bitmapItem)));
  SDEBUG(("ccb=$%lx ", (unsigned long)(ccb)));
  SDEBUG((" )\n"));

  bitmap = (Bitmap *)CheckItem( bitmapItem, NODE_GRAPHICS, TYPE_BITMAP );
  if ( !bitmap ) {
    return GRAFERR_BADITEM;
  }
  if (bitmap->bm.n_Owner != CURRENTTASK->t.n_Item) {
    if (ItemOpened(CURRENTTASK->t.n_Item,bitmapItem)<0) {
      PRINTNOTOWNER (bitmap->bm.n_Item, CURRENTTASK->t.n_Item);
      return GRAFERR_NOTOWNER;
    }
  }

  SuperLockSemaphore (GrafBase->gf_CelSemaphore, 1);

  t1 = bitmap->bm_WatchDogCtr;
  timer = GrafBase->gf_TimeoutTimer;
  tid = timer->tm_ID;
  (*timer->tm_Control) (timer, 0, TIMER_ALLBITS);
  (*timer->tm_Load) (tid-1, t1&0xffff, 0xffff);
  (*timer->tm_Load) (tid, (t1>>16)+1, 0x0000);
  (*timer->tm_Control) (timer, TIMER_CASCADE|TIMER_DECREMENT|TIMER_RELOAD, 0);

  *CCBCTL0 = bitmap->bm_CEControl;
  *REGCTL0 = bitmap->bm_REGCTL0;
  *REGCTL1 = bitmap->bm_REGCTL1;
  *REGCTL2 = bitmap->bm_REGCTL2;
  *REGCTL3 = bitmap->bm_REGCTL3;
  *NEXTPTR = (ulong)ccb;
  *SPRSTRT = 0; /* GO */

  retvalue = 0;

  state = 1;

  while( *STATBits & SPRON ) {
    /* Here because of an interrupt
     * and the Cel engine has more to do.
     * Is there a higher priority task waiting?
     * If so, go, return here when we are highest priority
     */
    if (*STATBits & SPRPAU) {
      if ( (KernelBase->kb_PleaseReschedule) ) {
        /* Stop timer during task switch */
        (*timer->tm_Control) (timer, 0, TIMER_DECREMENT);
        SuperSwitch();
        /* Restart timer upon return */
        (*timer->tm_Control) (timer, TIMER_DECREMENT, 0);
      }

      if (state) {
//      if ((*timer->tm_Read)(tid)==0x0000) {
        if (((HardTimer*)Timer0)[tid].ht_cnt==0x0000) {
          *SPRPAUS = 0;          /* If timed out, issue pause request */
```

```
            state--;
          }
        } else {
          retvalue = GRAFERR_CELTIMEOUT;  /* Timeout value underflowed */
          *SPRSTOP = 0;
          break;
        }
      }
      *SPRCNTU = 0;
    }

    SuperUnlockSemaphore(GrafBase->gf_CelSemaphore);
    return retvalue;
}


void
MapCel( CCB *ccb, Point *quad )
/* Take a cel and a cel and create position and delta values to map
 * its corners onto the specified quadrilateral.
 */
{

/* This routine should be in user mode */

        ccb->ccb_XPos = ((quad[0].pt_X<<16) & 0xffff0000) + 0x8000;
        ccb->ccb_YPos = ((quad[0].pt_Y<<16) & 0xffff0000) + 0x8000;
        ccb->ccb_HDX = ((quad[1].pt_X-quad[0].pt_X)<<20) / ccb->ccb_Width;
        ccb->ccb_HDY = ((quad[1].pt_Y-quad[0].pt_Y)<<20) / ccb->ccb_Width;
        ccb->ccb_VDX = ((quad[3].pt_X-quad[0].pt_X)<<16) / ccb->ccb_Height;
        ccb->ccb_VDY = ((quad[3].pt_Y-quad[0].pt_Y)<<16) / ccb->ccb_Height;
        ccb->ccb_HDDX = ((quad[2].pt_X-quad[3].pt_X-quad[1].pt_X+quad[0].pt_X)
                        << 20) / (ccb->ccb_Width*ccb->ccb_Height);
        ccb->ccb_HDDY = ((quad[2].pt_Y-quad[3].pt_Y-quad[1].pt_Y+quad[0].pt_Y)
                        << 20) / (ccb->ccb_Width*ccb->ccb_Height);
}


/* --- ------------------------------------------------------------------ */
/* --- ------------------------------------------------------------------ */
/* --- ------------------------------------------------------------------ */

void
zAddScreenGroup( Item sgitem, TagArg *targs )
{
/*???   List *list;*/
/*???   ScreenGroup *sg,*thissg;*/
/*???   int32 show,make;*/
/*???*/
/*???   show = GrafBase->gf_VDLSwitch;*/
/*???   make = 1 - show;*/
/*???*/
/*???   thissg = (ScreenGroup *)LocateItem( sgitem );*/
/*???   if ( (int32)thissg->sg_NextDisplay[show] != -1 ) return;*/
/*???*/
/*???   list = GrafBase->gf_ScreenGroupListPtr;*/
/*???   for( sg = (ScreenGroup *)FIRSTNODE( list ); ISNODE( list, sg ); */
/*???                    sg = (ScreenGroup *)NEXTNODE( sg ) )*/
/*???           {*/
/*???           sg->sg_NextDisplay[make] = sg->sg_NextDisplay[show];*/
/*???           sg->sg_VDLPtr[make][0] = sg->sg_VDLPtr[show][0];*/
/*???           sg->sg_VDLPtr[make][1] = sg->sg_VDLPtr[show][1];*/
/*???           }*/
/*???   thissg->sg_NextDisplay[make] = GrafBase->gf_FirstDisplay[show];*/
/*???   GrafBase->gf_FirstDisplay[make] = thissg; */
}


void
zRemoveScreenGroup( Item sgitem )
{
/*???   List *list;*/
/*???   ScreenGroup *sg,*thissg;*/
/*???   int32 show,make;*/
/*???*/
/*???   show = GrafBase->gf_VDLSwitch;*/
/*???   make = 1 - show;*/
/*???*/
/*???   thissg = (ScreenGroup *)LocateItem( sgitem );*/
```

```
/*???   if( (int32)thissg->sg_NextDisplay[show] == -1 ) return;*/
/*???*/
/*???   list = GrafBase->gf_ScreenGroupListPtr;*/
/*???   for( sg = (ScreenGroup *)FIRSTNODE( list ); ISNODE( list, sg );*/
/*???                   sg = (ScreenGroup *)NEXTNODE( sg ))*/
/*???           {*/
/*???           sg->sg_NextDisplay[make] = sg->sg_NextDisplay[show];*/
/*???           sg->sg_VDLPtr[make][0] = sg->sg_VDLPtr[show][0];*/
/*???           sg->sg_VDLPtr[make][1] = sg->sg_VDLPtr[show][1];*/
/*???           }*/
/*???*/
/*???   sg = GrafBase->gf_FirstDisplay[make] = GrafBase->gf_FirstDisplay[show];*/
/*???   if( sg == thissg )*/
/*???           GrafBase->gf_FirstDisplay[make] = thissg->sg_NextDisplay[make];*/
/*???   else*/
/*???           for( ; sg; sg = sg->sg_NextDisplay[make] )*/
/*???                   {*/
/*???                   if( sg->sg_NextDisplay[make] == thissg )*/
/*???                           {*/
/*???                           sg->sg_NextDisplay[make] = thissg->sg_NextDisplay[make];*/
/*???                           break;*/
/*???                           }*/
/*???                   }*/
/*???*/
/*???   thissg->sg_NextDisplay[make] = (ScreenGroup *)-1;*/
}


/* === ================================================================ */
/* === ================================================================ */
/* === ================================================================ */

int32
ControlVDL( Item screenItem, int32 clearflag, int32 setflag )
{
  Screen *screen;
  VDLEntry *entry, value;

  screen = (Screen *)CheckItem( screenItem, NODE_GRAPHICS, TYPE_SCREEN );
  if ( NOT screen ) {
    return GRAFERR_BADITEM;
  }
  if (screen->scr.n_Owner != CURRENTTASK->t.n_Item) {
    if (ItemOpened(CURRENTTASK->t.n_Item,screenItem)<0) {
      PRINTNOTOWNER (screen->scr.n_Item, CURRENTTASK->t.n_Item);
      return GRAFERR_NOTOWNER;
    }
  }

  /* JCR */
  entry = screen->scr_VDLPtr->vdl_DataPtr;
  value = *(entry + 4);
  value |= setflag;
  value = value & ~clearflag;
  *(entry + 4) = value;
  return 0;
}


int32
EnableVAVG( Item screenItem )
{
  return( ControlVDL( screenItem, 0, VDL_VINTEN ) );
}


int32
DisableVAVG( Item screenItem )
{
        return( ControlVDL( screenItem, VDL_VINTEN, 0 ) );
}


int32
EnableHAVG( Item screenItem )
{
        return( ControlVDL( screenItem, 0, VDL_HINTEN ) );
}
```

```
int32
DisableHAVG( Item screenItem )
{
        return( ControlVDL( screenItem, VDL_HINTEN, 0 ) );
}


/* --- ------------------------------------------------------------------ */
/* --- ------------------------------------------------------------------ */
/* --- ------------------------------------------------------------------ */

Item
internalCreateScreenGroup (ScreenGroup *sg, TagArg *args)
{
  SDEBUGVDL(("internalCreateScreenGroup( ScreenGroup=0x%x TagArg=0x%x\n",sg,args));
  sg->sg_Y = -1;                /* code for "screen location not yet allocated" */
  InitList (&sg->sg_SharedList, "ScreenGroup shared access list\n");
  return sg->sg.n_Item;
}


Item
internalCreateScreen (Screen *scr, void *args)
{
/*???   AddTail(GrafBase->gf_ScreenListPtr,(Node *)scr);*/
  InitList (&scr->scr_SharedList, "Screen shared access list\n");
  return scr->scr.n_Item;
}


struct _bmi {
  int32 w, h, cw, ch, cx, cy, wdog, cectrl;
  void *bmp;
};


static int32
icb (Bitmap *bm, struct _bmi *bmi, uint32 t, uint32 a)
{
  SSSDBUG (("Enter icb %lx %lx\n", t, a));
  switch (t) {
  case CBM_TAG_WIDTH:
    bmi->w = a;
    break;
  case CBM_TAG_HEIGHT:
    bmi->h = a;
    break;
  case CBM_TAG_BUFFER:
    bmi->bmp = (void*)a;
    break;
  case CBM_TAG_CLIPWIDTH:
    bmi->cw = a;
    break;
  case CBM_TAG_CLIPHEIGHT:
    bmi->ch = a;
    break;
  case CBM_TAG_CLIPX:
    bmi->cx = a;
    break;
  case CBM_TAG_CLIPY:
    bmi->cy = a;
    break;
  case CBM_TAG_WATCHDOGCTR:
    bmi->wdog = a;
    break;
  case CBM_TAG_CECONTROL:
    bmi->cectrl = a;
    break;
  default:
    return GRAFERR_BADTAG;
  }
  return 0;
}


Item
internalCreateBitmap (Bitmap *bm, TagArg *args)
{
```

```
int32 rc0, i;
Err e;
struct _bmi bmi;

SSSDBUG (("internalCreateBitmap(%lx,%lx)\n", (int32)bm, (int32)args));

memset (&bmi, 0, sizeof(bmi));

bmi.wdog = WATCHDOG_DEFAULT;
bmi.cectrl = CECONTROL_DEFAULT;

e = TagProcessor (bm, args, icb, &bmi);
if (e<0) {
  return e;
}

i=0;
while (bmi.w!=_rwmod[i][0]) {
  if (!_rwmod[i][0]) {
    return GRAFERR_BUFWIDTH;
  }
  i++;
}
rc0 = _rwmod[i][1];

switch (bmi.w) {
case 32  :
  rc0 = RMOD_32   | WMOD_32;
  break;
case 64  :
  rc0 = RMOD_64   | WMOD_64;
  break;
case 96  :
  rc0 = RMOD_96   | WMOD_96;
  break;
case 128 :
  rc0 = RMOD_128  | WMOD_128;
  break;
case 160 :
  rc0 = RMOD_160  | WMOD_160;
  break;
case 256 :
  rc0 = RMOD_256  | WMOD_256;
  break;
case 320 :
  rc0 = RMOD_320  | WMOD_320;
  break;
case 384 :
  rc0 = RMOD_384  | WMOD_384;
  break;
case 512 :
  rc0 = RMOD_512  | WMOD_512;
  break;
case 576 :
  rc0 = RMOD_576  | WMOD_576;
  break;
case 640 :
  rc0 = RMOD_640  | WMOD_640;
  break;
case 1024:
  rc0 = RMOD_1024 | WMOD_1024;
  break;
case 1056:
  rc0 = RMOD_1056 | WMOD_1056;
  break;
case 1088:
  rc0 = RMOD_1088 | WMOD_1088;
  break;
case 1152:
  rc0 = RMOD_1152 | WMOD_1152;
  break;
case 1280:
  rc0 = RMOD_1280 | WMOD_1280;
  break;
case 1536:
  rc0 = RMOD_1536 | WMOD_1536;
  break;
case 2048:
  rc0 = RMOD_2048 | WMOD_2048;
  break;
default:
  SSSDBUG (("w = %lx\n", bmi.w));
```

```
    return GRAFERR_BUFWIDTH;
  }

  if (bmi.h<1 || bmi.h>(1<<11)) {
    return GRAFERR_BADBITMAPSPEC;
  }

  e = SuperValidateMem (CURRENTTASK, (uint8*)bmi.bmp, bmi.w*bmi.h*2);
  if (e<0) {
    return GRAFERR_NOWRITEACCESS;
  }

  if (bmi.cw==0) {
    bmi.cw = bmi.w;
  }
  if (bmi.ch==0) {
    bmi.ch = bmi.h;
  }

  if (bmi.cx<0 || bmi.cx>=bmi.w || bmi.cy<0 || bmi.cy>=bmi.h || bmi.cw<0
      || (bmi.cx+bmi.cw)>bmi.w || bmi.ch<0 || (bmi.cy+bmi.ch)>bmi.h) {
    return GRAFERR_BADCLIP;
  }

  bm->bm_Buffer = (ubyte*)bmi.bmp;
  bm->bm_Width = bmi.w;
  bm->bm_Height = bmi.h;
  bm->bm_VerticalOffset = 0;
  bm->bm_Flags = 0;
  bm->bm_ClipWidth = bmi.cw;
  bm->bm_ClipHeight = bmi.ch;
  bm->bm_ClipX = bmi.cx;
  bm->bm_ClipY = bmi.cy;
  bm->bm_WatchDogCtr = bmi.wdog>>4;
  bm->bm_SysMalloc = 0;
  bm->bm_CEControl = bmi.cectrl;
  bm->bm_REGCTL0 = rc0;
  bm->bm_REGCTL1 = MAKE_REGCTL1 (bmi.w, bmi.h);
  bm->bm_REGCTL2 = (uint32)bmi.bmp;
  bm->bm_REGCTL3 = (uint32)bmi.bmp;

  InitList (&bm->bm_SharedList, "Bitmap shared access list\n");
  return bm->bm.n_Item;
}


Item
internalOpenScreenGroup (ScreenGroup *sg, void *args)
{
  /* For now, we require the args field to be NULL */
  if (args) {
    return GRAFERR_BADPTR;
  }
  return GRAFERR_NOTYET;
}


Item
internalOpenScreen (Screen *s, void *args)
{
  Err e;
  SharedListNode *sl;

  /* For now, we require the args field to be NULL */
  if (args) {
    return GRAFERR_BADPTR;
  }
  e = SuperOpenItem (s->scr_TempBitmap->bm.n_Item, 0);
  if (e<0) {
    return e;
  }
  sl = (SharedListNode*) SUPER_ALLOCMEM (sizeof(SharedListNode), MEMTYPE_ANY);
  if (!sl) {
    return GRAFERR_NOMEM;
  }
  sl->sl_TaskItem = CURRENTTASK->t.n_Item;
  AddTail (&s->scr_SharedList, (Node *)sl);
  return s->scr.n_Item;
}


Item
```

```
internalOpenBitmap (Bitmap *b, void *args)
{
  Err e;
  SharedListNode *sl;

  /* For now, we require the args field to be NULL */
  if (args) {
    return GRAFERR_BADPTR;
  }
  e = SuperValidateMem (CURRENTTASK, (uint8*)b->bm_Buffer, b->bm_Width*b->bm_Height*2);
  if (e<0) {
    return GRAFERR_NOWRITEACCESS;
  }
  sl = (SharedListNode*) SUPER_ALLOCMEM (sizeof(SharedListNode), MEMTYPE_ANY);
  if (!sl) {
    return GRAFERR_NOMEM;
  }
  sl->sl_TaskItem = CURRENTTASK->t.n_Item;
  AddTail (&b->bm_SharedList, (Node *)sl);
  return b->bm.n_Item;
}


Err
internalCloseScreenGroup (ScreenGroup *sg, Task *t)
{
  Node *n;
  for (n=FIRSTNODE(&sg->sg_SharedList); ISNODE(&sg->sg_SharedList,n); n=NEXTNODE(n)) {
    if (((SharedListNode *)n)->sl_TaskItem == t->t.n_Item) {
      RemNode(n);
      return 0;
    }
  }
  DEVBUG (("CloseScreenGroup failed\n"));
  DEVBUG (("Unable to find task item 0x%lx in shared list for item 0x%lx\n",
           t->t.n_Item, sg->sg.n_Item));
  return GRAFERR_INTERNALERROR;
}


int32
internalDeleteScreenGroup (ScreenGroup *sg, Task *t)
{
        Item sgi;

        sgi = sg->sg.n_Item;

        RemNode( (Node *)sg );  /* Unhook from other applications' groups */

        /* Delete any Screen items that refer to this Screen Group */
/*???   list = GrafBase->gf_ScreenListPtr;*/
/*???   scr = (Screen *)FIRSTNODE(list);*/
/*???   while(ISNODE(list,scr))*/
/*???           {*/
/*???           nextscr = (Screen *)NEXTNODE(scr);*/
/*???           if(scr->scr_ScreenGroupPtr == sg)*/
/*???                   SuperexternalDeleteItem(scr->scr.n_Item);*/
/*???           scr = nextscr;*/
/*???           }*/

        return 0;                                          /* Error free return */
}


Err
internalCloseScreen (Screen *scr, Task *t)
{
  Node *n;
  for (n=FIRSTNODE(&scr->scr_SharedList); ISNODE(&scr->scr_SharedList,n); n=NEXTNODE(n)) {
    if (((SharedListNode *)n)->sl_TaskItem == t->t.n_Item) {
      RemNode(n);
      return 0;
    }
  }
  DEVBUG (("CloseScreen failed\n"));
  DEVBUG (("Unable to find task item 0x%lx in shared list for item 0x%lx\n",
           t->t.n_Item, scr->scr.n_Item));
  return GRAFERR_INTERNALERROR;
}
```

Oct 28 12:07 1993 intgraf.c Page 10

```
int32
internalDeleteScreen (Screen *scr, Task *t)
{
  Node *n;

  SDEBUGVDL(("internalDeleteScreen called with screen ptr 0x%x\n",scr));

  while ( n=FIRSTNODE(&scr->scr_SharedList),ISNODE(&scr->scr_SharedList,n) ) {
    RemNode (n);
    SUPER_FREEMEM (n, sizeof(SharedListNode));
  }

  /* JCR */
  if ( GrafBase->gf_CurrentVDLEven == scr->scr_VDLPtr->vdl_DataPtr )
    GrafBase->gf_CurrentVDLEven = GrafBase->gf_VDLBlank;
  /* JCR */
  if ( GrafBase->gf_CurrentVDLOdd == scr->scr_VDLPtr->vdl_DataPtr )
    GrafBase->gf_CurrentVDLOdd = GrafBase->gf_VDLBlank;

  RemNode((Node *)scr);                    /* Unhook from list of screens */
  return 0;
}


Err
internalCloseBitmap (Bitmap *bm, Task *t)
{
  Node *n;
  for (n=FIRSTNODE(&bm->bm_SharedList); ISNODE(&bm->bm_SharedList,n); n=NEXTNODE(n)) {
    if (((SharedListNode *)n)->sl_TaskItem == t->t.n_Item) {
      RemNode(n);
      return 0;
    }
  }
  DEVBUG (("CloseBitmap failed\n"));
  DEVBUG (("Unable to find task item 0x%lx in shared list for item 0x%lx\n",
           t->t.n_Item, bm->bm.n_Item));
  return GRAFERR_INTERNALERROR;
}


int32
internalDeleteBitmap (Bitmap *bm, Task *t)
{
  Node *n;
  while ( n=FIRSTNODE(&bm->bm_SharedList),ISNODE(&bm->bm_SharedList,n) ) {
    RemNode (n);
    SUPER_FREEMEM (n, sizeof(SharedListNode));
  }
  RemNode ((Node*)bm);
  return 0;
}


Item
internalCreateGrafItem( void *n, uint8 ntype, void *args )
{
        SDEBUGITEM (("CreateGrafItem (0x%lx, %d, 0x%lx)\n", n, ntype, args));

        switch (ntype)
                {
                case TYPE_SCREENGROUP:
                        return internalCreateScreenGroup( (ScreenGroup *)n, (TagArg *)args );
                case TYPE_SCREEN:
                        return internalCreateScreen( (Screen *)n, (TagArg *)args );
                case TYPE_BITMAP:
                        return internalCreateBitmap( (Bitmap *)n, (TagArg *)args );
                case TYPE_VDL:
                        return internalCreateVDL( (VDL *)n, (TagArg *)args );
                }

        return( GRAFERR_BADSUBTYPE );
}


int32
internalDeleteGrafItem( Item it, Task *t )
{
        Node *n;
```

```
        SDEBUGITEM (("DeleteGrafItem (0x%lx, 0x%lx)\n", it, t));

        n = (Node *)LookupItem( it );

        switch (n->n_Type)
                {
                case TYPE_SCREENGROUP:
                        return internalDeleteScreenGroup ((ScreenGroup *)n, t);
                case TYPE_SCREEN:
                        return internalDeleteScreen ((Screen *)n, t);
                case TYPE_BITMAP:
                        return internalDeleteBitmap ((Bitmap *)n, t);
                case TYPE_VDL:
                        return internalDeleteVDL ((VDL *)n, t);
                }

        return( GRAFERR_INTERNALERROR );
}


Item
internalFindGrafItem (int32 ntype, TagArg *p)
{
        SDEBUGITEM (("FindGrafItem (%d, %s)\n", ntype, p));

        return( GRAFERR_NOTYET );
}


Item
internalOpenGrafItem (Node *n, void *args)
{
  SDEBUGITEM (("OpenGrafItem (%d, 0x%lx)\n", node, args));

  switch (n->n_Type) {
  case TYPE_SCREENGROUP:
    return internalOpenScreenGroup ((ScreenGroup *)n, args);
  case TYPE_SCREEN:
    return internalOpenScreen ((Screen *)n, args);
  case TYPE_BITMAP:
    return internalOpenBitmap ((Bitmap *)n, args);
  case TYPE_VDL:
    return internalOpenVDL ((VDL *)n, args);
  default:
    return( GRAFERR_INTERNALERROR );
  }
}


Item
internalCloseGrafItem (Item it, Task *t)
{
  Node *n;

  SDEBUGITEM (("CloseGrafItem (%d, 0x%lx)\n", node, args));

  n = (Node *)LookupItem (it);

  switch (n->n_Type) {
  case TYPE_SCREENGROUP:
    return internalCloseScreenGroup ((ScreenGroup *)n, t);
  case TYPE_SCREEN:
    return internalCloseScreen ((Screen *)n, t);
  case TYPE_BITMAP:
    return internalCloseBitmap ((Bitmap *)n, t);
  case TYPE_VDL:
    return internalCloseVDL ((VDL *)n, t);
  default:
    return GRAFERR_INTERNALERROR;
  }
}


/* === ================================================================ */
/* === ================================================================ */
/* === ================================================================ */

int32
```

```
SetClipWidth( Item bitmapItem, int32 clipwidth )
/*
 * Set the bitmap
 */
{
  Bitmap *bitmap;

/* This routine needs to be in supervisor mode and needs to do serious */
/* validity checking */

  bitmap = (Bitmap *)CheckItem( bitmapItem, NODE_GRAPHICS, TYPE_BITMAP );
  if ( !bitmap ) {
    return GRAFERR_BADITEM;
  }
  if (bitmap->bm.n_Owner != CURRENTTASK->t.n_Item) {
    if (ItemOpened(CURRENTTASK->t.n_Item,bitmapItem)<0) {
      PRINTNOTOWNER (bitmap->bm.n_Item, CURRENTTASK->t.n_Item);
      return GRAFERR_NOTOWNER;
    }
  }

  if (( clipwidth <= 0 ) || ( clipwidth + bitmap->bm_ClipX > bitmap->bm_Width )) {
    return GRAFERR_BADCLIP;
  }

  bitmap->bm_ClipWidth = clipwidth;
  bitmap->bm_REGCTL1 = MAKE_REGCTL1( bitmap->bm_ClipWidth, bitmap->bm_ClipHeight );

  return 0;
}


int32
SetClipHeight( Item bitmapItem, int32 clipheight )
/*
 * Set the bitmap
 */
{
  Bitmap *bitmap;

/* This routine needs to be in supervisor mode and needs to do serious */
/* validity checking */

  bitmap = (Bitmap *)CheckItem( bitmapItem, NODE_GRAPHICS, TYPE_BITMAP );
  if ( !bitmap ) {
    return GRAFERR_BADITEM;
  }
  if (bitmap->bm.n_Owner != CURRENTTASK->t.n_Item) {
    if (ItemOpened(CURRENTTASK->t.n_Item,bitmapItem)<0) {
      PRINTNOTOWNER (bitmap->bm.n_Item, CURRENTTASK->t.n_Item);
      return GRAFERR_NOTOWNER;
    }
  }

  if (( clipheight <= 0 ) || ( clipheight + bitmap->bm_ClipY > bitmap->bm_Height )) {
    return GRAFERR_BADCLIP;
  }

  bitmap->bm_ClipHeight = clipheight;
  bitmap->bm_REGCTL1 = MAKE_REGCTL1( bitmap->bm_ClipWidth, bitmap->bm_ClipHeight );

  return 0;
}


int32
SetClipOrigin( Item bitmapItem, int32 x, int32 y )
/*
 * Set the bitmap
 */
{
  int32 i;
  Bitmap *bitmap;

SDEBUG(("SetClipOrigin( "));
SDEBUG(("bitmapItem=$%lx ", (unsigned long)(bitmapItem)));
SDEBUG(("x=%ld ", (unsigned long)(x)));
SDEBUG(("y=%ld ", (unsigned long)(y)));
SDEBUG((" )\n"));
```

```
/* This routine needs to be in supervisor mode and needs to do serious */
/* validity checking */

  bitmap = (Bitmap *)CheckItem( bitmapItem, NODE_GRAPHICS, TYPE_BITMAP );
  if ( !bitmap ) {
    return GRAFERR_BADITEM;
  }
  if (bitmap->bm.n_Owner != CURRENTTASK->t.n_Item) {
    if (ItemOpened(CURRENTTASK->t.n_Item,bitmapItem)<0) {
      PRINTNOTOWNER (bitmap->bm.n_Item, CURRENTTASK->t.n_Item);
      return GRAFERR_NOTOWNER;
    }
  }

/*???*/
  if ( y & 1 ) {
    DEVBUG (("warning:  SetClipOrigin odd Y\n"));
    y = y & -2;
  }

  if (( x < 0 ) || ( x + bitmap->bm_ClipWidth > bitmap->bm_Width )
      || ( y < 0 ) || ( y + bitmap->bm_ClipHeight > bitmap->bm_Height )) {
    return GRAFERR_BADCLIP;
  }

  i = (y * bitmap->bm_Width + x * 2) * 2;
  i += (int32)(bitmap->bm_Buffer);
  if ( bitmap->bm_REGCTL2 == bitmap->bm_REGCTL3 ) {
    bitmap->bm_REGCTL2 = i;
  }
  bitmap->bm_REGCTL3 = i;
  bitmap->bm_ClipX = x;
  bitmap->bm_ClipY = y;

  return 0;
}


int32
SetScreenColor( Item screenItem, uint32 colorEntry )
{
        return( SetScreenColors( screenItem, &colorEntry, 1 ) );
}


int32
SetScreenColors( Item screenItem, uint32 *colorEntries, int32 count )
{
  uint32 i;
  ubyte index, red, green, blue;
  Screen *screen;
  uint32 colorEntry;

  /* This routine needs to be in supervisor mode */

  screen = (Screen *)CheckItem( screenItem, NODE_GRAPHICS, TYPE_SCREEN );
  if ( NOT screen ) {
    return GRAFERR_BADITEM;
  }
  if (screen->scr.n_Owner != CURRENTTASK->t.n_Item) {
    if (ItemOpened(CURRENTTASK->t.n_Item,screenItem)<0) {
      PRINTNOTOWNER (screenItem, CURRENTTASK->t.n_Item);
      return GRAFERR_NOTOWNER;
    }
  }
  if ( screen->scr_VDLType != VDLTYPE_SIMPLE ) {
    return GRAFERR_BADVDLTYPE;
  }

  for ( ; count > 0; count-- ) {
    colorEntry = *colorEntries++;
    index = (ubyte)(colorEntry >> 24);
    if ( index <= 32 ) {
      red = (ubyte)(colorEntry >> 16);
      green = (ubyte)(colorEntry >> 8);
      blue = (ubyte)(colorEntry >> 0);

      if (index==32) {
        i = MakeCLUTBackgroundEntry (red, green, blue);
      } else {
        i = MakeCLUTColorEntry (index, red, green, blue);
```

```
      }

      *(screen->scr_VDLPtr->vdl_DataPtr + 5 + index) = i;
    } else {
      return GRAFERR_INDEXRANGE;
    }
  }

  return 0;
}


RGB888
ReadCLUTColor (ulong index)
{
/*???   RGB888 c;*/
/*???*/
/*???   if ( index > 32 ) return 0xffffffff;*/
/*???   c = GrafBase->gf_VDL[index+GrafBase->gf_LineHeaderSize] & 0x00ffffff;*/
/*???#ifdef __SHERRIE*/
/*???   {*/
/*???           ulong r,g,b;*/
/*???           r = (c>>16)&0xff;*/
/*???           g = (c>>8)&0xff;*/
/*???           b = c&0xff;*/
/*???           r = ((r-16)*255)/(235-16);*/
/*???           g = ((g-16)*255)/(235-16);*/
/*???           b = ((b-16)*255)/(235-16);*/
/*???           c = (r<<16) + (g<<8) + b;*/
/*???   }*/
/*???#endif*/
/*???   return c;*/

return 0;
}


int32
ResetScreenColors( Item screenItem )
{
  ulong i;
  ubyte color;
  int32 colorEntry;
  int32 retvalue;

  /*??? This routine would be faster (and fatter) if we calculated
   * the screen address once and poked the values directly
   */
  for ( i = 0; i < 32; i++ ) {
    color = (ubyte)(( i * 255 ) / 31);
    colorEntry = MakeCLUTColorEntry(i, color, color, color );
    retvalue = SetScreenColor( screenItem, colorEntry );
    if ( retvalue < 0 ) goto DONE;
  }

  retvalue = 0;

DONE:
  return( retvalue );
}


int32 ResetReadAddress( Item bitmapItem )
{
  Bitmap *bitmap;
  int32 i3;

  bitmap = (Bitmap *)CheckItem( bitmapItem, NODE_GRAPHICS, TYPE_BITMAP );
  if ( !bitmap ) {
    return GRAFERR_BADITEM;
  }
  if (bitmap->bm.n_Owner != CURRENTTASK->t.n_Item) {
    if (ItemOpened(CURRENTTASK->t.n_Item,bitmapItem)<0) {
      PRINTNOTOWNER (bitmap->bm.n_Item, CURRENTTASK->t.n_Item);
      return GRAFERR_NOTOWNER;
    }
  }

  i3 = (bitmap->bm_REGCTL0 & WMOD_MASK);
  bitmap->bm_REGCTL0 = i3 | ( ((i3 >> WMOD_SHIFT) << RMOD_SHIFT) & RMOD_MASK );
  bitmap->bm_REGCTL2 = bitmap->bm_REGCTL3;
```

```
  return 0;
}


Err
SetReadAddress( Item bitmapItem, ubyte *buffer, int32 width )
{
  Bitmap *bitmap;
  int32 i, rc0;

  bitmap = (Bitmap *)CheckItem( bitmapItem, NODE_GRAPHICS, TYPE_BITMAP );
  if ( !bitmap ) {
    return GRAFERR_BADITEM;
  }
  if (bitmap->bm.n_Owner != CURRENTTASK->t.n_Item) {
    if (ItemOpened(CURRENTTASK->t.n_Item,bitmapItem)<0) {
      PRINTNOTOWNER (bitmap->bm.n_Item, CURRENTTASK->t.n_Item);
      return GRAFERR_NOTOWNER;
    }
  }

  i=0;
  while (width!=_rwmod[i][0]) {
    if (!_rwmod[i][0]) {
      return GRAFERR_BUFWIDTH;
    }
    i++;
  }
  rc0 = _rwmod[i][1]&RMOD_MASK;

  bitmap->bm_REGCTL0 = (bitmap->bm_REGCTL0 & (~RMOD_MASK)) | rc0;
  bitmap->bm_REGCTL2 = (int32)buffer;

  return 0;
}
```

The above disclosure is to be taken as illustrative of the invention, not as limiting its scope or spirit. Numerous modifications and variations will become apparent to those skilled in the art after studying the above disclosure. For example, the invention is not restricted to RGB formats. Other digital formats such as YCC, or Composite Video Broadcast Standard (CVBS), can also be used. For the sake of simplification, an RGB format was assumed above.

Given the above disclosure of general concepts and specific embodiments, the scope of protection sought is to be defined by the claims appended hereto.

What is claimed is:

1. A method for preparing a list of configuration control words for download from system memory to a programmably re-configurable image-enhancing and display subsystem, wherein the image-enhancing and display subsystem is configured by the downloaded configuration control words and accordingly processes and outputs display signals representing image lines, said preparation method comprising the steps of:

(a) defining in a first region of the system memory, a first control word having a ListLen field, where the first control word is to be processed before all optional control words, if any, of the first region and where the ListLen field indicates a number of optional additional control words that are to be included if at all in the first region and that are to be downloaded after the first control word, said first control word and optional additional control words of the first region being used upon download for configuring the image-enhancing and display subsystem before the processing and output by the image-enhancing and display subsystem of display signals representing a corresponding first set of one or more image lines;

(b) defining in said first memory region, a second control word, where the second control word includes a pointer to a first portion of a memory buffer containing first image data corresponding to the first set of one or more image lines;

(c) defining in said first memory region, a third control word; and (d) defining in said first memory region, a fourth control word, where the fourth control word includes a pointer to a next memory region having next control words to be optionally next downloaded for re-configuring the image-enhancing and display subsystem.

2. The download preparation method of claim 1 wherein the third control word includes a pointer to a second portion of said memory buffer containing respective second image data corresponding to the first set of one or more image lines, where the first and second image data can be combined to enhance the apparent resolution of the display signals output by the image-enhancing and display subsystem.

3. The download preparation method of claim 1 wherein:

said pointer to the next memory region within the fourth control word can be relative or absolute; and the first control word further includes a NexVLCBr field indicating whether the pointer of the fourth control word is relative or absolute.

4. The download preparation method of claim 1 wherein:

the first control word further includes a NoLines field indicating how many image lines are contained in said first set of one or more image lines, the indicated number of image lines being those whose corresponding display signals are to be processed and output by the image-enhancing and display subsystem while said subsystem is configured according to the downloaded first control word and optional additional control words.

5. The download preparation method of claim 1 wherein:

the first control word further includes an EnVDMA field that indicates whether or not a video DMA operation should be enabled in response to downloading of said first control word.

6. The download preparation method of claim 1 wherein:

the first control word further includes a NexPline field that indicates whether, in response to downloading of said first control word, a previous-video-line address for each subsequent scan line is to be calculated by adding a predefined modulo or by defining it as the previously used current-video line address.

7. The download preparation method of claim 1 wherein:

the first control word further includes a CAValid field that indicates whether, in response to downloading of said first control word, to use a normally incremented current-line video address or to use a new current-line video address defined by the pointer of said second control word.

8. The download preparation method of claim 1 wherein:

the first control word further includes a VRes field that indicates whether, in response to downloading of said first control word, the image-enhancing and display subsystem will or will not double the number of horizontal lines in an image defined by display signals supplied to the subsystem.

9. The download preparation method of claim 1 further comprising the steps of:

(a2) defining in a second region of the system memory that is pointed to by said pointer to a next memory region of the first region, another first control word having another Listnen field, where said another first control word is to be processed before all optional control words, if any, of the second region and where said another ListLen field indicates a number of optional additional control words that are to be included if at all in the second region and that are to be downloaded after said another first control word, said another first control word and its optional additional control words of the second region being used upon download for configuring the image-enhancing and display subsystem before the processing and output by the image-enhancing and display subsystem of display signals representing a corresponding second set of one or more image lines;

(b2) defining in said second memory region, another second control word, where said another second control word includes a pointer to a first portion of another memory buffer containing first image data corresponding to the second set of one or more image lines;

(c2) defining in said second memory region, another third control word; and (d2) defining in said second memory region, another fourth control word, where said another fourth control word includes a pointer to another next memory region having next control words to be optionally next downloaded for re-configuring the image-enhancing and display subsystem.

10. A method for preparing a list of configuration control words for download from system memory to a programmably re-configurable image-enhancing and display subsystem, wherein the image-enhancing and display subsystem is configured by the downloaded configuration control words and accordingly processes and outputs display signals representing image lines, said preparation method comprising the steps of:

(a) defining in a first region of the system memory, a first control word having a ListLen field, where the first control word is to be processed before all optional control words, if any, of the first region and where the listLen field indicates a number of optional additional control words that are to be included if at all in the first region and that are to be downloaded after the first control word, said first control word and optional additional control words of the first region being used upon download for configuring the image-enhancing and display subsystem before the processing and output by the image-enhancing and display subsystem of display signals representing a corresponding first set of one or more image lines; and (b) defining in said first memory region, a second control word, where the second control word includes a pointer to a next memory region having next control words to be optionally next downloaded for re-configuring the image-enhancing and display subsystem.

* * * * *

UNITED STATES PATENT AND TRADEMARK OFFICE

CERTIFICATE OF CORRECTION

PATENT NO. : 5,502,462

DATED : March 26, 1996

INVENTOR(S) : Robert J. Mical et al.

It is certified that error appears in the above-indentified patent and that said Letters Patent is hereby corrected as shown below:

Column 18, lines 7 and 17, "Sport" should be --"S-port--.
Column 21, line 46, "col" should be --cel--.
Column 35, line 29, "callo" should be --call.--
Column 40, line 1, "humPages" should be --numPages--;
Column 172, line 35, "Listnen" should be --ListLen--.
Column 173, line 8, "listLen" should be --ListLen--.

Signed and Sealed this

Twenty-ninth Day of October 1996

*Attest:*

Bruce Lehman

BRUCE LEHMAN

*Attesting Officer*

*Commissioner of Patents and Trademarks*